US006543644B2

(12) United States Patent
Makino et al.

(10) Patent No.: US 6,543,644 B2
(45) Date of Patent: Apr. 8, 2003

(54) BAG STORING LIQUID AND CONTAINER STORING THE BAG

(75) Inventors: Hideya Makino, Takayama (JP); Yutaka Iwashita, Takayama (JP)

(73) Assignee: Kabushiki Kaisha Makino Sogo Kenkyujo, Gifu-ken (JP)

( * ) Notice: Subject to any disclaimer, the term of this patent is extended or adjusted under 35 U.S.C. 154(b) by 0 days.

(21) Appl. No.: 09/730,114

(22) Filed: Dec. 5, 2000

(65) Prior Publication Data

US 2001/0000398 A1 Apr. 26, 2001

(30) Foreign Application Priority Data

| | | |
|---|---|---|
| Apr. 4, 1999 | (JP) | 11-103887 |
| Jul. 23, 1999 | (JP) | 11-209359 |
| Jul. 23, 1999 | (JP) | 11-209371 |
| Oct. 20, 1999 | (JP) | 11-298731 |
| Oct. 20, 1999 | (JP) | 11-298732 |

(51) Int. Cl.[7] ..... B67D 5/00

(52) U.S. Cl. ..... 222/81; 222/80; 222/105; 206/521

(58) Field of Search ..... 222/81, 83, 80, 222/105; 206/521

(56) References Cited

U.S. PATENT DOCUMENTS

| | | | | |
|---|---|---|---|---|
| 2,831,610 A | * | 4/1958 | Dennie | 222/105 |
| 3,437,256 A | * | 4/1969 | Miller, Jr. et al. | 229/23 |
| 4,483,464 A | * | 11/1984 | Nomura | 222/83 |
| 4,572,422 A | * | 2/1986 | Henberger et al. | 229/7 |
| 4,599,625 A | * | 7/1986 | Terasawa et al. | 346/140 |
| 4,660,737 A | | 4/1987 | Green et al. | |
| 4,669,627 A | * | 6/1987 | Ueda et al. | 220/94 |
| 4,723,689 A | * | 2/1988 | Vallos et al. | 222/91 |
| 4,964,536 A | * | 10/1990 | Vestering | 222/83 |
| 5,048,691 A | | 9/1991 | Heuberger et al. | |
| 5,273,171 A | * | 12/1993 | Steele-Rowland et al. | 215/11.1 |
| 5,829,637 A | * | 11/1998 | Takemura et al. | 222/81 |
| 6,223,981 B1 | * | 5/2001 | Gunder | 229/242 |
| 6,253,993 B1 | * | 7/2001 | Lloyd et al. | 229/117.3 |

FOREIGN PATENT DOCUMENTS

| | | |
|---|---|---|
| JP | 06092370 | 4/1994 |
| JP | 09323740 | 12/1997 |
| JP | 10-101140 | 4/1998 |

* cited by examiner

*Primary Examiner*—Henry C. Yuen
*Assistant Examiner*—Frederick C. Nicolas
(74) *Attorney, Agent, or Firm*—Cherskov & Flaynik

(57) ABSTRACT

A container (11) for a liquid containing bag. The container is capable of adjusting the flow rate of a liquid (41) to be poured out. The container includes a container body (12) having an opening (24), and a cap (13) for selectively closing the opening. The container body is closed by a pair of lids (17). The upper end portion of the bag (42) is supported between mating faces (25) of the lids. The cap has fasteners (37) for clamping the upper end portion of the bag. When the cap is slid along grooves (26) formed in the lids, the fasteners close a pourer (43) of the bag.

12 Claims, 44 Drawing Sheets

BAG STORING LIQUID AND CONTAINER STORING THE BAG

This application claims priority per 35 U.S.C. §119 (a) and §365 to various Japanese Patent Application Nos.: 11/103887, 11/209359, 11/209371, 11/298731, 11/298732.

TECHNICAL FIELD

The present invention relates to a bag for containing a liquid and a container for accommodating the bag. Specifically, the present invention relates to a liquid containing bag made of a soft material and a container made of a hard material for accommodating the bag.

BACKGROUND ART

Japanese Utility Model Registration Publication No. Sho 58-37803 discloses a conventional holder 300 for a fluid filling bag illustrated in FIGS. 58(*a*) to 58(*c*). The holder 300 has two curved walls 301 and two flip plates 303, which connected by hinges 302 in upper and lower openings of the curved walls 301. One of the flip plates 303 elastically flips between an open position (convex position) and a closed position (concave position). As illustrated in FIG. 58(*b*), when the flip plate 303 is switched to the open position, an opening is formed in the holder 300, and a cavity 304 is formed between the two curved walls. A window 305 is formed in an end portion of the curved wall 301. This window 305 is selectively closed by a sliding plate 306. A bag 307 filled with a fluid is accommodated in the holder 300. A protrusion (lip) 308 is formed on the top surface of the bag 307, and the protrusion 308 extends through the window 305 of the holder.

When the body of the bag 307 is pressed, the fluid flows from the bag. On the other hand, by fastening the lip 308 of the bag between the sliding plate 306 and the window 305, the opened bag closes. Thus, the holder 300 retains the remaining fluid.

However, since the sliding plate 306 only opens or closes the window 305, the conventional holder 300 cannot adjust the flow rate of the fluid that flows from the lip 308.

DISCLOSURE OF THE INVENTION

It is an object of the present invention to provide a container for accommodating a liquid containing bag capable of adjusting the flow rate of liquid from the bag and a liquid containing bag suitable for use with the container.

To achieve the above object, a first aspect of the present invention provides a container for accommodating a bag that contains a liquid. The container has a container body having an opening, which can be opened and closed, and a removable cap member on the container body for closing the opening. The container body includes a supporter for supporting the upper end portion of the bag and an engaging portion for engagement with the cap member. The cap member includes a fastener for clamping the upper end portion of the bag that is exposed through the opening.

A second aspect of the present invention provides a holder for holding a bag that contains a liquid. The holder has a pair of holding members having an opening and capable of opening and closing, and a cap member capable of closing the opening, and removably disposed on the holding members. The holding members include a supporter for supporting the upper end portion of the bag, and an engaging portion for engagement with the cap member. The cap member includes a fastener for clamping the upper end portion of the bag.

A third aspect of the present invention provides a bag for containing a liquid. The bag has an upper thermally welded zone at the upper end portion of the bag, and a lower thermally welded zone at the lower end portion of the bag. The upper thermally welded zone has first and second ends, and the lower thermally welded zone has third and fourth ends. At least one of the first, second, third and fourth ends includes a pouring zone having a width smaller than the corresponding thermally welded zone.

Other aspects and advantages of the present invention will become apparent from the following description together with the drawings illustrating examples of the principles of the present invention.

BRIEF DESCRIPTION OF THE DRAWINGS

Characteristics of the present invention which are believed to be novel are apparent particularly in the appended claims. The present invention together with its object and advantages will be understood from the following description of presently preferred embodiments with reference to the accompanying drawings.

FIG. 6(*b*) is a cross-sectional view of the cap taken along the line 6*b*—6*b* in FIG. 3;

FIG. 15(*b*) is a cross-sectional view of the cap of FIG. 15(*a*);

FIG. 36(*b*) is a cross-sectional view of the container taken along the line 36*b*—36*b* in FIG. 35;

FIG. 39(*b*) is a perspective view of FIG. 39(*a*);

FIG. 41 is an developed plan of the bag of FIG. 41(*a*);

FIG. 58(*c*) is a cross-sectional view of a bag contained in the holder of FIGS. 58(*a*), 58(*b*).

BEST MODE FOR CARRYING OUT THE INVENTION

A first embodiment of the present invention will be described below in detail with reference to the drawings.

Figure 1:
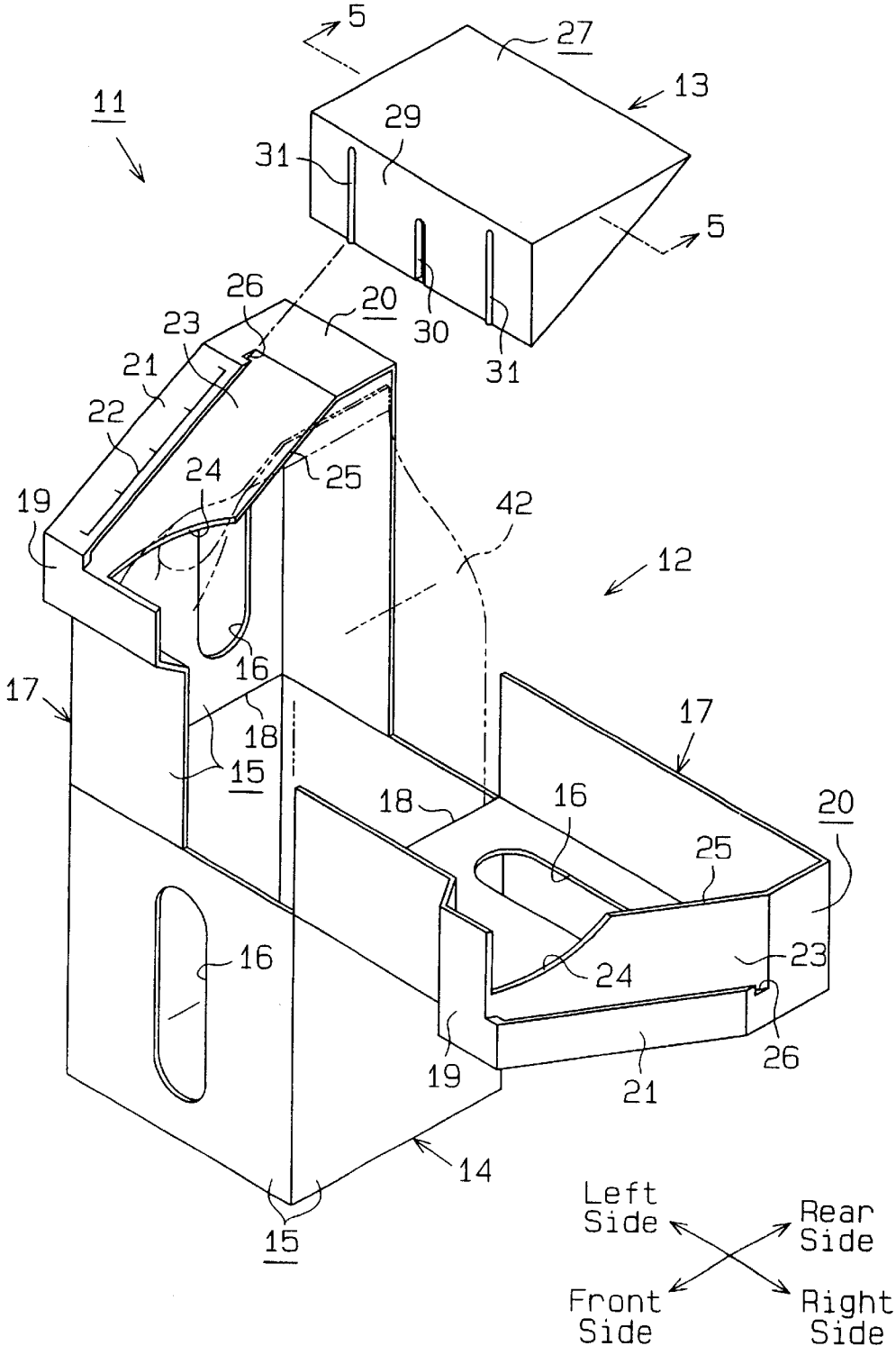
FIG. 1 is a perspective view of a container for a liquid containing bag according to a first embodiment of the present invention.

As illustrated in FIG. 1, a container 11 for a liquid containing bag according to the first embodiment has a container body 12 and a removable cap 13. The container 11, which is made of a relatively hard synthetic resin, accommodates a bag 42, which is indicated by imaginary lines in FIG. 1. The bag 42 may contain liquid 41 such as mineral water, juice, or the like. The bag 42 is preferably made of a soft synthetic resin, and more preferably of polyethylene.

The container body 12 has a lower box 14, and a pair of lids 17. The lower box 14 has four side walls 15. The pair of lids 17 are symmetric to each other. The lids 17 are coupled to two side walls 15 of the lower box 14, which are opposite to each other, through hinges 18. The lids 17 are each movable between an open position and a closed position through the associated hinges 18. When the lids 17 are closed, a containing space for containing the bag 42 is formed in the container body 12.

A side wall 15 positioned on the front side of the container body 12 is formed with an elongated window 16 through which the amount of liquid 41 in the bag 42 can be seen. Also, both lids 17 are formed with a beak 19 extending frontward from the top to increase the space within the container body 12. Both lids 17 have outer inclined surfaces 21, respectively, which are inclined from the beaks 19 to top walls 20. A scale 22 is marked on the outer inclined surface 21 of the left lid 17.

Figure 2:
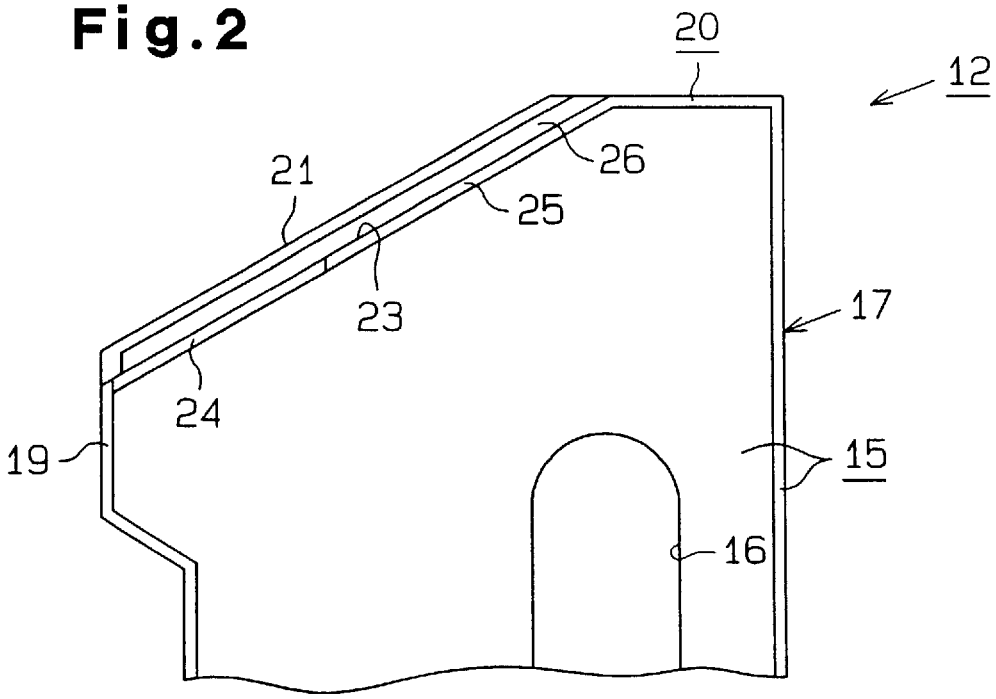
FIG. 2 is a partial cross-sectional view of the container body in FIG. 1.

A portion of the beak 19 that is inward of each outer inclined surface 21 is formed with an inner inclined surface 23 parallel with the outer inclined surface 21. Both inner inclined surfaces 23 are formed with fan-shaped openings 24, respectively. When the lids 17 are closed, clamping faces 25 are formed by mating surfaces of the inner inclined surfaces 23 for clamping the upper portion of the bag 42. As illustrated in FIGS. 1 and 2, a sliding groove 26 is formed between each outer inclined surface 21 and each inner inclined surface 23.

As illustrated in FIG. 1 and FIGS. 3 through 6, a cap 13 has a top lid 27 in the shape of a hollow triangular block and a pair of supporters 28 accommodated in the top lid 27. The top lid 27 has a front wall 29, which is formed with a pair of sliding rails 31 as a guide. As indicated by one-dot chain lines in FIG. 8, each sliding rail 31 is formed at a position at which it engages the inner edge of a corresponding outer inclined surface 21. A slot 30 is also formed midway between the sliding rails 31.

Figure 3:
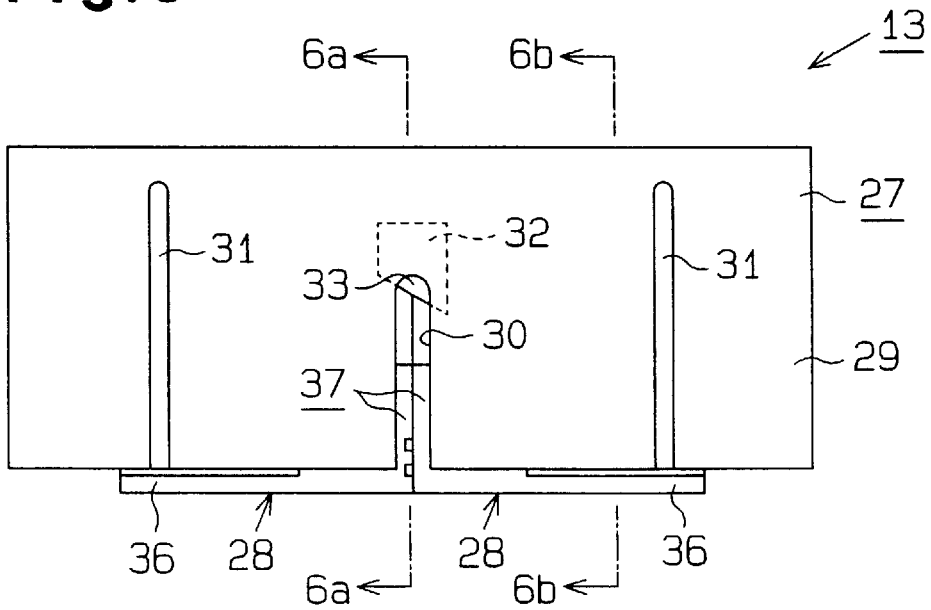
FIG. 3 is a front view of the cap in FIG. 1.
Figure 5:
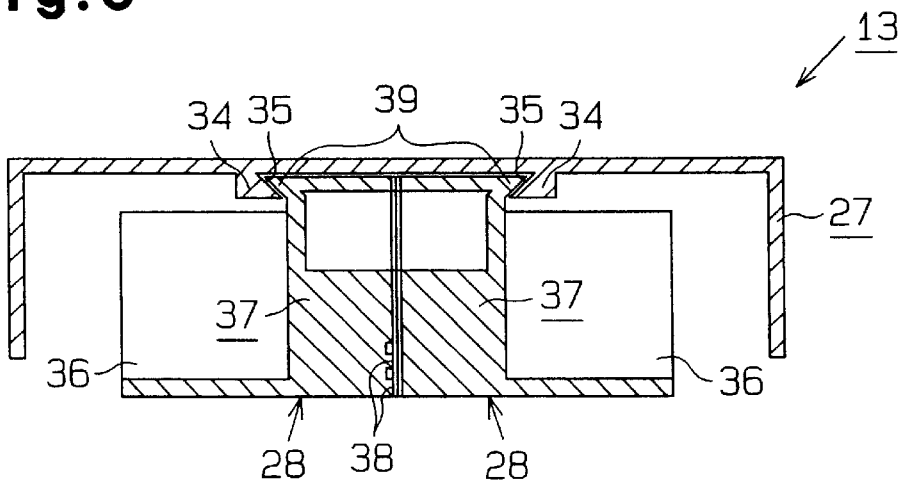
FIG. 5 is a cross-sectional view of the cap taken along the line 5—5 in FIG. 1.
Figure 6A:
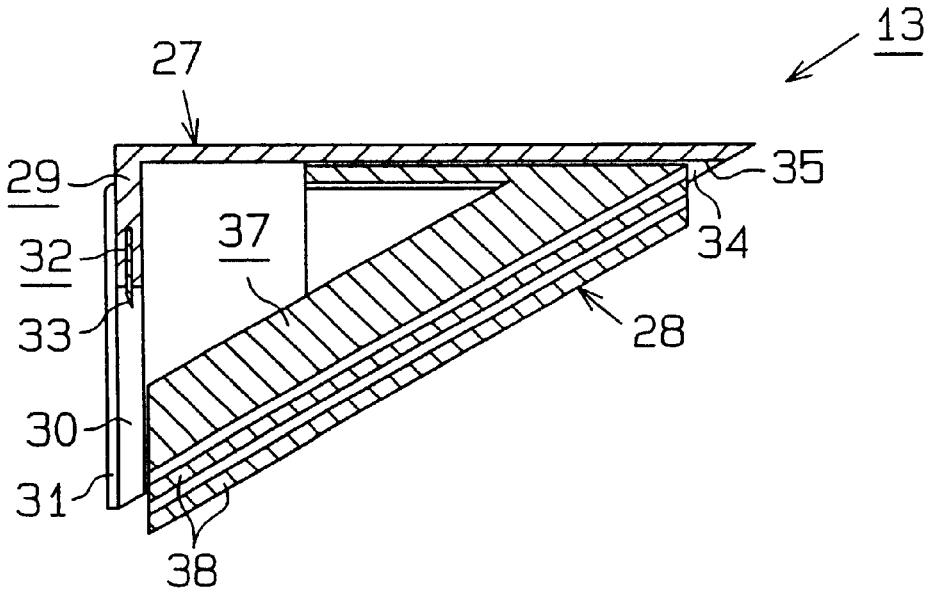
FIG. 6(*a*) is a cross-sectional view of the cap taken along the line 6*a*—6*a* in FIG. 3.
Figure 6B:
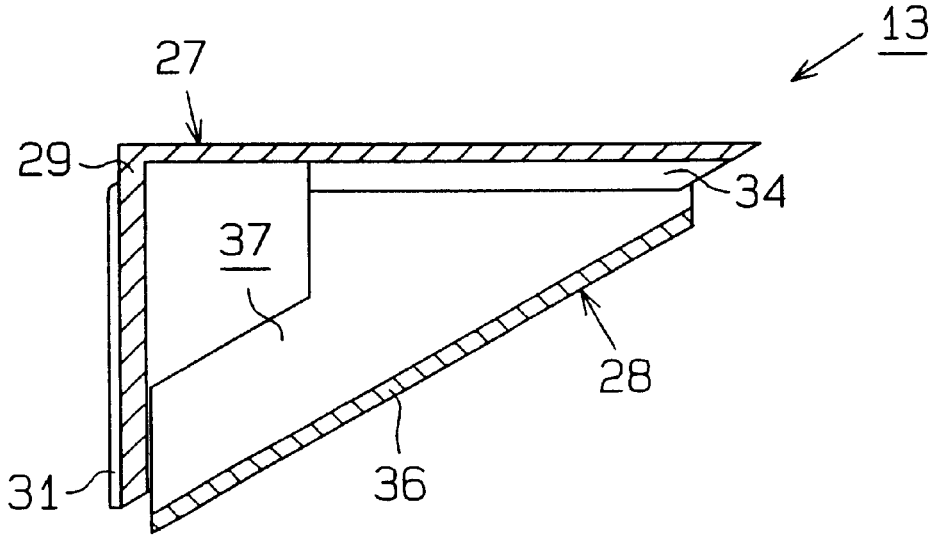

As illustrated in FIG. 3, a blade 32 made of a steel material is attached to the front wall 29. Specifically, as illustrated in FIG. 6(*a*), the blade 32 is embedded in the front wall 29 such that a portion of its edge 33 is exposed in the slot 30. Also, as illustrated in FIGS. 5, 6(*a*) and 6(*b*), a pair of rails 34 are formed on the inner lower surface of the top lid 27. A key groove (so-called dovetail groove) 35 is formed inside of each rail 34.

Figure 4:
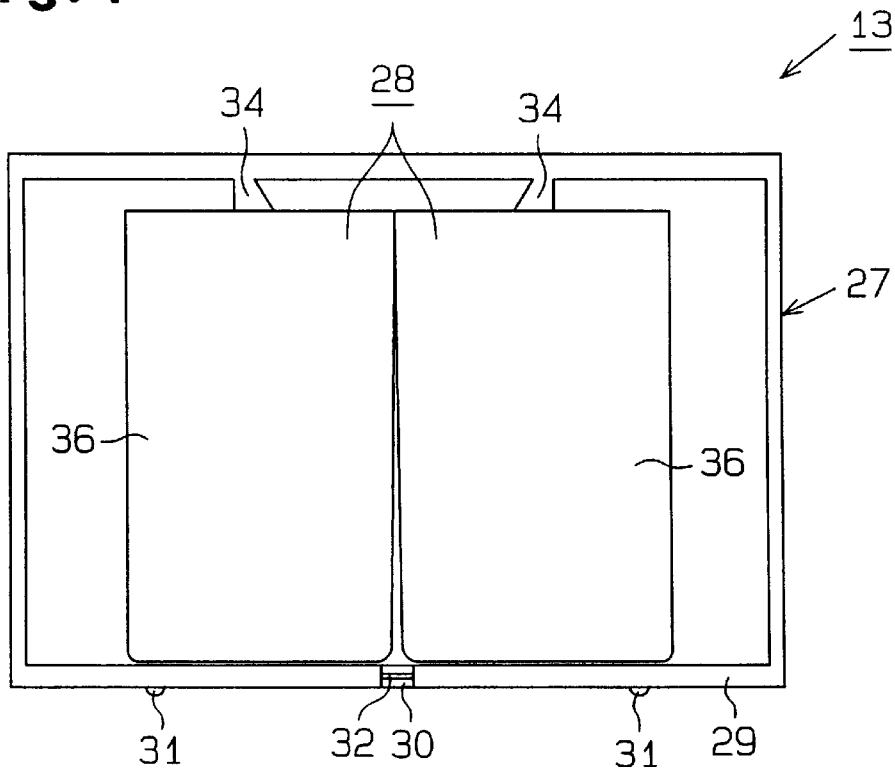
FIG. 4 is a bottom view of the cap in FIG. 1.

As illustrated in FIGS. 3 through 5, the pair of supporters 28 are substantially symmetric. A sliding plate 36 is formed below each supporter 28. A gap is formed between the sliding plates 36, and both sliding plates 36 are inclined such that the gap is wider at locations closer to the slot 30. Also, the two corners of each sliding plate 36 that are positioned near the front wall 29 are chamfered. The sliding plates 36 engage with and slide with respect to the corresponding sliding grooves 26 of the beaks 19. This allows the cap 13 to slide along the inclined surfaces 21, 23 of the container body 12 to selectively close the opening 24.

As illustrated in FIGS. 5, 6(*a*) and 6(*b*), fasteners 37 are integrally formed on top surfaces of the sliding plates 36. Similar to the sliding plates 36, the fasteners 37 are inclined such that a gap between the fasteners 37 becomes wider toward the front wall 29. Opposing faces (inner faces) of the fasteners 37 and opposing faces between the sliding plates 36 are at the same level. In addition, two grooves are formed in the inner face of one of the supporters 28, and by the grooves, two fastening rails 38 are formed extending parallel to the surfaces of the sliding plates 36. Each supporter 28 has a key 39 which is engaged with a key groove 35. Through engagement of each key 39 with the corresponding key groove 35, the pair of supporters 28 are mounted to the top lid 27.

Figure 7:
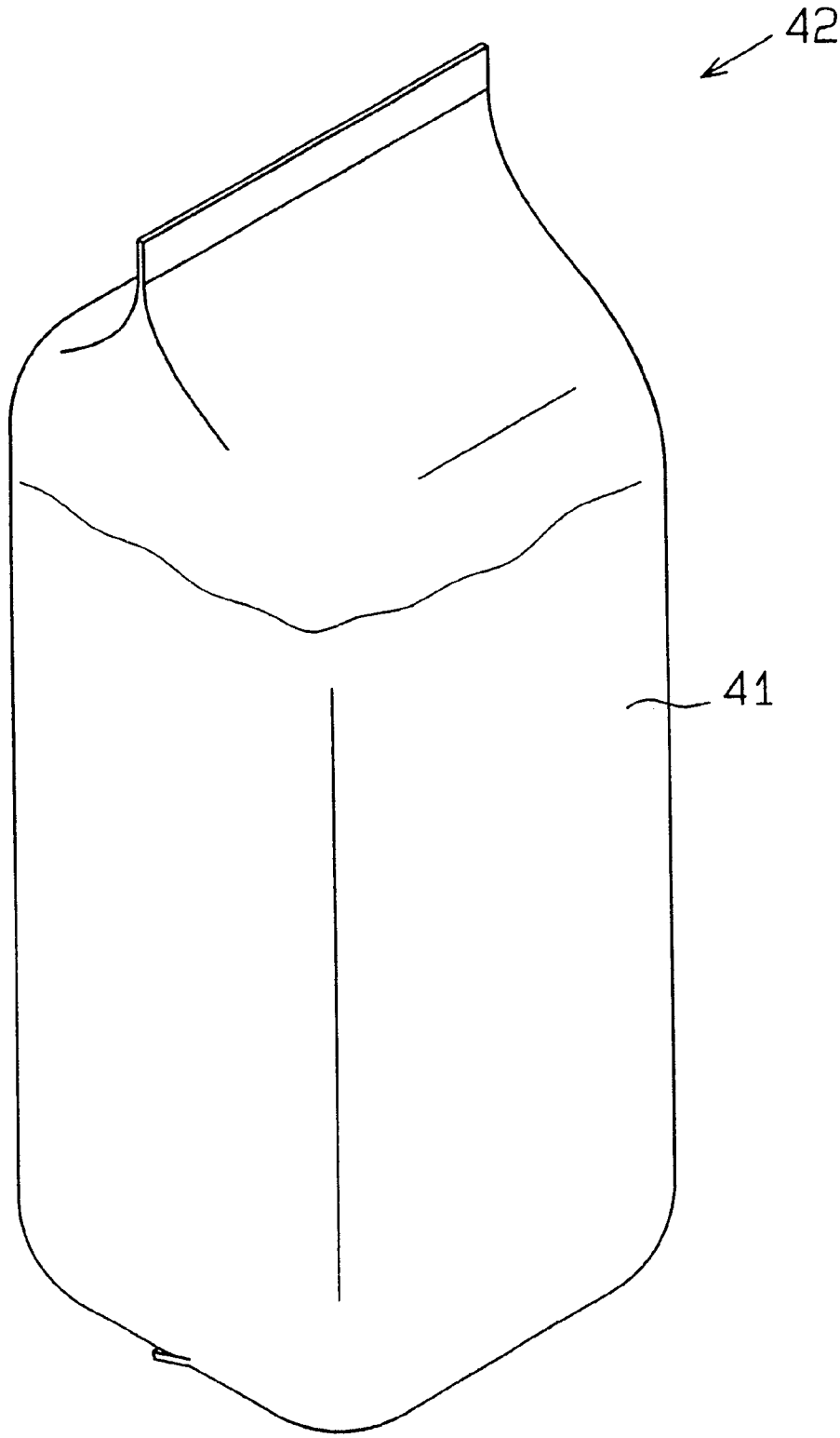
FIG. 7 is a perspective view of a bag according to the first embodiment of the present invention.

As illustrated in FIG. 7, the bag 42 is manufactured in the following manner. First, a polyethylene sheet is formed into a cylindrical shape. One of openings of the cylinder is folded and thermally welded. Next, the bag 42 is filled with a liquid 41. The other opening is folded and thermally welded.

In the following the use of the container 11 will be described.

Figure 8:
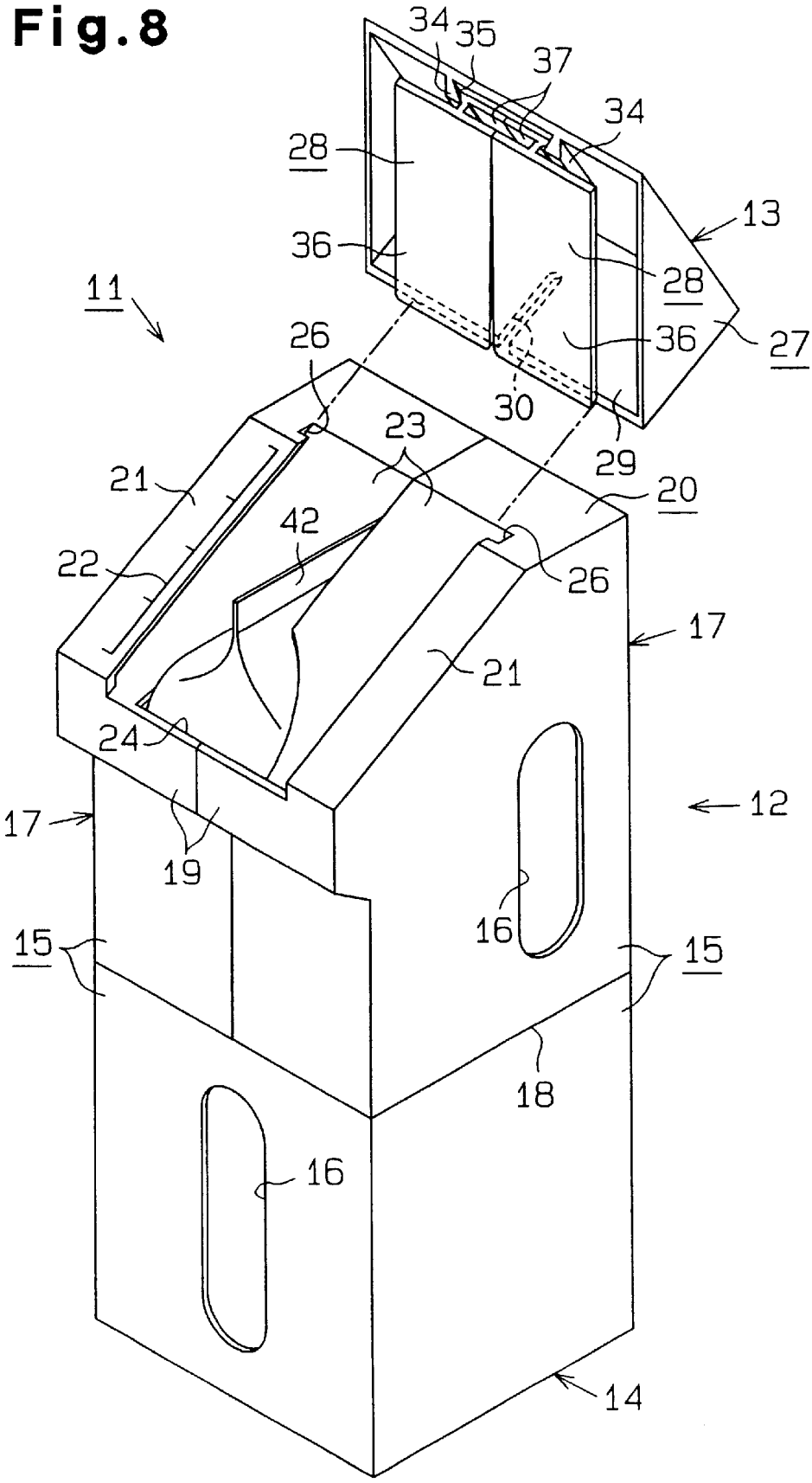
FIG. 8 is a perspective view of the container which contains the bag of FIG. 7.

For placing the bag 42 in the container 11, the lids 17 are first opened, and the bag 42 is inserted into the container body 12. The upper end of the bag 42 is held upward, and the lids 17 are closed. In this way, as illustrated in FIG. 8, the top corner portion of the bag 42 is located outside of the container body 12 (opening 24), with the upper corner portion clamped between the clamping faces 25. As a result, the bag 42 is fixed to the container body 12.

Figure 9:
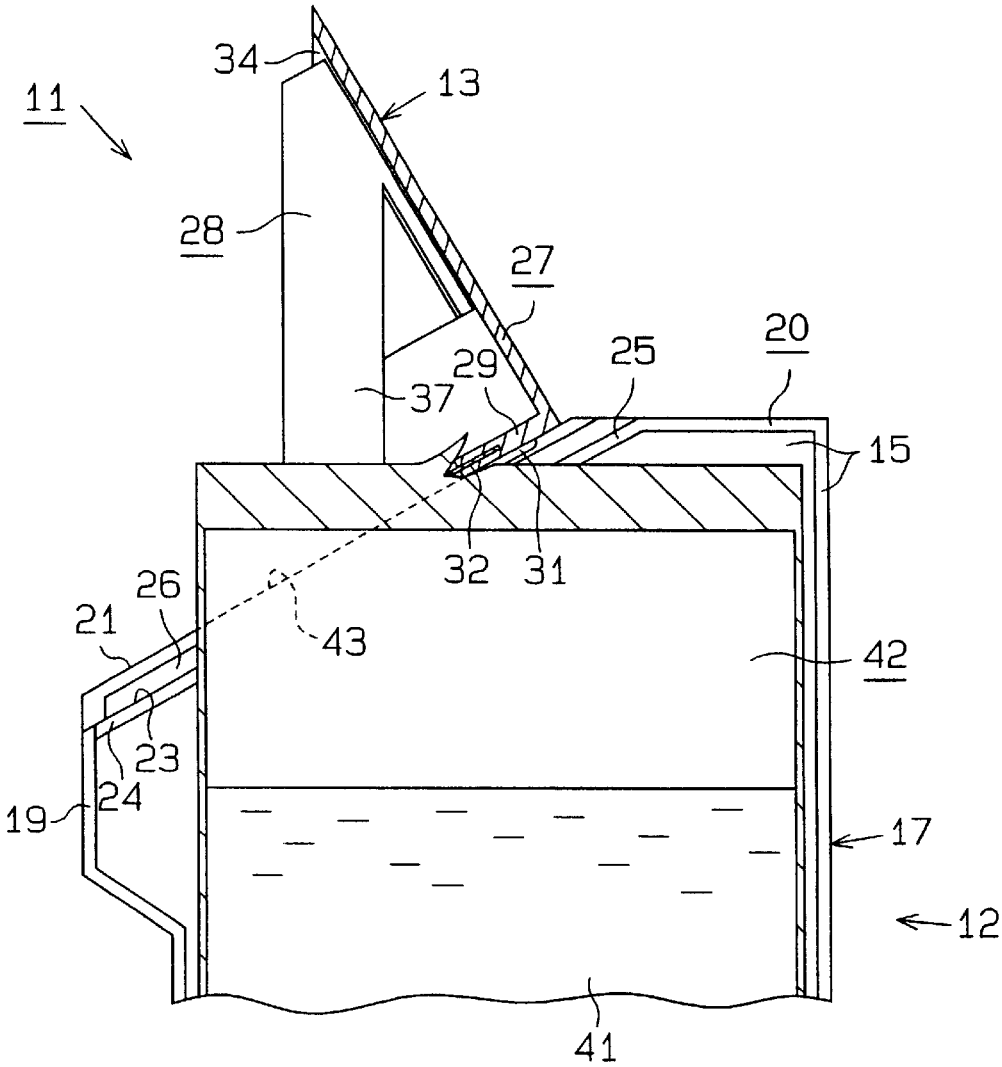
FIG. 9 is a cross-sectional view of a bag opening step.

Subsequently, the top corner portion of the bag 42 is cut using the cap 13. Specifically, the cap 13 is oriented in a direction shown in FIG. 8. Next, as illustrated in FIG. 9, the sliding rails 31 of the cap 13 are engaged with the inner edges of the outer inclined surfaces 21 of the container body 12, and the cap 13 is slid along the inner edges. Then, the top corner portion of the bag 42 is inserted into the slot 30 of the cap 13, and cut by the edge 33 of the blade 32. In this way, the bag 42 is formed with a pourer 43, and is opened. The top end of the opened bag 42 is gripped by the lids 17, and the bag 42 is covered with the container body 12, so that the bag 42 is protected from deformation and does not fall down. Therefore, the liquid 41 is prevented from pouring out of the bag 42.

Figure 10:
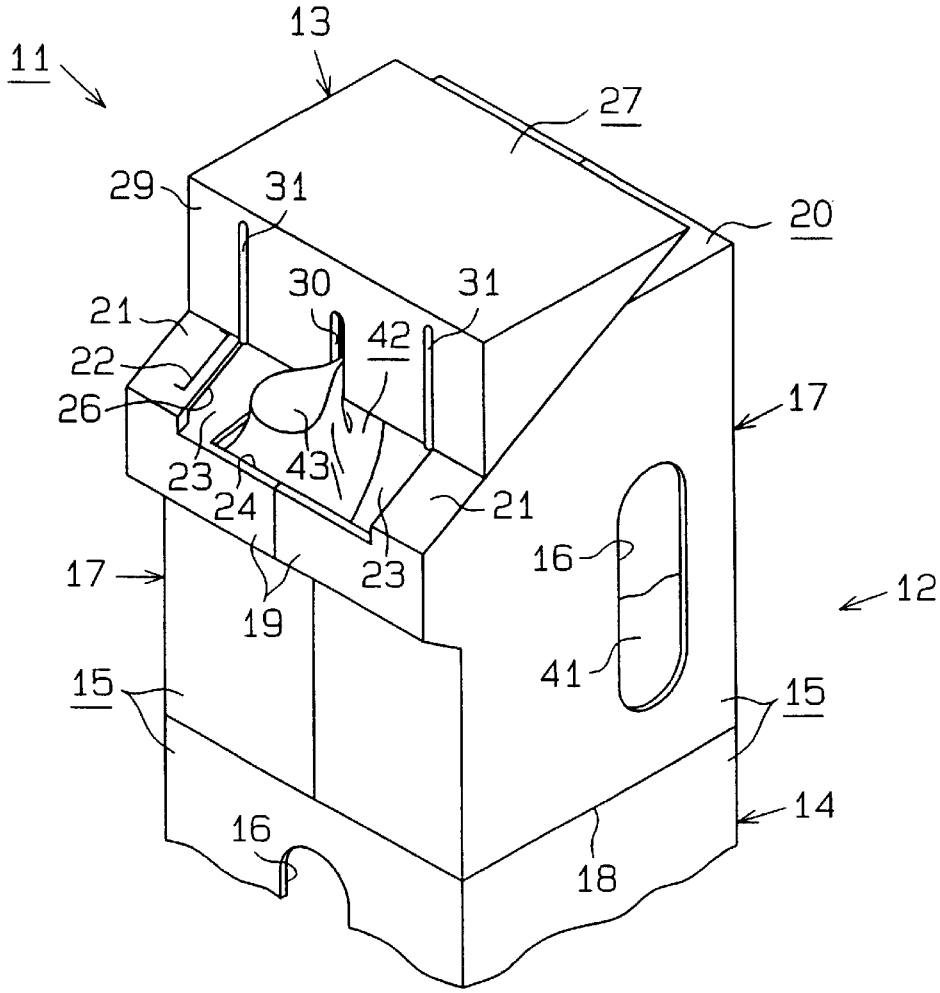
FIG. 10 is a perspective view of a bag closing step.
Figure 11:
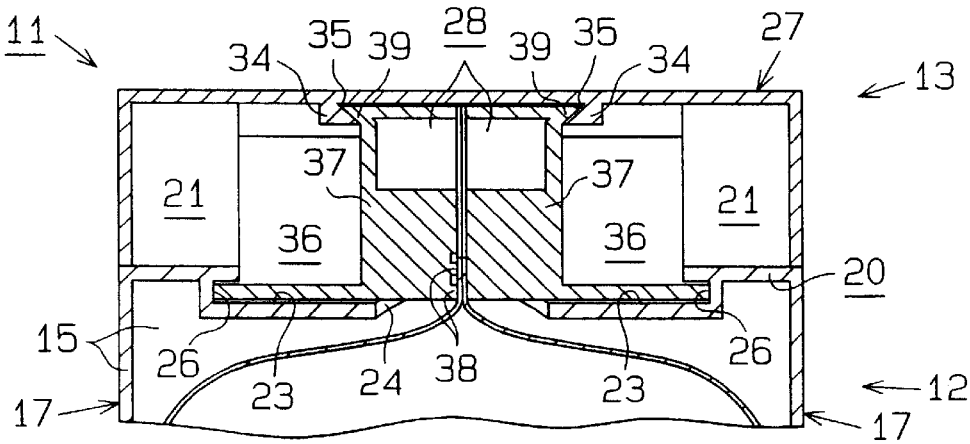
FIG. 11 is a cross-sectional view of the closed bag.

On the other hand, for pouring the liquid 41 out of the bag 42, the cap 13 is mounted to the container body 12, as illustrated in FIG. 10. Specifically, the sliding plates 36 of the cap 13 are engaged with the sliding grooves 26 of the container body 12, the cap 13 is slid, and the sliding of the cap 13 is stopped at an appropriate position on the scale 22. In this manner, as illustrated in FIG. 11, the top end of the bag 42 is clamped between the supporters 28. Also, the pourer 43 is clamped between the end face of one supporter 28 and the fastening rail 38 of the other supporter 28 and is partially closed in accordance with the position at which the cap 13 is stopped.

Then, by inclining the container 11 forward, the liquid 41 pours out of the pourer 43. Further, by adjusting the size of the pourer 43 using the cap 13, the flow rate of liquid 41 poured out of the bag 42 can be readily adjusted.

Figure 12:
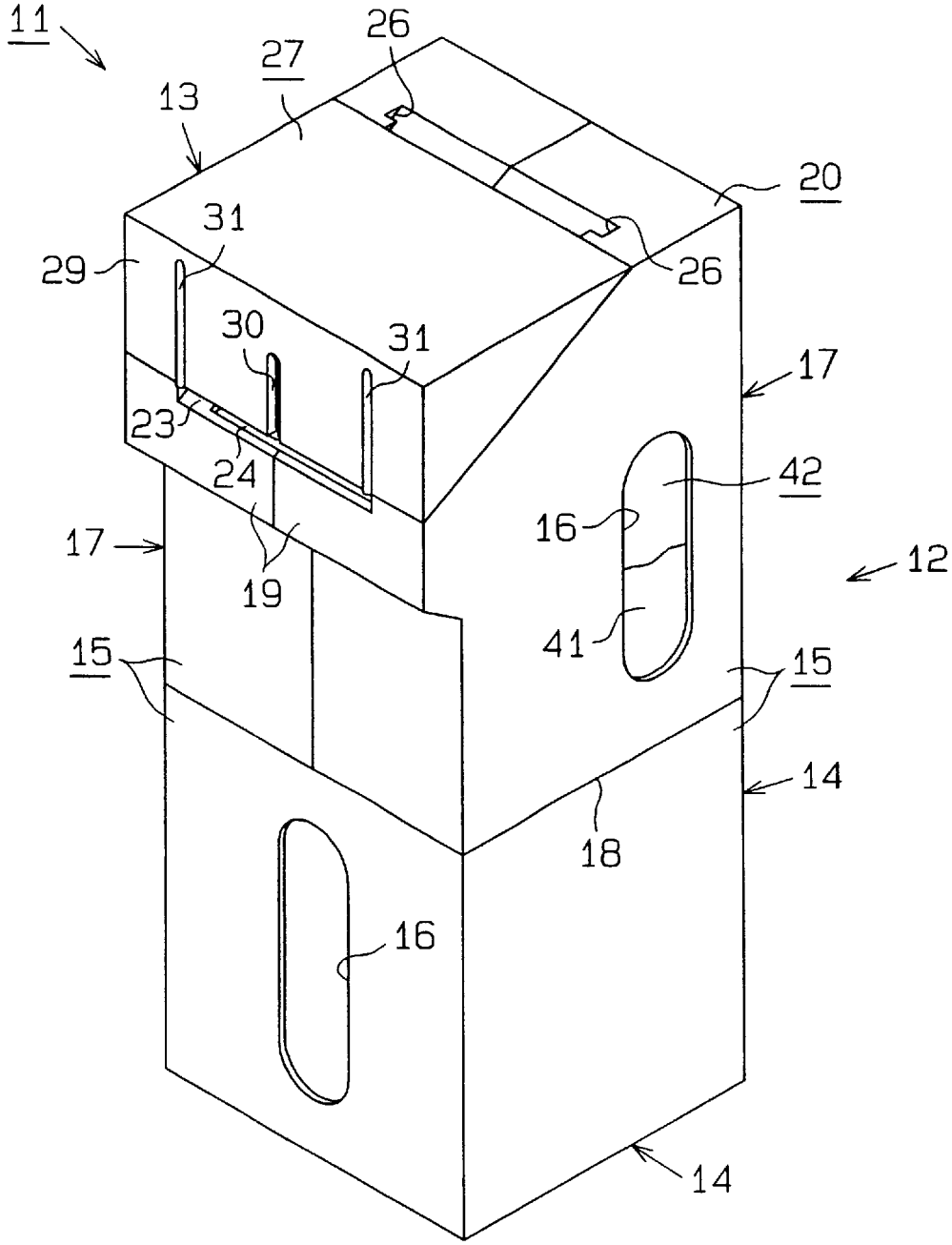
FIG. 12 is a perspective view of the closed bag.

As illustrated in FIG. 12, as the sliding plates 36 are moved to the far ends of the sliding grooves 26, the container body 12 is closed by the cap 13. This causes the bag 42 to be enclosed in the container 11. At this time, the lower portion of the pourer 43 is clamped between the supporters 28 of the cap 13. In other words, the bag 42 is sealed by the inner face of one supporter 28 and the fastening rail 38 of the other supporter 28.

The first embodiment has the following advantages:

Since the pourer 43 is closed by the clamping faces 25 formed on the pair of lids 17 and the fastener 37 formed in the cap 13, the liquid 41 is prevented from leaking from the pourer 43. Also, since the opened bag 42 can be held in the container 11, the remaining liquid 41 can be stored after a required amount of the liquid 41 has poured out. Thus, the liquid 41 can be economically used. Further, by adjusting the size of the pourer 43 using the cap 13, the flow rate of the liquid 41 can be readily adjusted.

Since the pourer 43 is formed by cutting a corner of the bag 42 along the outer inclined surface 21 and the inner inclined surface 23, the liquid 41 is readily and sanitarily poured.

The opening 24 is readily opened by sliding the cap 13 upward along the sliding grooves 26. This permits the liquid 41 to be readily poured.

A force sealing the upper end of the bag 42 concentrates on the narrow fastening rails 38. Thus, the bag 42 is tightly fastened and supported, while the pourer 43 is securely sealed.

Since the bag 42 can be readily opened by the blade 32 mounted in the cap 13, the convenience of the container 11 is improved.

When the bag 42 is opened, the pair of sliding rails 31 are guided by the inner edges of the outer inclined surfaces 21, so that the bag 42 is properly opened by the blade 32.

Since the gap between the supporters 28 becomes wider as at locations closer to the front wall 29, the bag 42 can be readily fastened by sliding the cap 13 downward along the sliding grooves 26.

In the following, a second embodiment of the present invention will be described.

Figure 13:
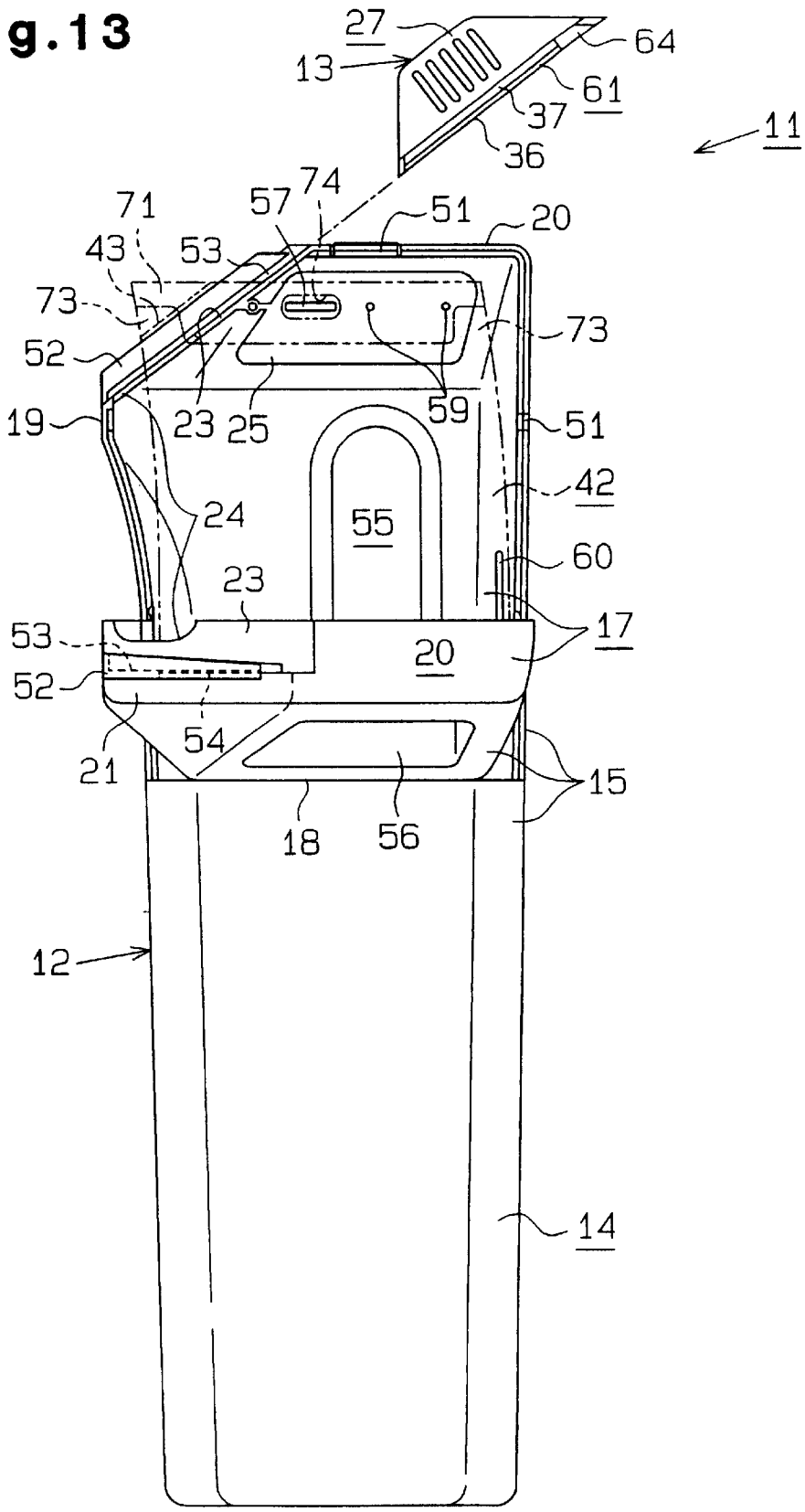
FIG. 13 is a lateral view of a container for a liquid containing bag according to a second embodiment of the present invention.

As illustrated in FIG. 13, a container 11 for a liquid containing bag according to a second embodiment has a container body 12, and a cap 13, which is removable from the container body 12. As indicated by imaginary lines in FIG. 13, a bag 42 containing a liquid 41 is contained in the bag 11. The container 11 is preferably made of transparent or translucent hard polypropylene. The bag 42 is preferably made of polyethylene.

The container body 12 has a lower box 14 and a pair of lids 17. The lower box 14 has a base and four side walls 15, and each side wall 15 is formed to widen toward the top. Adjacent side walls 15 are connected by rounded surfaces. The base of the container body 12 is formed with a drain hole, not shown, for facilitating the drainage.

The lids 17 are substantially symmetric. The lids 17 are coupled to the lower box 14 by hinges 18, respectively. Further, one of the lids 17 is formed with a plurality of engaging tabs 51 on the edge. The other lid 17 is formed with an engaging recesses on the edge for engagement with the engaging tabs 51. When the lids 17 are closed, the engaging tabs 51 engage with the corresponding engaging recesses. In this way, a containing space is formed in the container body 12 for containing the bag 42.

Each lid 17 is formed with a tapering beak 19 on the top. Specifically, the beaks 19 are formed such that they narrow toward the front of the body 12 and toward mating faces of the lids 17. Thus, the containing space in the container body 12 extends toward the center front, so that the portion near a pourer 43 of the bag 42 is pressed upward. Therefore, the liquid 41 smoothly pours out of the pourer 43.

Each lid 17 is formed such that its upper portion tapers toward a top wall 20. An outer inclined surface 21 and an inner inclined surface 23 adjoining the outer inclined surface 21 are formed between the top wall 20 and the beaks 19. Each inner inclined surface 23 is formed with an opening 24, which is cut away in a semi-circular shape. When the lids 17 are closed, the openings 24 are positioned around the pourer 43 of the bag 42.

A tapering rail 52, which widens toward the front of the body 12, is formed between the outer inclined surface 21 and the inner inclined surface 23. A guide groove 53 of a predetermined depth is formed in the inner wall of the tapering rail 52 adjoining the inner inclined surface 23. Also, a fastening groove 54 of a predetermined length is formed in the outer wall of the tapering rail 52 adjoining the outer inclined surface 21.

An oval recess 55 is formed on a side wall 17*a* of each lid 17 such that the container body 12 can be readily grasped for pouring the liquid 41. For facilitating carrying, a pair of hand grips 56 are formed on slopes between both top walls 20 and the side walls 17*a,* respectively. Both hand grips 56 are recessed, so that when the lids 17 are closed, inner surfaces of the hand grips 56 abut against each other to function as clamping faces 25 for the bag 42.

Figure 21:
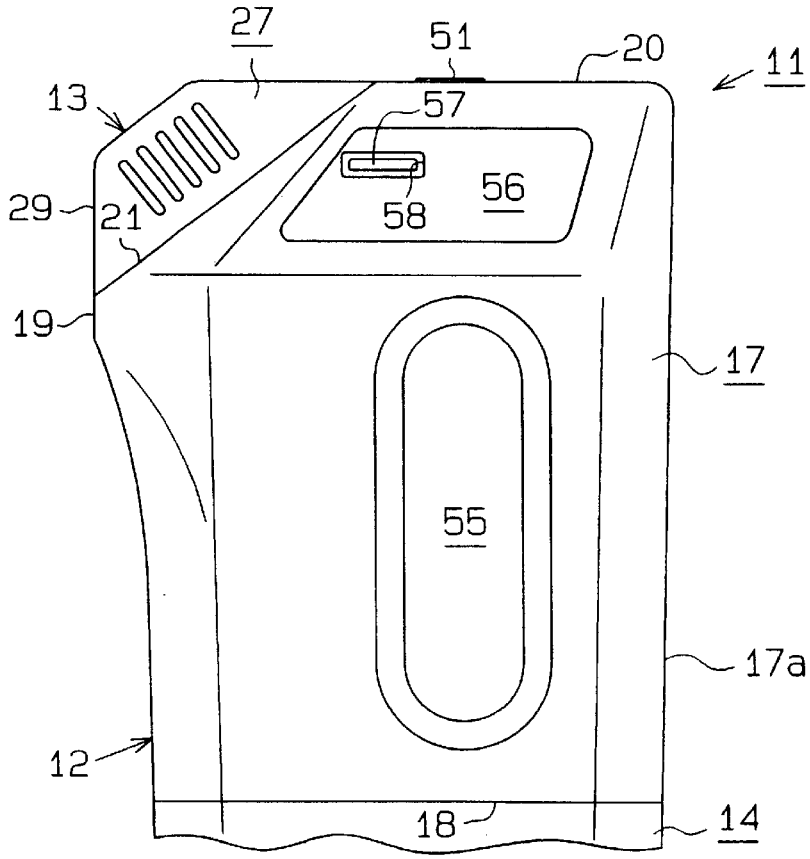
FIG. 21 is a lateral view of the closed bag.

As illustrated in FIGS. 13 and 21, a positioning piece extends from the clamping face 25 of one hand grip 56, and a plurality of conical fixing pins 59 (FIG. 13) are formed in line with the positioning piece 57. The clamping face 25 of the other hand grip 56 is formed with a positioning hole 58 corresponding to the positioning piece 57 and with holes (not shown) corresponding to the fixing pins 59.

Figure 17:
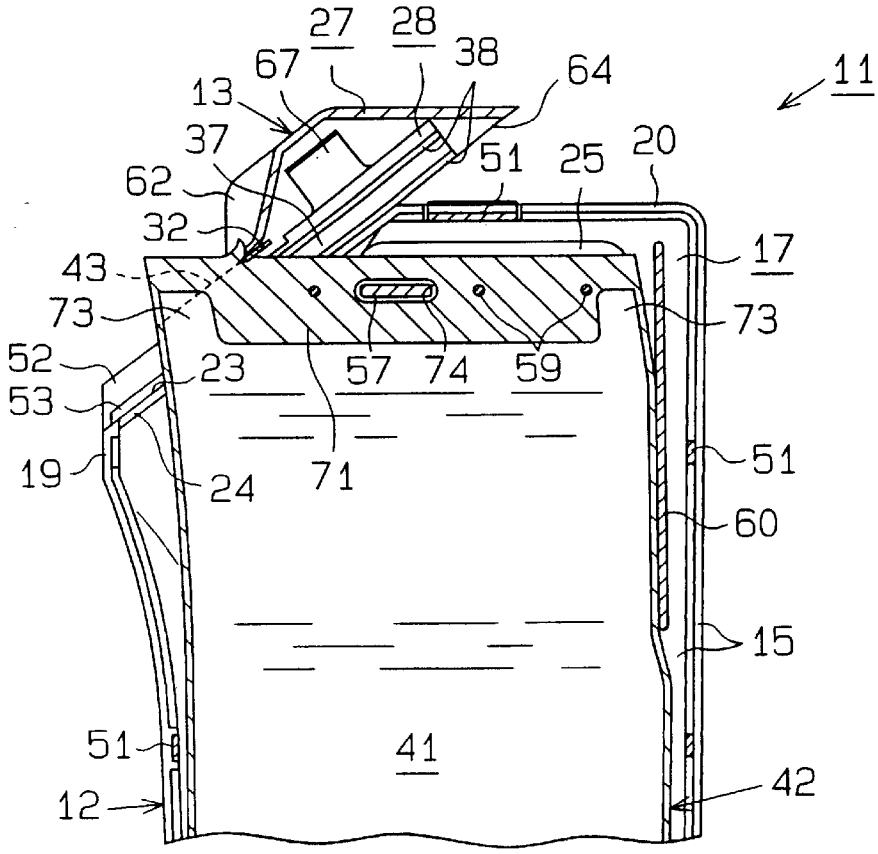
FIG. 17 is a cross-sectional view of a bag opening step.

As illustrated in FIGS. 13 and 17, a back plate 60 is formed on the lid 17. The back plate 60 includes the positioning hole 58, and extends toward the other lid 17. The back plate 60 deforms the bag 42 toward the beaks 19.

As illustrated in FIG. 13, the cap 13 has a clip 61, and a top lid 27 which covers the clip 61. The clip 61 has an elastically deformable structure. The top lid 27 is preferably made of transparent or translucent hard polypropylene. The side walls 27*a* of the top lid 27 form a trapezoid. The cap 13 is configured to slide along the tapering rails 52.

Figure 15A:
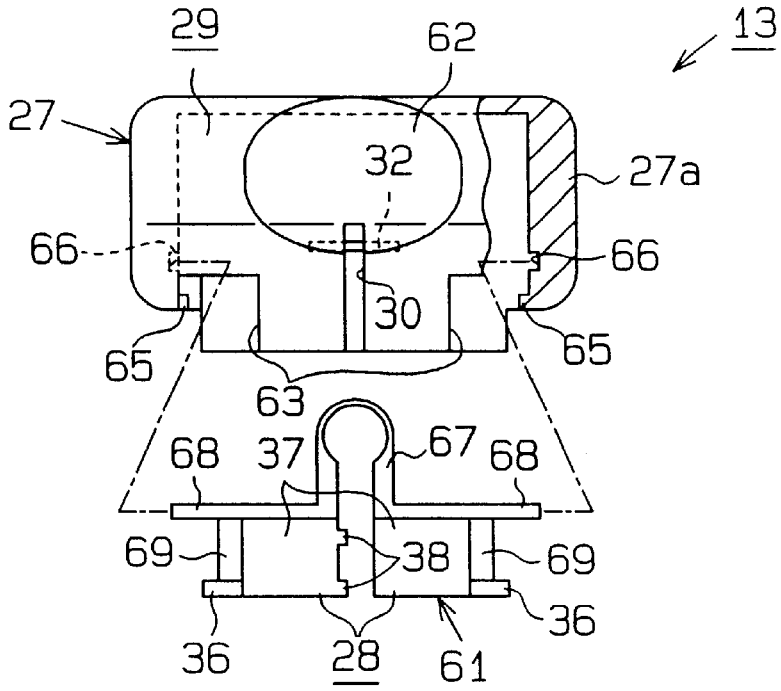
FIG. 15(*a*) is a front view of the cap in the second embodiment.
Figure 15B:
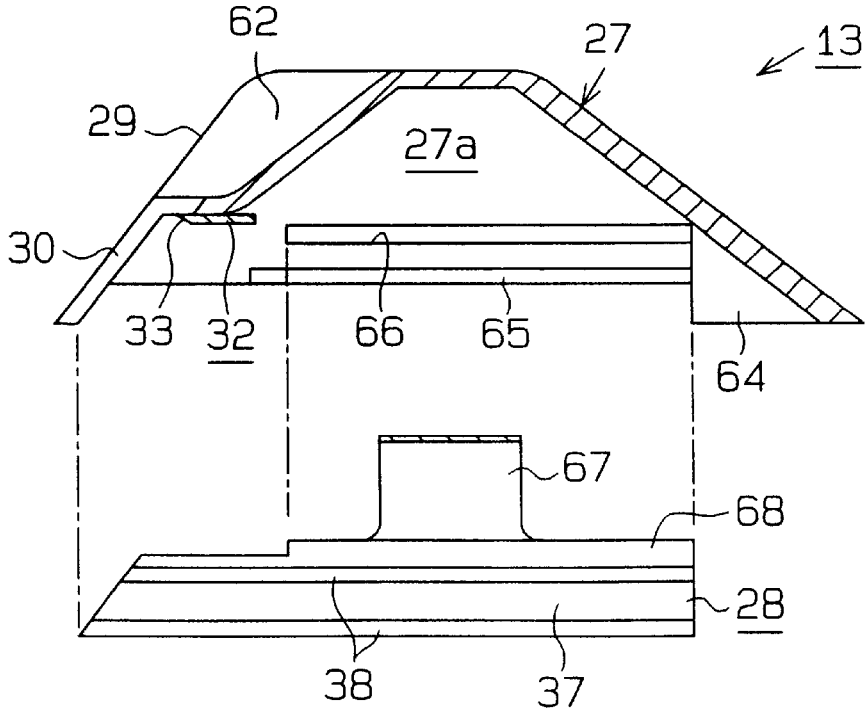
Figure 16:
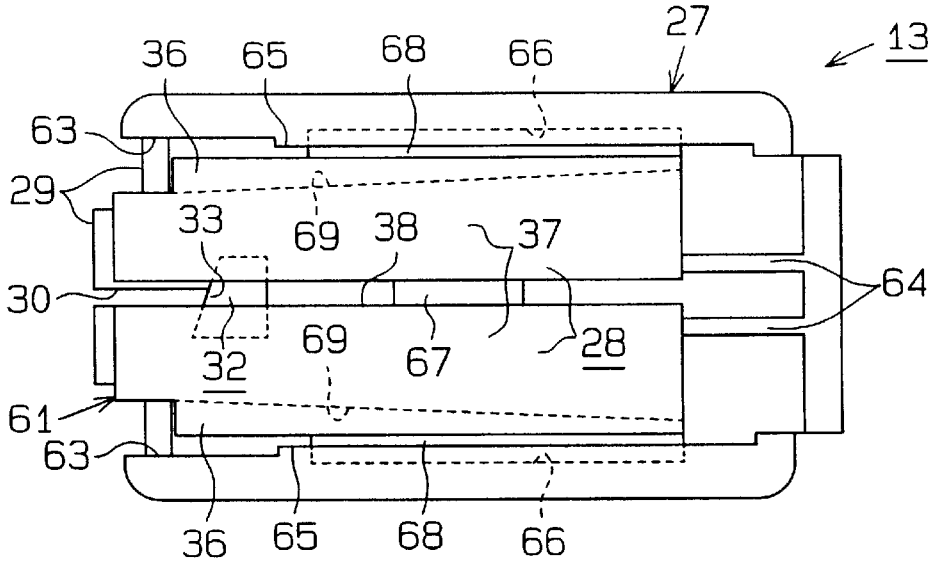
FIG. 16 is a bottom view of the cap in FIG. 14.

As illustrated in FIGS. 15(*a*) and 15(*b*), a finger recess 62 is formed in the top lid 27 for facilitating backward sliding of the cap 13. A slot 30 extends from the lower end of the front wall 29 to the finger recess 62. A pair of passages 63 for receiving the tapering rails 52 are formed through the lower end of the front wall 29.

A blade 32 is mounted on the rear surface of the finger recess 62. The plane of the blade 32 is substantially parallel with the base of a supporter 28. A portion of an edge 33 of the blade 32 is located in the slot 30.

As illustrated in FIGS. 15(*b*) and 16, a pair of triangular stopper plates 64 are formed on the rear surface of the top lid 27. One side (inner edge) of these stopper plates 64 is substantially perpendicular to the lower edge of the side wall 27*a* of the top lid 27. In other words, one side of the stopper plate 64 is substantially perpendicular to the base of the supporter 28.

As illustrated in FIGS. 15(*a*), 15(*b*) and 16, a fastening rail 65 and a engaging groove 66 are formed on inner faces of both side walls 27*a* of the top lid 27. The fastening rails 65 are engaged with the fastening grooves 54 of the lids 17 for guiding the cap 13 to move. The engaging grooves 66 of a predetermined length are formed extending parallel to the fastening rails 65.

The clip 61 has a pair of substantially symmetric supporters 28 and a substantially U-shaped coupling portion 67, which couples the respective supporters 28 and is integral with the supporters 28. The supporters 28 are elastically coupled by the coupling portion 67. Therefore, when a force acts to bring the supporters 28 closer to or away from each other, the coupling portion 67 urges the supporters 28 in the opposite direction. The coupling portion 67 and the supporters 28 may be made of an elastic material.

A rectangular stopper plate 68 is formed on the top of each supporter 28. Each stopper plate 68 is engaged with a corresponding stopper groove 66. Thus, the clip 61 is attached to the inside of the top lid 27. A pair of sliding plates 36 for engagement with guide grooves 53 of the lid 17 are formed at lower ends of the supporters 28.

Each supporter 28 forms a fastener 37. Opposing faces (inner faces) of the fasteners 37 are substantially parallel. Two fastening rails 38, which extends in a longitudinal direction, are formed on an inner surface of one of the fasteners 37. When the cap 13 is mounted to the container body 12, the fastener rails 38 press the pourer 43 of the bag 42 against the inner face of the opposing fastener 37. This causes the pourer 43 to be tightly closed.

Figure 18:
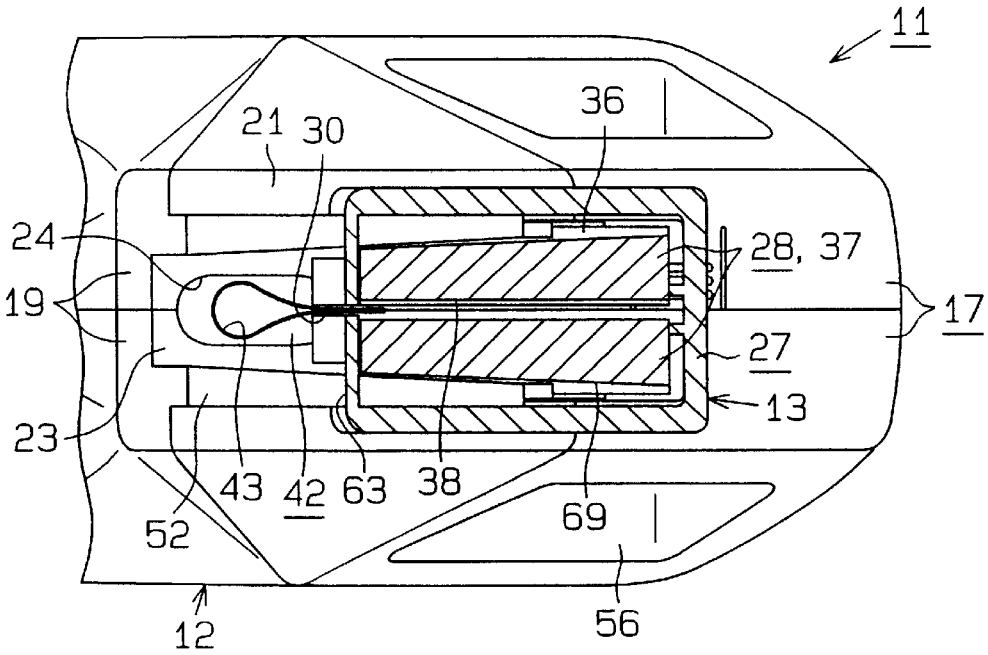
FIG. 18 is a cross-sectional view of a bag closing step.
Figure 19:
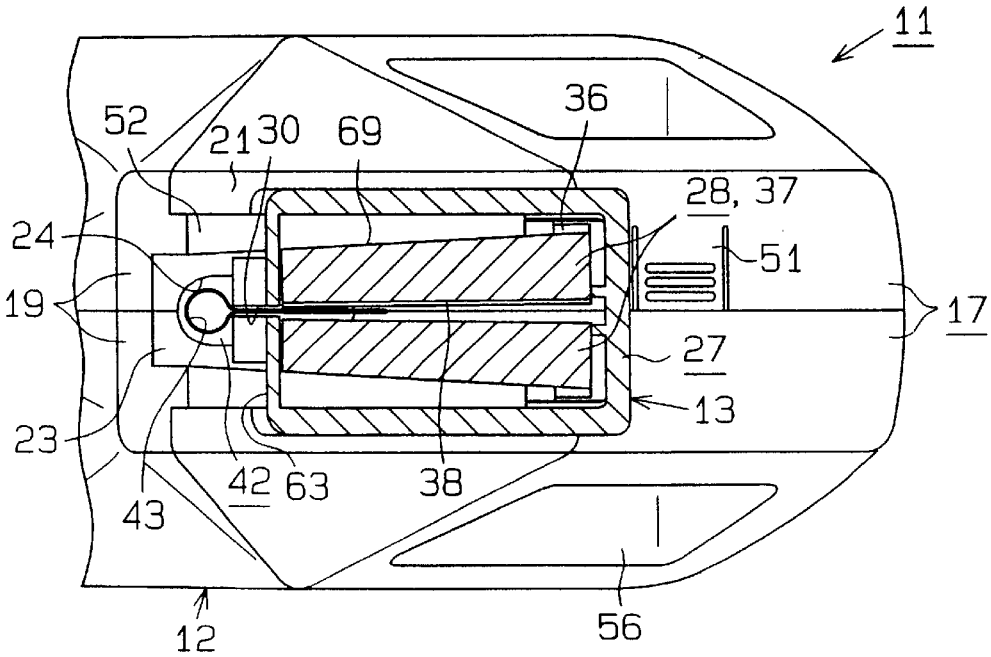
FIG. 19 is a cross-sectional view of the bag closing step.
Figure 20:
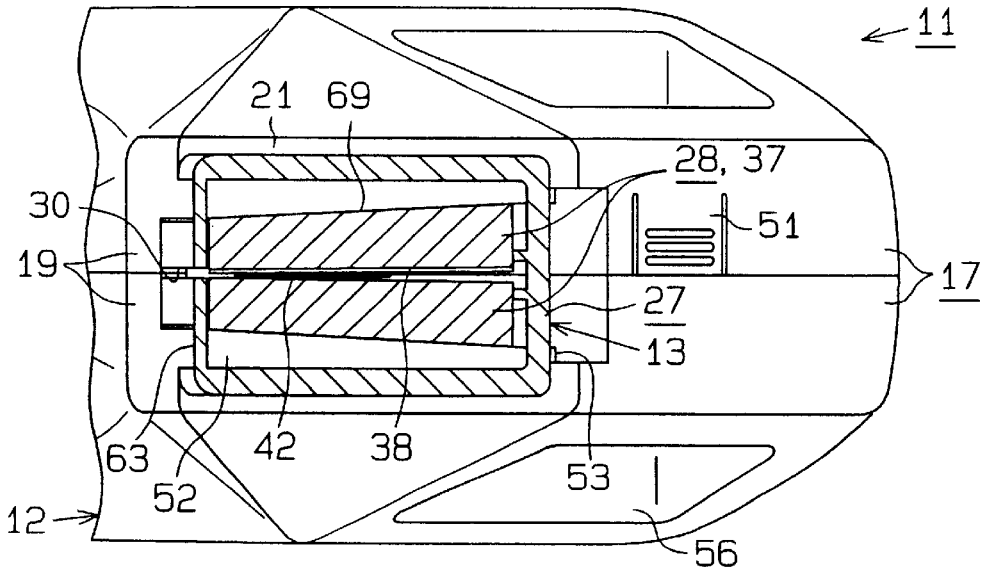
FIG. 20 is a cross-sectional view of the closed bag.

As illustrated in FIGS. 15(*a*) and 16, the fasteners 37 are tapered such that they are wider toward the rear of the body 12. As illustrated in FIG. 18, when the cap 13 is mounted to the lid 17, side surfaces 69 (tapering surfaces) of these fasteners 37 are parallel with inner side surfaces of the tapering rails 52 of the lids 17. Then, as illustrated in FIGS. 18 through 20, by sliding the cap 13 forward in engagement with the lids 17, the tapering surfaces 69 contact the inner side surfaces of the tapering rails 52, and the inner faces of the fasteners 37 gradually approach to each other.

Figure 14:
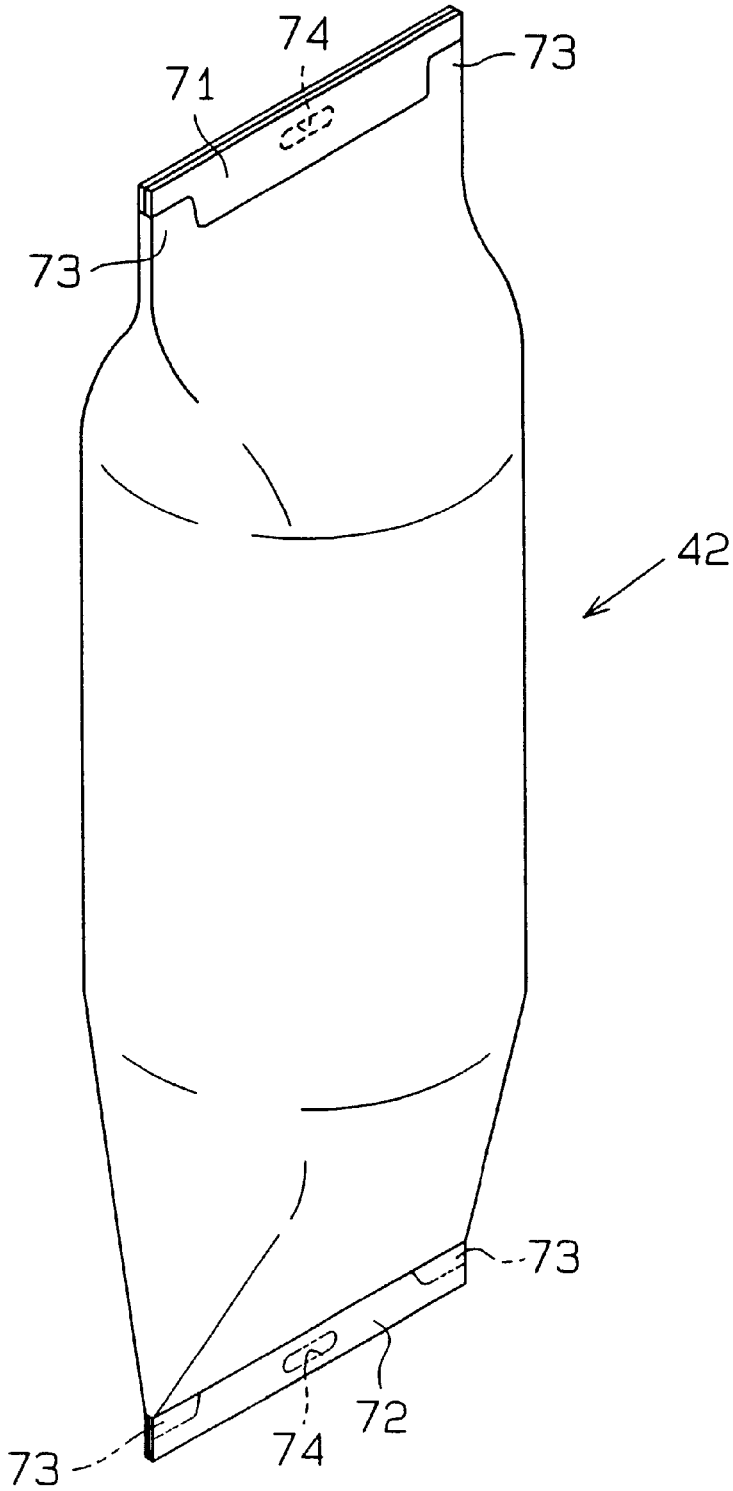
FIG. 14 is a perspective view of a bag according to the second embodiment of the present invention.

As illustrated in FIG. 14, by thermally welding the upper end and the lower end of the bag 42, an upper welded zone 71 and a lower welded zone 72 are formed, respectively. The upper welded zone 71 is formed with pouring zones 73, at both corners, which are thermally welded in an area having a smaller width. A pourer 43 is formed by cutting the pouring zone 73, such that the liquid 41 readily and smoothly pours out. As indicated by a dotted line, a cutting line is formed in the center of the upper welded zone 71. A hanging hole 74 is formed by cutting along the cutting line. By inserting the positioning piece 57 of the lid 17 through the hanging hole 74, the bag 42 is placed at a predetermined position in the container body 12.

For manufacturing the bag 42, first, one end of a polyethylene sheet, which is molded into a cylindrical shape, is folded, and thermally welded to form the lower welded zone 72. Next, the liquid 41 is injected into the thus formed sheet. The other end of the sheet is folded and thermally welded to form the upper welded zone 71. Finally, the cutting line is formed on the upper welded zone 71.

The use of the container 11 will be described below.

To reduce the manufacturing cost of the container 11, it is preferred that the container body 12 (lower box 14 and lid 17) is integrally molded by injection molding. Though not shown, a mold for the injection molding consists of an upper mold and a lower mold. A cavity having the shape of the container body 12 is formed on a parting surface (PL surface) of the mold.

The container body 12 is integrally molded with the lids 17 pivoted to open on both sides of the body 12 (for example, in a state in which the lids 17 are pivoted by 90° to both sides and oriented in the horizontal direction). For example, the lower mold is formed corresponding to the outer side surface of the lower box 14 and the outer side surfaces of the lids 17, while the upper mold is formed corresponding to the inner side surfaces of the lower box 14 and the inner side surfaces of the lids 17.

The molds are clamped, and a melt synthetic resin is injected into the cavity. When the molds are opened after the synthetic resin has been cooled, the container body 12 is molded.

As an alternative molding method, the lower box 14 and the two lids 17 are injection molded as separate members. Then, the respective lids 17 may be connected to the lower box 14 by thermal welding. The hinges 18 are formed during the thermal welding.

As a further alternative molding method, the lower box 14 and one lid 17 may be integrally molded by injection molding, while the other lid 17 is separately injection molded and connected to the lower box 14 by thermal welding.

For placing the bag 42 in the container 11, first, the cutting line is torn off to open the hanging hole 74. Next, the lids 17 are opened to place the bag 42 in the body 12. Then, the lid 17 that is provided with the positioning hole 57 is moved to the closed position, which results in the state illustrated in FIG. 13.

Next, the positioning piece 57 is hung in the hanging hole 74. The other lid 17 is moved to the closed position to bring the inner edges of the lids 17 into contact. Each engaging tab 51 is engaged with the corresponding engaging recess. As a result, the container body 12 is closed with the bag 42 placed at a predetermined position in the container body 12.

As illustrated in FIG. 17, the bag 42 is slightly inclined in front. Specifically, the upper welded zone 71 is located slightly on the front side of the container body 12 by the hanging hole 74 and the positioning piece 57, and is fixed by the plurality of fixing pins 59. Further, the bag 42 is pressed in front by the back plate 60. For this reason, the corner of the bag 42 is positioned above the inner inclined surface 23.

For opening the bag 42, the cap 13 is moved along the one-dot chain line from the state shown in FIG. 13. Specifically, the fastening rails 65 are inserted into the fastening grooves 54, and the sliding plates 36 are inserted into the guide grooves 53. Then, the cap 13 is slid to the front ends of the tapering rails 52.

During this sliding, as illustrated in FIGS. 18 through 20, the front corner of the bag 42 is clamped between the slot 30 of the cap 13 and the inner edges of the lids 17. Further, since the fasteners 37 approach each other with the movement of the cap 13, the front corner is gradually fastened by the fasteners 37.

Then, as illustrated in FIG. 17, the front corner is cut by the blade 32 as indicated by a dotted line to form the pourer 43. Since the upper end of the bag 42 is gripped between the lids 17, the liquid 41 is prevented from flowing out of the bag 42 when the corner is cut.

For pouring a large amount of the liquid 41 from the bag 42 for a short time, the cap 13 is stopped in the rear portion of the tapering rails 52 as illustrated in FIG. 18. Then, the container 11 is inclined in front while the recesses 55 of the lids 17 are held. In this event, since the pourer 43 is not closed by the fasteners 37, the pourer 43 is relatively large. Therefore, a large amount of the liquid 41 can be poured through the pourer 43 for a short time.

For pouring a small amount of the liquid 41 from the bag 42, the cap 13 is stopped in the middle of the tapering rails 52, as illustrated in FIG. 19. Then, the container 11 is inclined in front. In this event, since the fasteners 37 reduce the size of the pourer 43, a small amount of the liquid 41 can pour through the pourer 43.

Since the size of the pourer 43 can be adjusted in accordance with the position of the cap 13, the liquid 41 can be poured out of the bag 42 at a desired flow rate.

For storing the liquid 41 remaining in the bag 42, the cap 13 is slid to the front ends of the tapering rails 52, as illustrated in FIG. 21. This grips the pourer 43 with the fasteners 43, so that the bag 42 is sealed.

Specifically, as the tapering surfaces 69 are pressed inwardly with a uniform force by the inner side surfaces of both tapering rails 52, the fasteners 37 are closed to seal the bag 42. Particularly, since the bag 42 is locally fastened more tightly by the fastening rails 38 formed on the one fastener 37, the pourer 43 is closed to ensure that the liquid 41 is prevented from leaking.

As illustrated in FIG. 21, when the bag 42 is closed by the cap 13, the top surface of the cap 13 is level with the surface of the top wall 20 of the lid 17, and the front surface of the cap 13 is level with the front surfaces of the beaks 19. Since the pourer 43 is covered with the cap 13, it is possible to prevent foreign substances such as garbage, dust and so on from attaching near the pourer 43 or from entering the bag 42.

Since the top lid 27 has a surface parallel with the outer inclined surface 21, it is possible to readily confirm whether the cap 13 is properly mounted to the container body 12 by viewing from the lateral direction.

The second embodiment has the following advantages:

The bag 42 is clamped between the clamping faces 25 of the lids 17 and between the fasteners 37 of the cap 13. Also, the cap 42 is sealed by the fasteners 37. For this reason, the deformable bag 42 can be readily held, and the liquid 41 is prevented from leaking from the pourer 43 of the bag 42. The liquid 41 contained in the bag 42 is therefore preserved.

Further, since a required amount of the liquid 41 can be poured from the bag 42, the liquid 41 need not be used entirely at one time, which is economical. Also, since the size of the pourer 43 of the bag 42 can be changed in accordance with the position at which the cap 13 is mounted, the flow rate of the liquid 41 being poured can be readily adjusted.

As the cap 13 slides frontward along the tapering rails 52 and the tapering surfaces 69 that contact the tapering rails 52, a fastening force applied between the fasteners 37 is increased. Then, by moving the cap 13 to the frontmost position, the pourer 43 of the bag 42 is clamped between the fasteners 37 and securely sealed. As a result, the liquid 41 is prevented from leaking.

The liquid 41 can be readily and sanitarily poured out of the bag 42 by the inner inclined surfaces 23 formed on the lids 17.

Since a force closing the fasteners 37 concentrates on the fastening rails 38, which have a smaller area, the pourer 43 of the bag 42 can be more tightly fastened. Thus, the bag 42 is securely sealed.

The bag 42 is readily opened by the blade 32 provided in the cap 13. Further, since the plane of the blade 32 is parallel with the direction in which the cap 13 is slid, the blade 32 can readily cut the pouring zone 73 of the bag 42, and the pourer 43 is clearly formed. As a result, the liquid 41 smoothly pours out of the pourer 43.

Since the fasteners 37 are made of an elastic material, a necessary and sufficient fastening force is transmitted to the pourer 43 when the pourer 43 of the bag 42 is fastened, thereby increasing the effectiveness of the seal formed when the pourer 43 is closed. It is also possible to readily and smoothly open and close the opening 24 by the cap 13.

The bag 42 can be readily placed and supported at a predetermined position in the container body 12 by the positioning piece 57 formed on the clamping face 25.

The plurality of fixing pins 59 prevent mispositioning of the bag 42.

The upper portion of the bag 42 is pushed in front by the back plate 60 so that the upper portion of the bag 42 is offset in front. Therefore, the liquid 41 readily pours out.

Since the container body 12 is manufactured with a transparent or translucent material, the state of the bag 42 (the amount of the remaining liquid 41) can be readily viewed.

Since the cap 13 has the top lid 27 and the clip 61, the maintenance of the blade 32 (corrosion prevention) and washing of the clip 61 are facilitated by removing the clip 61 from the top lid 27, which is sanitary.

Since the bag 42 is formed with a pair of pouring zones 73, the bag 42 can be inserted into the container body 12 and opened in either a forward or a backward orientation. Therefore, the handling of the bag 42 is improved. For example, if a portion near the one pouring zone 73 is contaminated, the other pouring zone 73 may be opened to sanitarily dispense the liquid 41.

Since the cutting line (hanging hole 47) is formed at the central position of the upper welded zone 71 of the bag 42, the bag 42 can be readily placed at a predetermined position in the container body 12 by inserting the positioning piece 57 through the hanging hole 74.

Since the bag 42 is made of a soft polyethylene sheet, the bag 42 can be compacted after use, so that the amount of garbage is reduced.

In the following, a third embodiment of the present invention will be described centering on aspects that differ from the second embodiment.

Figure 22:
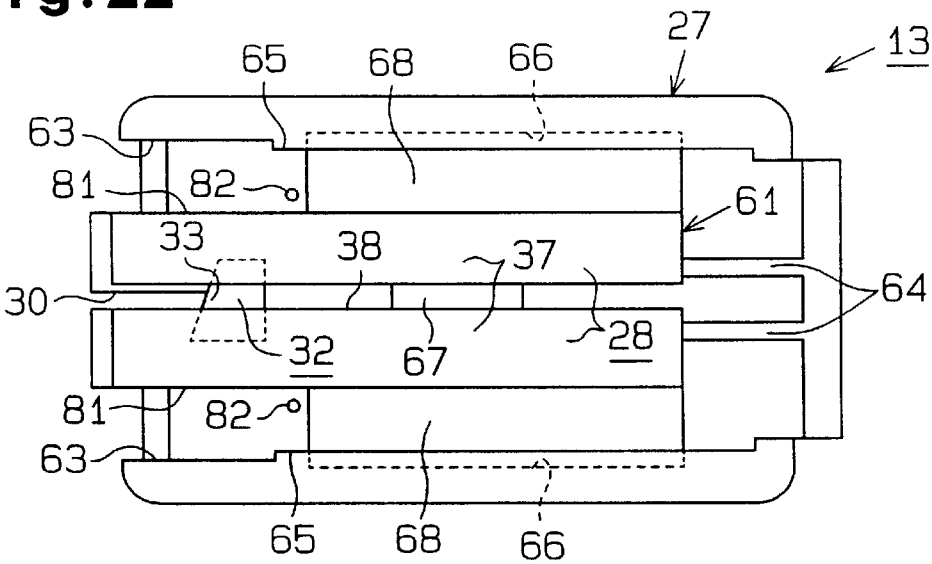
FIG. 22 is a bottom view of a cap according to a third embodiment of the present invention.

As illustrated in FIG. 22, each supporter 28 of a cap 13 has a square pole fastener 37 located at the lower position of a stopper plate 68. In place of the tapering surface 69 in the second embodiment, each supporter 28 has a parallel stopper surface 81. Also, the sliding plates 36 in the second embodiment are omitted. A pair of cylindrical stopper protrusions 82 are formed to extend downward from the inner face of a top lid 27.

Figure 23:
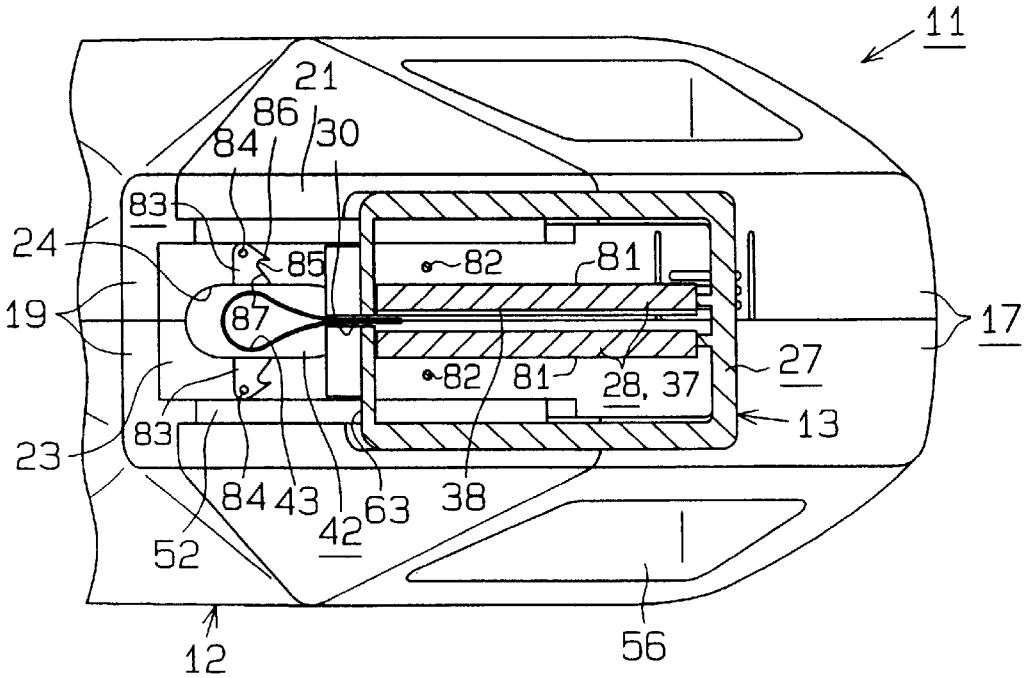
FIG. 23 is a cross-sectional view of a bag closing step.

As illustrated in FIG. 23, a pair of pivot shafts 84 are formed on both sides of an opening 24, respectively. A pivot plate 83 is attached for pivotal movement about the pivot shaft 84. A hook 85 is formed behind each pivot plate 83 for engagement with one of the stopper protrusions 82 of the cap 13. As the cap 13 is moved to the back, a leading surface 86 of the hook 85 engages the corresponding stopper protrusion 82, so that the pivot plate 83 is returned to the original position (FIG. 23).

The hook 85 has a substantially triangular stopper 87. The stopper 87 protrudes into the opening 24 when the pivot plate 83 is pivoted forward. Then, the stoppers 87 fasten the stopper surfaces 81 of the cap 13. The guide grooves 53 of the second embodiment is omitted in this embodiment.

The container 11 of the third embodiment will be described in terms of action and effect.

Figure 24:
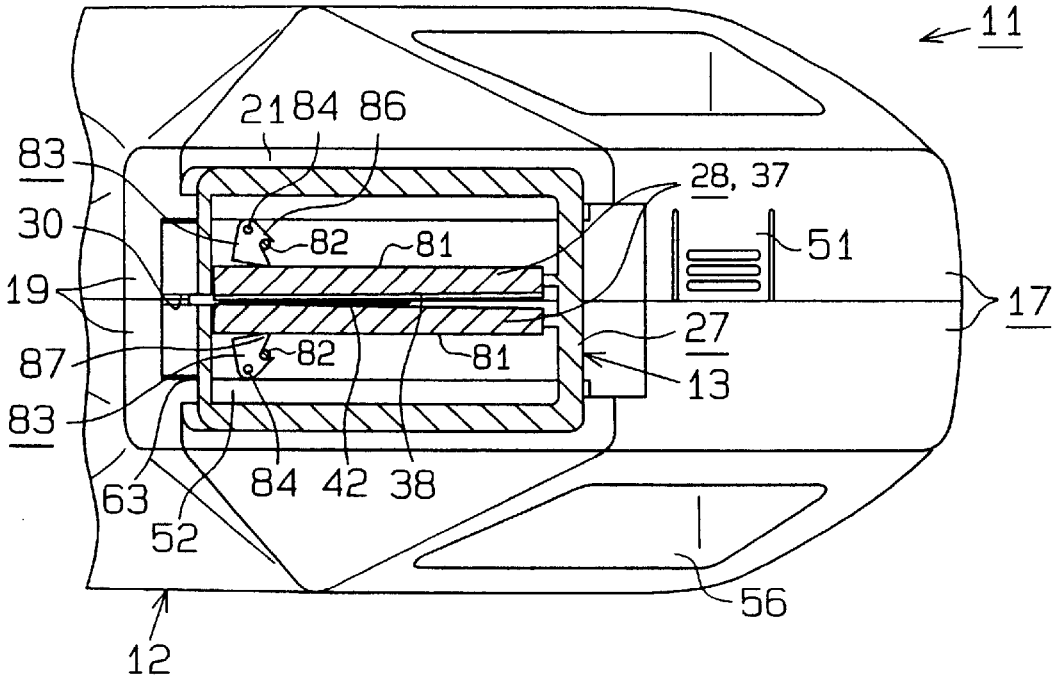
FIG. 24 is a cross-sectional view of the bag closing step.

For sealing the bag 42 using the container 11 of the third embodiment, the bag 42 is inserted into the container body 12 and the lids 17 are closed, as illustrated in FIG. 23. Then, the cap 13 is slid to the front end of the tapering protrusions 52 on the lids 17. In this event, as illustrated in FIG. 24, the pair of stopper protrusions 82 pivot the pair of pivot plates 83 frontward about the pivot shafts 84 in front. As a result, the stoppers 87 of the pivot plates 83 clamp the stopper surfaces 81, causing the inner faces of the fasteners 37 to seal the pourer 43 of the bag 42.

On the other hand, the pourer 43 is opened by sliding the cap 13 illustrated in FIG. 24 rearward along the tapering rails 52. In this event, the leading surface 86 of the hooks 85 engage the stopper protrusions 82, so that both pivot plates 83 are pivoted rearward and are returned to the original positions.

In the container 11 of the third embodiment, the pivot plates 83, when pivoted frontward, tightly and inwardly fasten the fasteners 37 by the stopper protrusions 82. For this reason, the inner faces of the fasteners 37 tightly fasten the pourer 43 of the bag 42 to seal the pourer 43.

The respective embodiments may be modified in the following manners.

In the first embodiment, a recess and a protrusion for engagement with each other may be formed on the inner faces of the lids 17. In this way, the lids 17 can be firmly closed, so that the bag 42 is held between the, clamping faces 25.

In the first embodiment, an inner edge of the outer inclined surface 21 may be folded downward to form a regulating protrusion, and an engaging groove may be formed in the top surface of the sliding plate 36 of the cap 13 for engagement with the regulating protrusion. In this case, by mounting the cap 13 to the container body 12, the lids 17 are firmly closed by the engagement of the regulating protrusion with the engaging groove.

In the first embodiment, the clamping face 25 of at least one lid 17 may be formed with a rail. In this case, the bag 42 can be more firmly supported.

In the first embodiment, a stopper may be provided at the rear end of the key groove 35. Alternatively, the key groove 35 may be adhered to the key 39 using an adhesive. In this case, the supporters 28 can be firmly mounted to the top lid 27. It is therefore possible to use the cap without rattling movements.

In the first embodiment, the pair of supporters 28 may be integrally formed. In this case, since the supporters 28 are not easily moved from the top lid 27, use of the cap 13 is facilitated.

In the first embodiment, the lids 17 may be removed from the lower box 14, and the lids 17 and the lower box 14 may be formed with a recess and a protrusion for mutual engagement. In this case, the lids 17 can be coupled to the lower box 14 by engagement of the recess with the protrusion.

In the first embodiment, the base of the container body 12 may be, for example, hexagonal, octagonal, circular or elliptic. Also, the cap 13 is formed to correspond to the shape of the container body 12.

In the first embodiment, at least one of the window 16, beaks 19, scale 22, slot 30, blade 32, sliding rails 31 and fastening rails 38 may be omitted. In this case, the container 11 can be simplified.

In the second and third embodiments, one hinge 18 may be omitted, and one lid 17 may be fixed to the lower box 14. In this case, the container 11 can be simplified.

Figure 25:
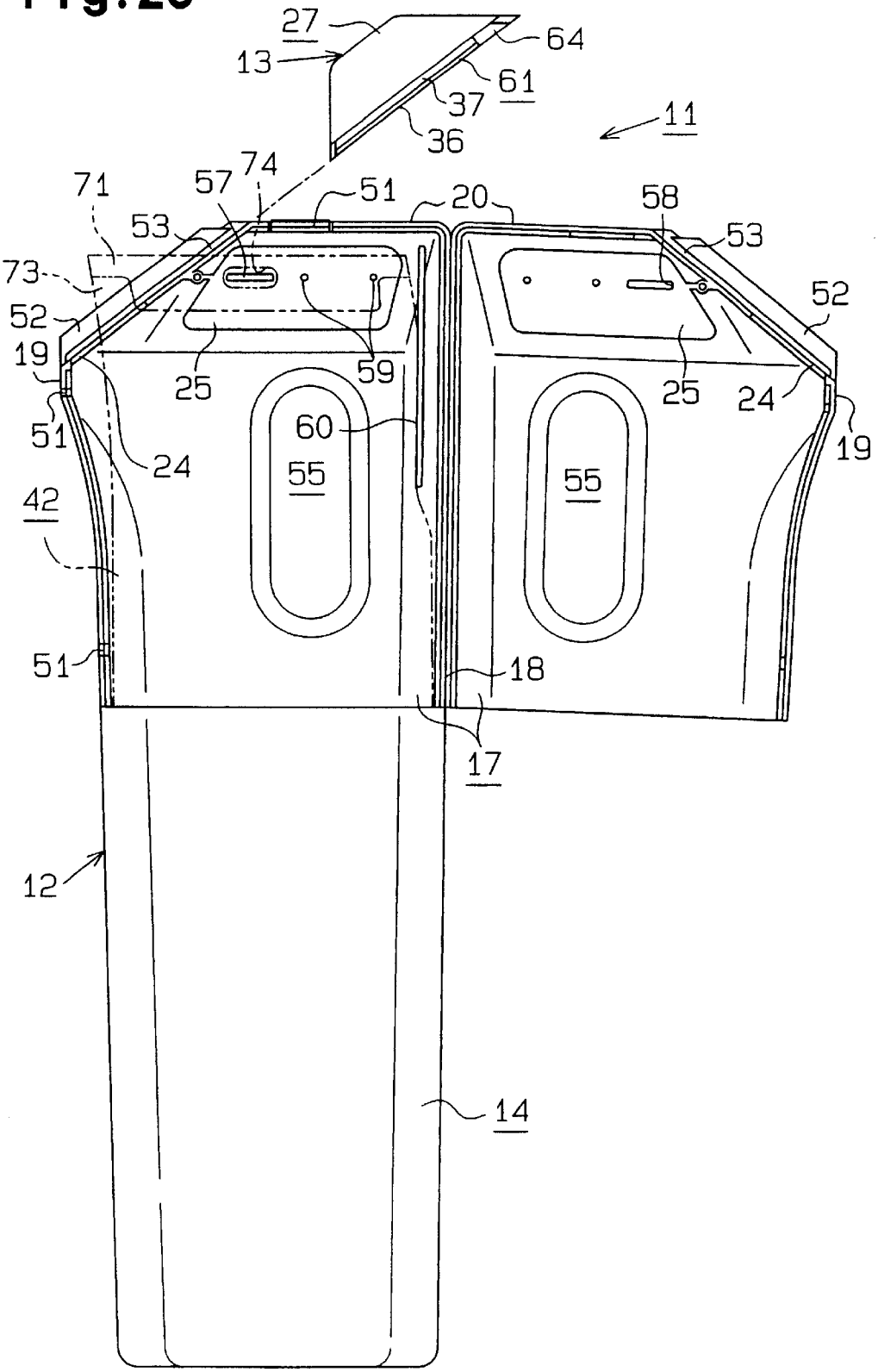
FIG. 25 is a lateral view of a container according to another embodiment of the present invention.

In the second and third embodiments, as illustrated in FIG. 25, one lid 17 may be fixed to the lower box 14, and the other lid 17 may be connected to that lid 17 through the hinge 18. In this way, the one lid 17 can be opened in the lateral direction. Alternatively, the rear wall of the lower box 14 may be formed to extend upward, and the hinges 18 are attached on both side edges of the rear wall to couple the pair of lids 17. In this way, the lids 17 can be opened in the lateral direction. In these cases, an engaging tab 51 and an engaging recess are preferably provided near the beaks 19 of the lids 17 for engagement with each other.

Figure 26A:
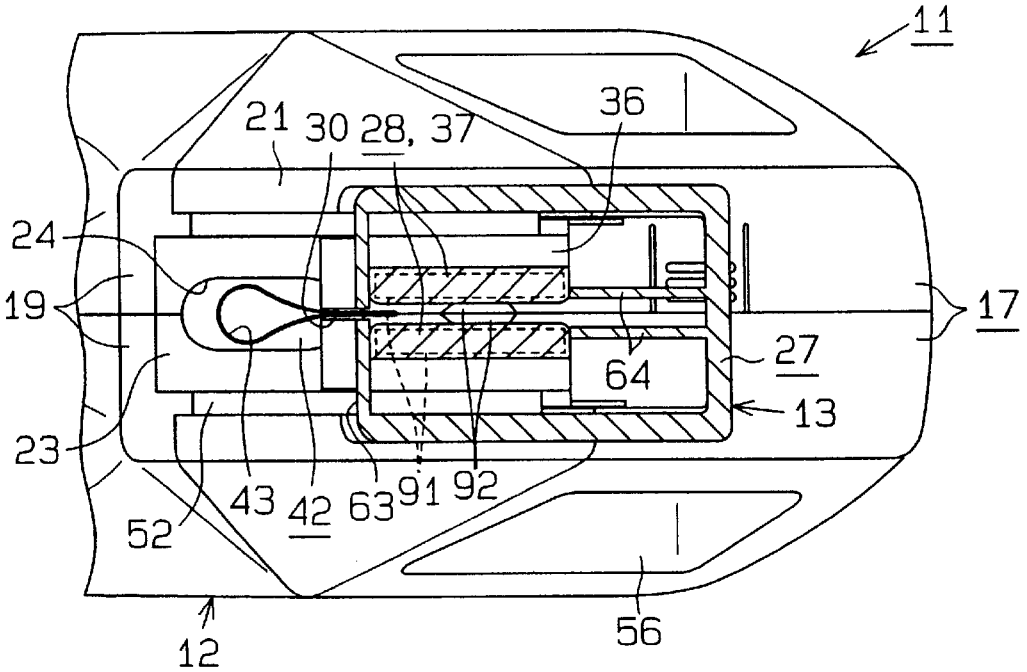
FIGS. 26(*a*) and 26(*b*) are cross-sectional views of bag closing steps.
Figure 26B:
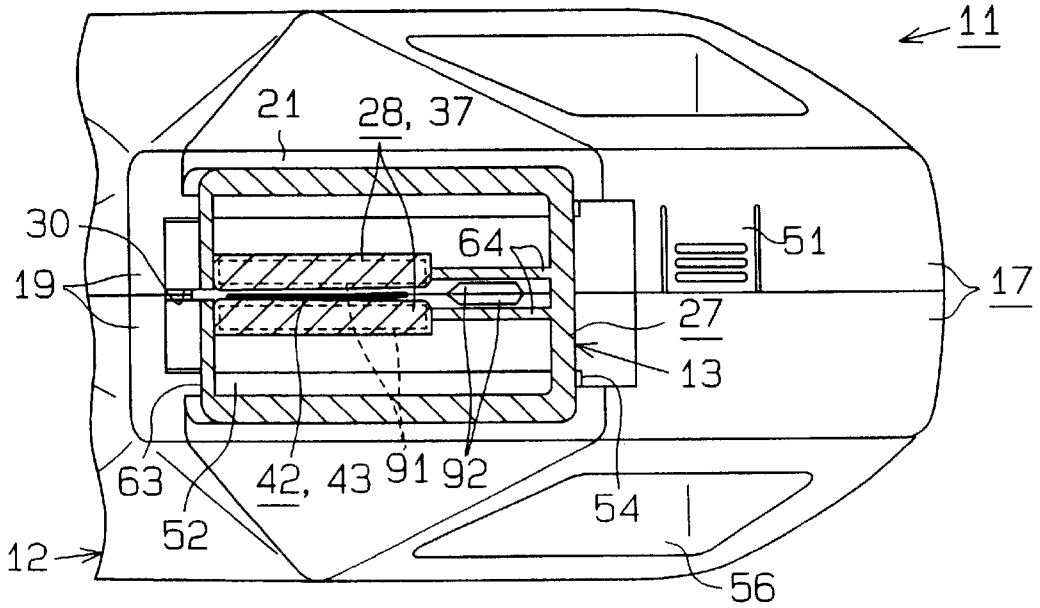

The container 11 according to the second and third embodiments may be formed in shapes illustrated in FIGS. 26(*a*) and 26(*b*). Specifically, the fasteners 37 of the cap 13 are formed of a magnet 91 indicated by dotted lines and a thin elastic member (not shown) covering the magnet 91. An attractive force acts between the magnets 91. Then, the side surfaces of the fasteners 37 are formed horizontally. The tapering rails 52 are formed in rectangle to avoid abutting with the fasteners 37. Further, a rail 92 is formed on the inner inclined surface 23. In this case, the fastening rails 38 of the fasteners 37 can be omitted. In this case, as the cap 13 is engaged with rear portions of the rails 52, the fasteners 37 are separated against the magnetic forces of the magnets 91 by contact with the separating rails 92. Then, as the cap 13 is slid toward the front, the fasteners 37 are closed by the magnetic forces of the magnets 91 to seal the pourer 43 of the bag 42. This readily and securely seals the pourer 43 of the bag 42.

Figure 27:
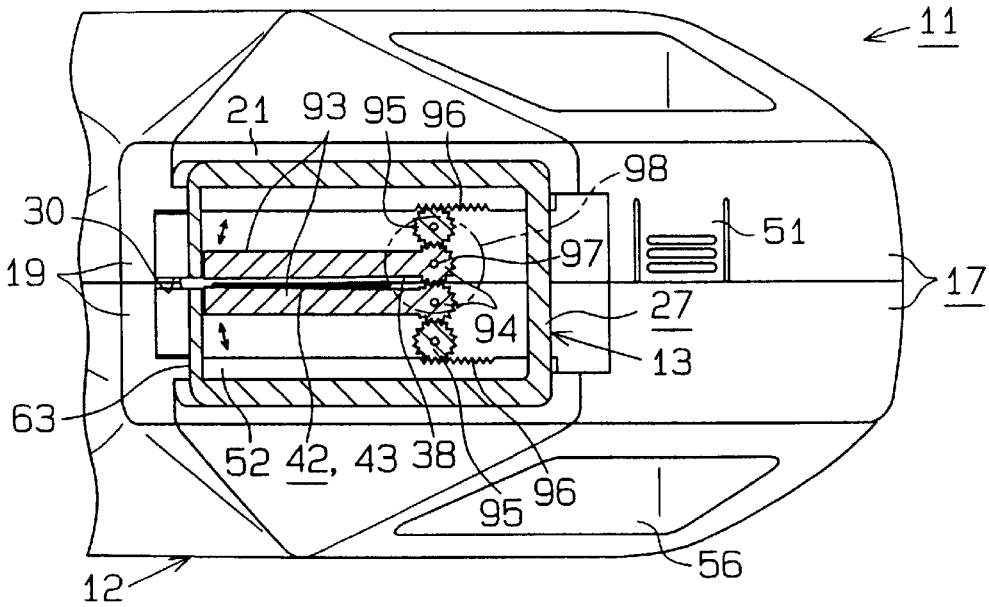
FIG. 27 is a cross-sectional view of a container according to another embodiment.

In the second and third embodiments, a pair of fastening rods 93 having a gear 94 may be used in place of the clip 61, as illustrated in FIG. 27. A proximal end of each fastening rod 93 is mounted to the top lid 27 through a shaft such that the gears 94 mesh with each other. The gears 94 mesh with a pair of pinions 95 mounted on the top lid 27 through shafts. Further, the inner faces of the tapering rails 52 of the container body 12 may be formed extending in parallel with their outer surfaces, and racks 96 may be provided near rear portions of the inner faces of both tapering rails 52 for engagement with the pinions 95.

In this case, when the cap 13 is slid forward, the racks 96 mesh with the pinions 95 immediately before the cap 13 is positioned at the front end of the container body 12, causing the pinions 95 to rotate in a predetermined direction. Then, the gears 94 are rotated in association with the rotation of these pinions 95, which causes the fastening rods 93 to pivot inwardly in association with the rotation of the gears 94. Consequently, with the closure of the container body 12 by the cap 13, the pourer 43 of the bag 42 can be readily and securely sealed.

Alternatively, the pinions 95 and racks 96 may be omitted, while a shaft 97 of one fastening rod 93 is extended to the top surface of the top lid 27, and a knob 98 may be provided at the leading end of the shaft, as indicated by two-dot chain line. In association with one fastening rod 93 being rotated by manipulating the rotating knob 98, the other fastening rod 93 can be rotated. In this case, by rotating the rotating knob 98 with the container body 12 closed by the cap 13, the pair of gears 94 can be rotated in engagement, so that the fastening rods 93 can be pivoted in the left and right directions as indicated by arrows in FIG. 27. It is therefore possible to readily open the pourer 43 of the bag 42 and to readily fasten the same.

Figure 28:
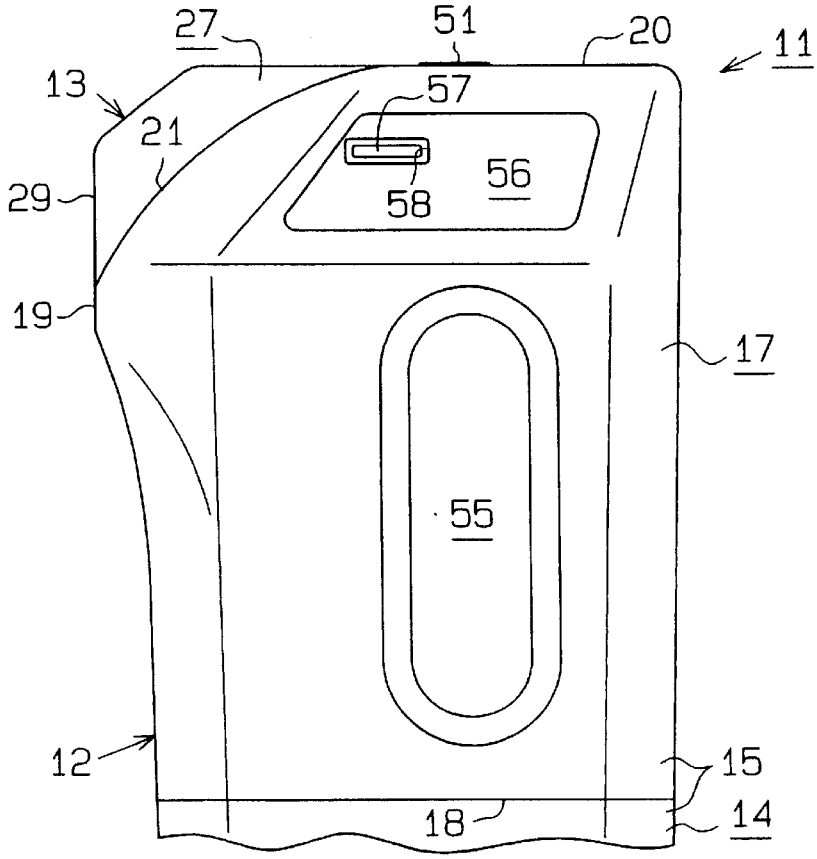
FIG. 28 is a lateral view of a container according to another embodiment.

In the second and third embodiments, the outer inclined surfaces 21, inner inclined surfaces 23 and tapering rails 52 may be convex as illustrated in FIG. 28. Alternatively, the outer inclined surfaces 21, inner inclined surfaces 23 and tapering rails 52 may be concave. In this case, the cap 13 is formed in accordance with the shape of the container body 12.

Figure 29:
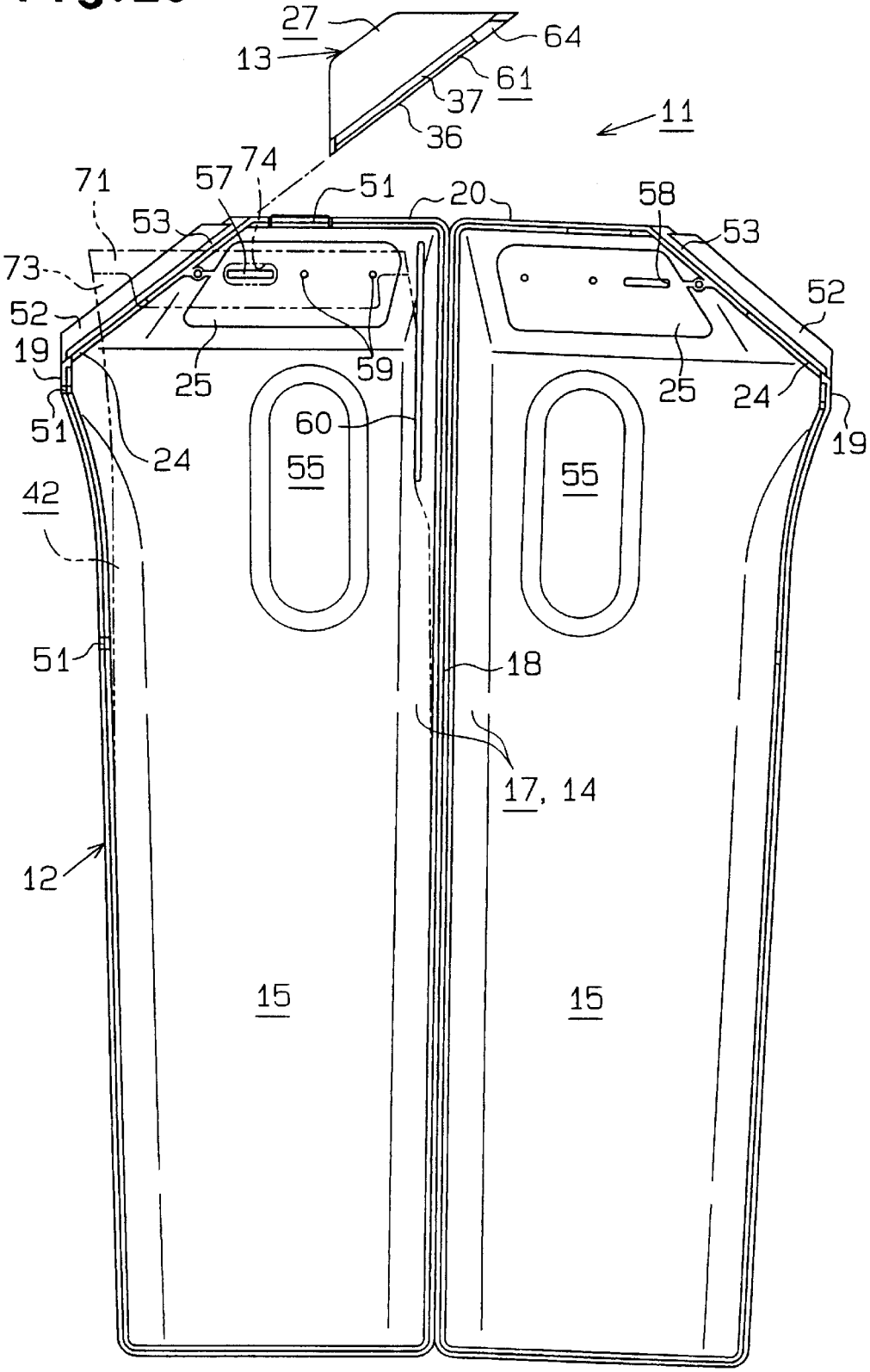
FIG. 29 is a lateral view of a container according to another embodiment.

In the second and third embodiments, the container body 12 may be formed such that it can be entirely opened, as illustrated in FIG. 29. Specifically, the container body 12 is vertically divided into two parts, and these are coupled by a hinge 18. In this case, the bag 42 can be readily placed at a predetermined position in the container body 12.

Figure 30:
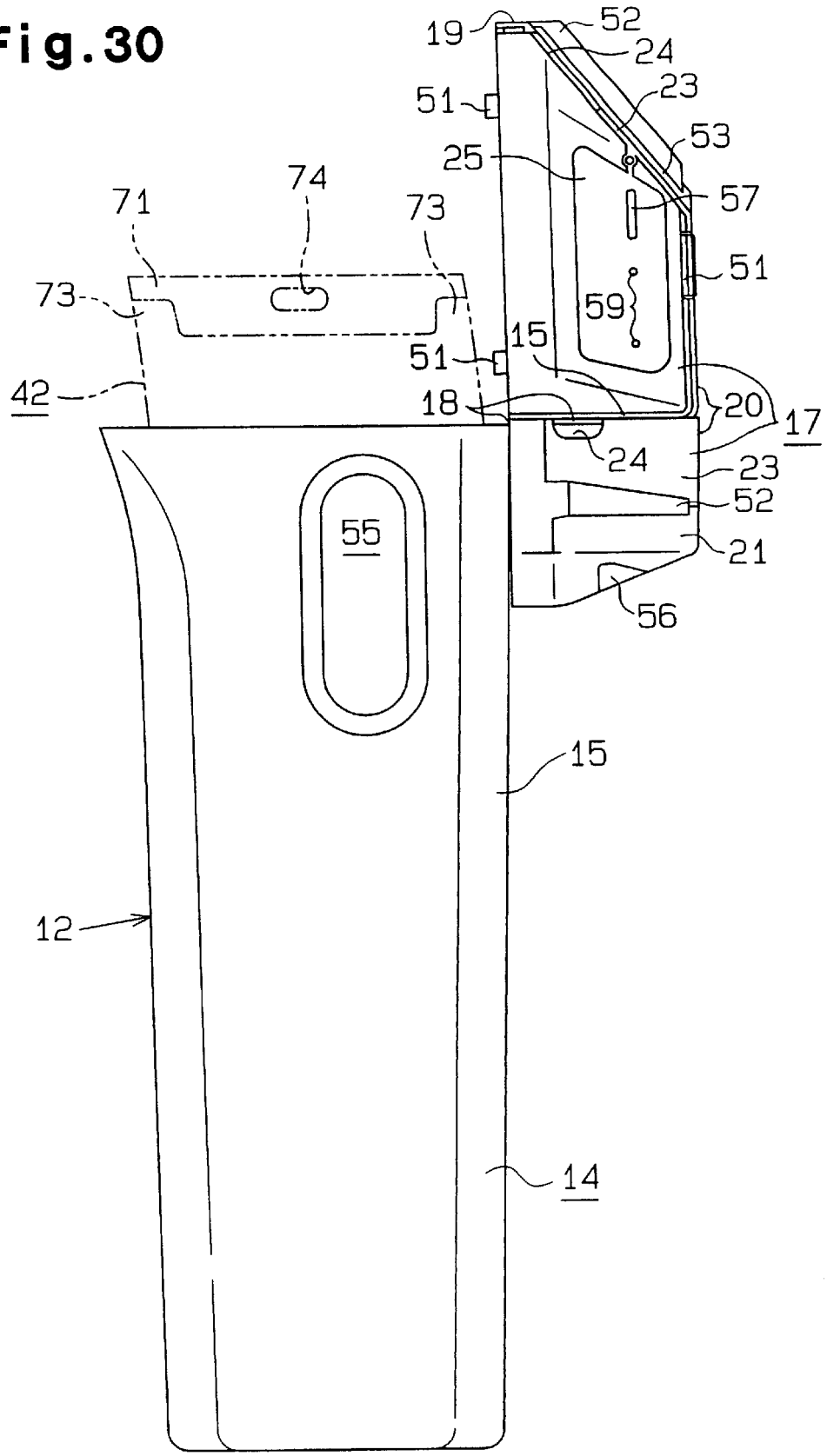
FIG. 30 is a lateral view of a container according to another embodiment.

In the second and third embodiments, the lower box 14 is formed to extend to the lower ends of the beaks 19, as illustrated in FIG. 30. The rear portions of the lids 17 may be connected through a hinge 18, and the lower end of the rear portion of one lid 17 may be coupled to an upper edge of the lower box 14 through the hinge 18. In this case, the bag 42 can be readily placed at a predetermined position in the container body 12.

Figure 31:
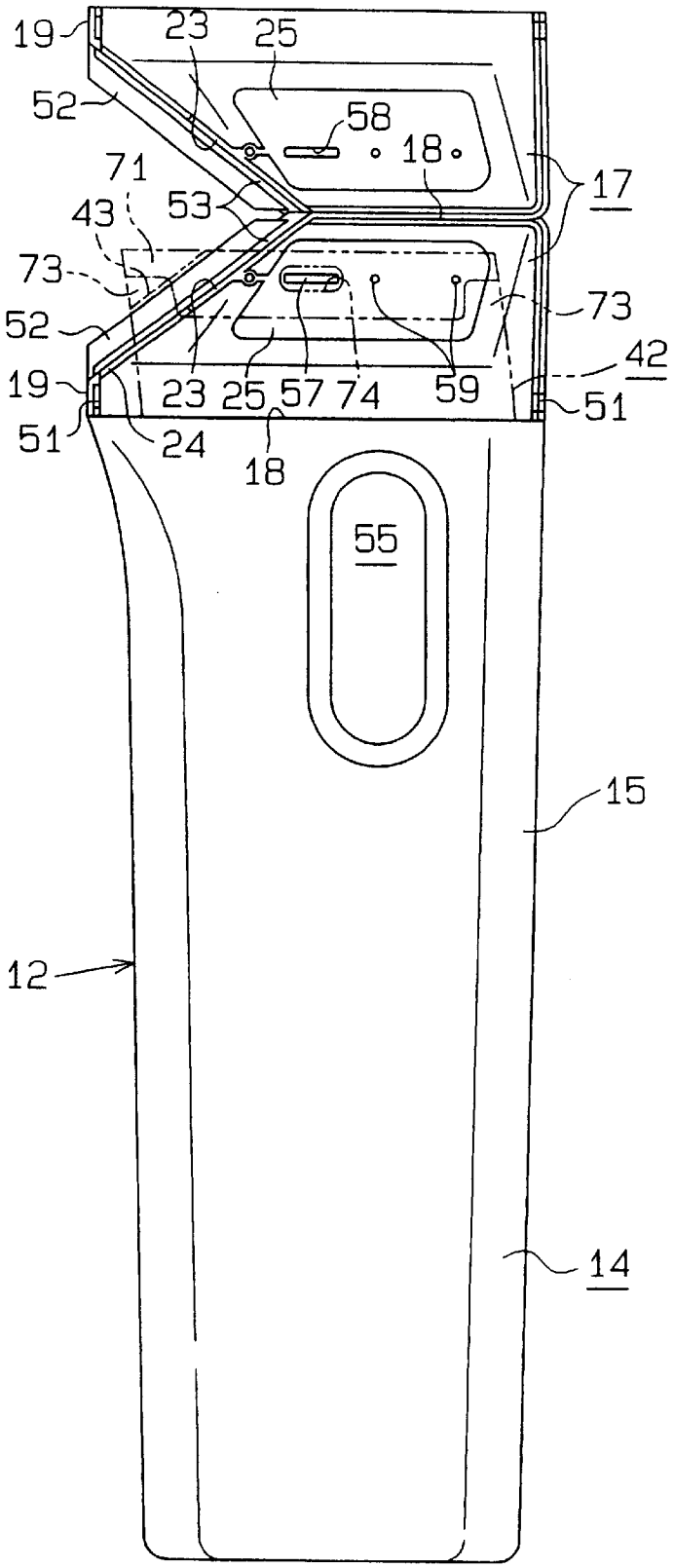
FIG. 31 is a lateral view of a container according to another embodiment.

In the second and third embodiments, the lower box 14 of the container body 12 is formed to extend to the lower ends of the beaks 19, as illustrated in FIG. 31. The two lids 17 may be coupled through a hinge 18 located on the top wall, while the lower edge of one lid 17 may be coupled to the upper edge of the lower box 14 through the hinge 18. In this case, the bag 42 can be readily placed at a predetermined position in the container body 12.

Figure 32:
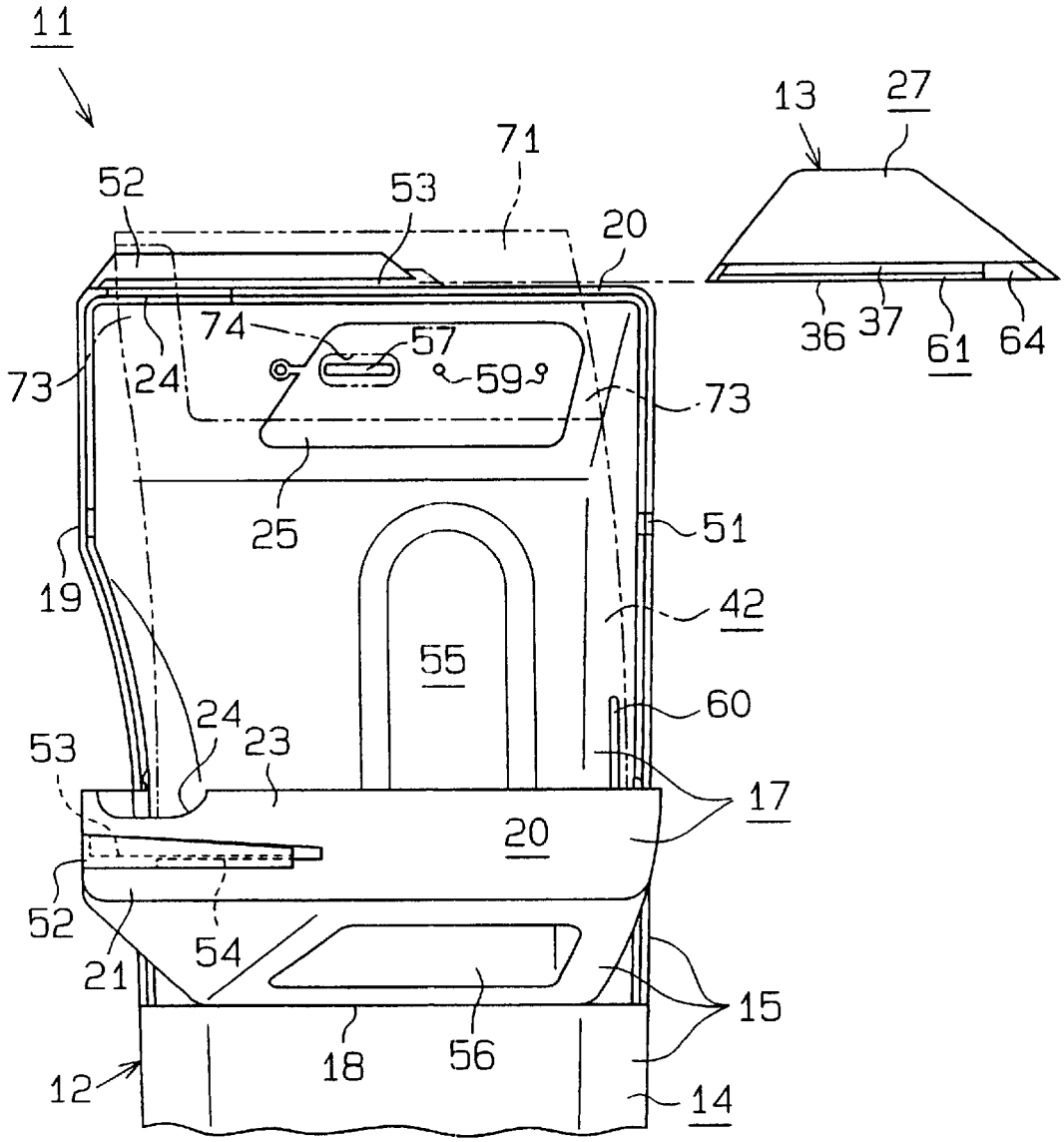
FIG. 32 is a lateral view of a container according to another embodiment.

In the second and third embodiments, the outer inclined surfaces 21 and the inner inclined surfaces 23 may be parallel with the top wall 20, as illustrated in FIG. 32. Further, the top welded zone 71 of the bag 42 is formed to extend from the clamping faces 25 beyond the top wall 20. Then, the pouring zone 73 is formed at one corner of the bag 42. In this case, the liquid 41 in the bag 42 can pour out of the upper end of the container 11.

Figure 33:
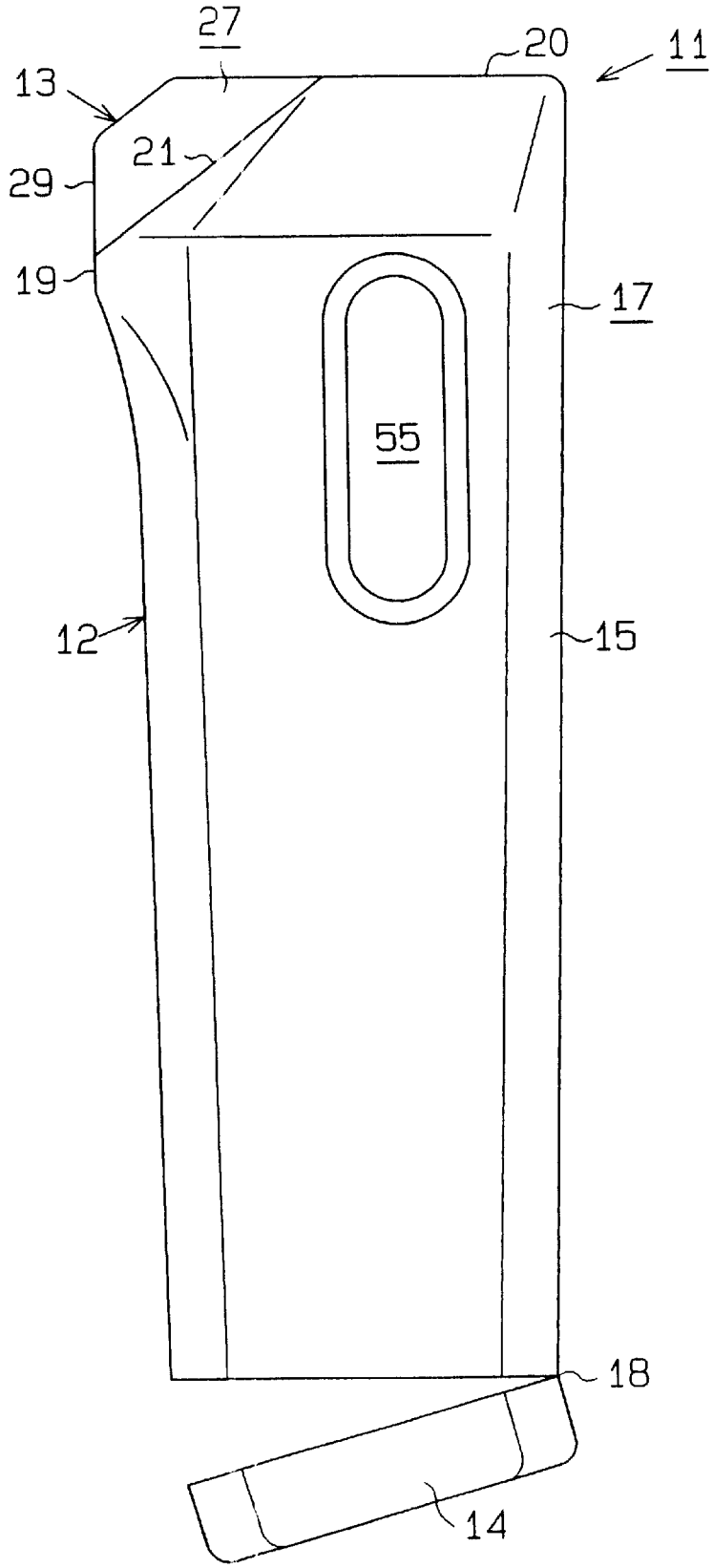
FIG. 33 is a lateral view of a container according to another embodiment.

In the second and third embodiments, the container body 12 may be formed of one lid 17 and one lower box 14 coupled to the lid 17 through a hinge 18, as illustrated in FIG. 33. Then, the bag 42 is formed of a synthetic resin sheet, which is hardly deformed. In this case, the bag 42 can be readily inserted from the lower end of the container body 12, and the upper end of the bag 42 can be readily positioned in the opening 24. It is therefore possible to hold the bag 42 substantially in a manner similar to the second and third embodiments, and to pour some of the liquid 41 from the bag 42. It is also possible to adjust the flow rate of the liquid 41 to be poured out.

In the second and third embodiments, one lid 17 is fixed to the lower box 14, and the other lid 17 is coupled to the inner edge of the top wall 20 of the lid 17 through the hinge 18. In this way, the other lid 17 closes the lower box 14. Preferably, an engaging tab 51 or an engaging recess is located at the lower end of the lid 17, while an engaging recess or an engaging tab 51 is located the upper end of the lower box 14. In this case, similar effects to those of the second and third embodiments are produced.

In the second and third embodiments, a pair of fastening rails 38 abutting to each other may be formed on the inner faces of the pair of fasteners 37 of the cap 13. In this case, since the pourer 43 of the bag 42 can be further locally fastened, the pourer 43 can be more tightly fastened for sealing.

In the second and third embodiments, a protrusion may be formed on the inner face of each side wall 15 of the container body 12 so as to urge side surfaces of the bag is 42. In this case, since the bag 42 is supported such that it is smoothly inclined from the bottom to the pourer 43, the liquid 41 can be smoothly poured out of the pourer 43.

In the second and third embodiments, at least one of the container body 12 and the top lid 27 of the cap 13 may be made, for example, of a synthetic resin such as polyethylene, polystyrene, polyethylene terephthalate, polyvinyl chloride, polycarbonate, acrylic resin or the like, aluminum, or waterproof converted paper.

The container 11 according to the second and third embodiments may be made of a colored opaque synthetic resin. In this case, preferably, a window 16 may be formed through at least one of the container body 12 and the lids 17.

In the second and third embodiments, the clip 61 may be made of an elastic material, for example, silicone, natural rubber, synthetic rubber, thermoplastic elastomer, or the like.

In the second and third embodiments, at least one of the fastening rails 38, recess 55 and finger recess 62 may be omitted. In this case, the structure of the container 11 is simplified.

In the second and third embodiments, one of the pouring zones 73 of the bag 42 may be omitted. In this case, the structure of the bag 42 can be simplified.

In the second and third embodiments, a pouring zone 73 may be formed at least one end portion of the lower welded zone 72 of the bag 42, as indicated by two-dot chain lines in FIG. 14. Further, a cutting line for forming the hanging hole 74 is preferably formed in a central portion of the lower welded zone 72. In this case, since the bag 42 can be used upside down, the bag 42 can be more easily handled.

In the respective embodiments, the bag 42 may contain the liquid 41, for example, oolong tea, green tea, sports drink, milk, soup, gum syrup, alcoholic liquor, sweet sake, vinegar, salad oil, sesame oil, olive oil, machine oil, and so on. In this case, the container 11 has wider applications.

In the second and third embodiments, the fixing pins 59 may be omitted. Even in this case, the bag 42 can be securely contained in the container body 12.

In the second and third embodiments, the positioning piece 57 may be colored, for example, in red so as to be prominent. In this case, the hanging hole 74 of the bag 42 can be readily mounted to the positioning piece 57.

Figure 34:
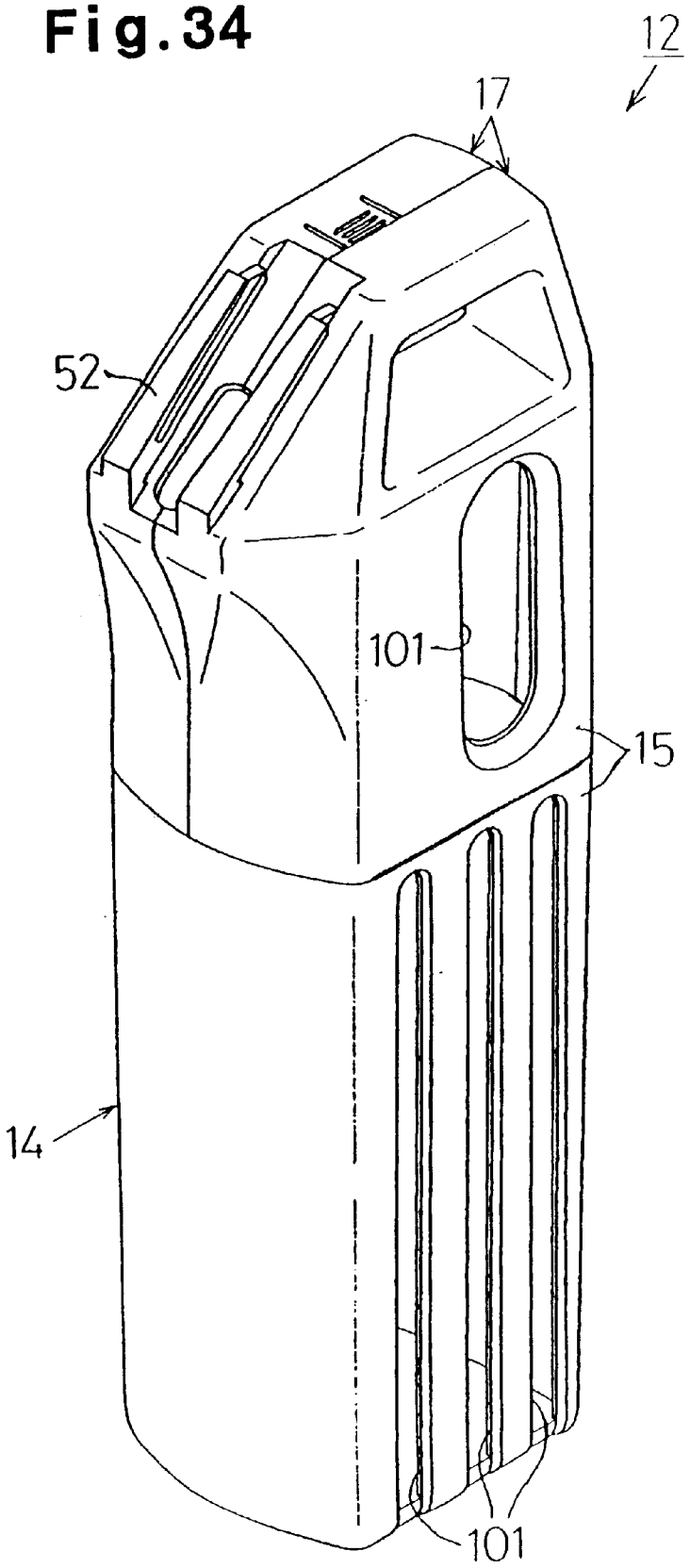
FIG. 34 is a perspective view of a container according to another embodiment.

In the second and third embodiments, a through hole 101 may be formed through the side wall 15 of the container body 12, as illustrated in FIG. 34. In this case, the liquid 41 can be readily and rapidly cooled. Further, when a transparent liquid 41 such as mineral water is contained, the amount of the remaining liquid 41 can be readily viewed. When the through hole 101 is formed in the recess 55, the container 11 can be readily held.

Figure 35:
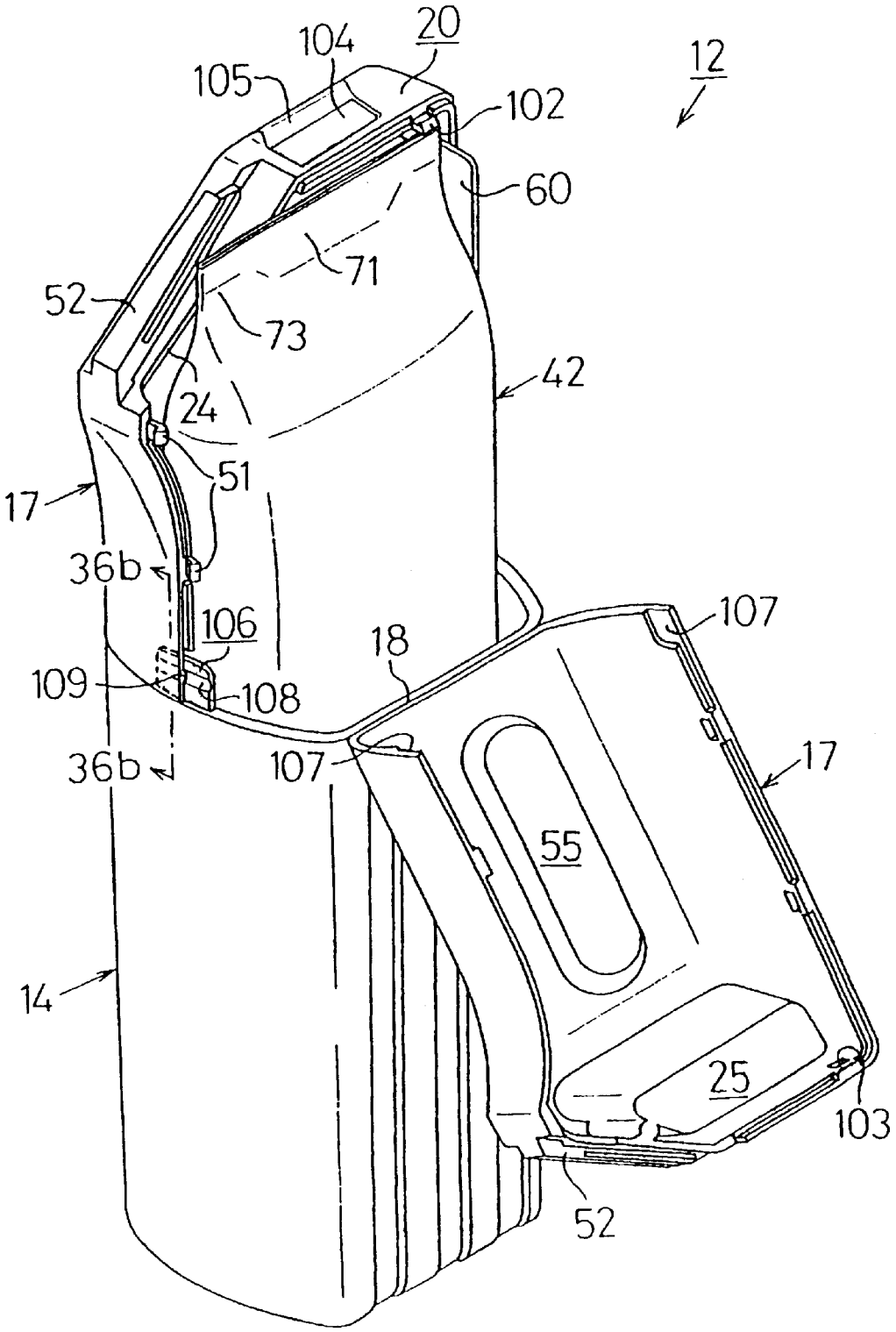
FIG. 35 is a perspective view of the container of FIG. 34.

In the second and third embodiments, the positioning piece 57 and the positioning hole 58 may be omitted, as illustrated in FIG. 35. The hanging hole 74 may be omitted. Further, the fixing pins 59 may be omitted. In this case, the bag 42 can be likewise fixed with the top edge clamped by the clamping faces 25.

Figure 36A:
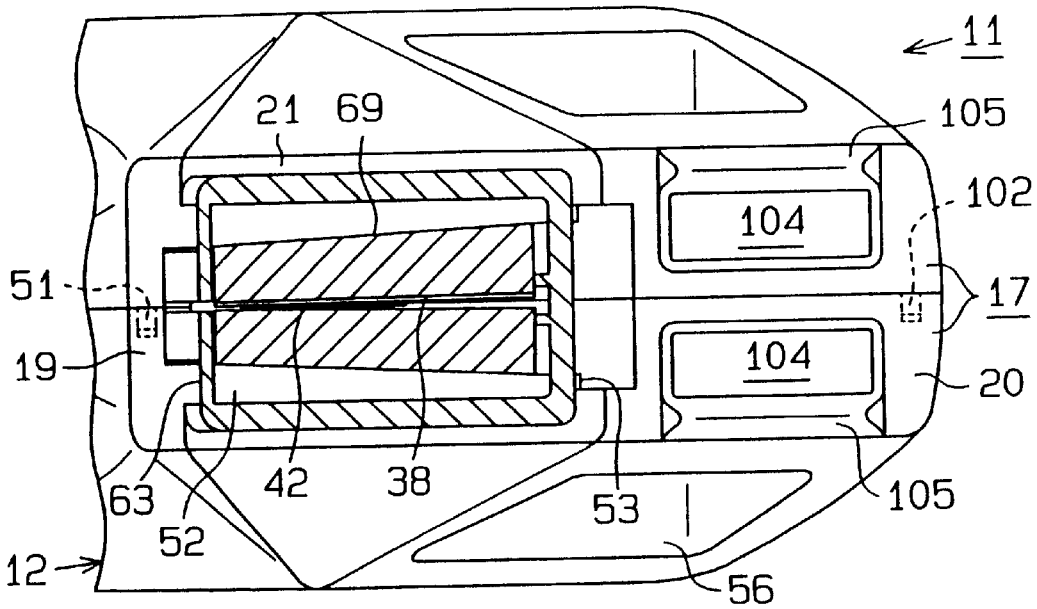
FIG. 36(*a*) is a cross-sectional view of the container of FIG. 35.
Figure 36B:
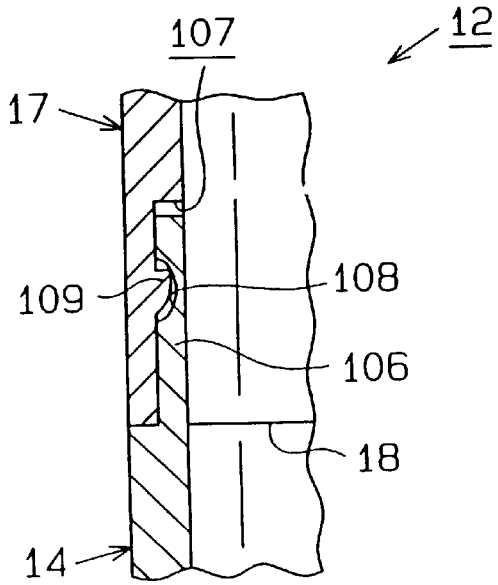

In the second and third embodiments, an engaging protrusion 102, in place of the engaging tab 51, and a corresponding engaging recess 103 (FIG. 35) may be formed in rear upper end portions of the lids 17, as illustrated in FIGS. 35 and 36(*a*). A pair of finger recesses 104 may be formed in the central portion of the top surface of the top wall 20, and a rail 105 may be formed along the outer end of the finger recess 104. In this case, the lid 17 can be readily opened.

In the second and third embodiments, a protrusive piece 106 may be formed in the end portion of the lower box 14, and a recess 107 corresponding to the protrusive piece 106 may be formed in the lid 17, as illustrated in FIG. 35. Preferably, the protrusive piece 106 is formed with a groove 108 extending in the horizontal direction, and a rail 109 for engagement with the groove 108 is formed on the recess 107, as illustrated in FIG. 36(*b*). Also, the recess 107 may be omitted such that the protrusive piece 106 abuts the inner faces of the lids 17.

In these cases, since portions susceptible to deformation and mispositioning are supported by the protrusive piece 106 and the recess 107, the lid 17 can be closed without slippage, and the shape of the container body 12 is firmly maintained. Also, the hinge 18 can be effectively prevented from being destroyed, so that the durability of the container body 12 can be improved.

The engagement of the groove 108 with the rail 109 enables only one lid 17 to stably stand on the lower box 14. This allows the upper end portion of the bag 42 to be readily positioned and mounted at a predetermined position of the clamping faces 25 of the lids 17. Also, the hanging hole 74 of the bag 42 can be readily inserted into the positioning piece 57.

Figure 37:
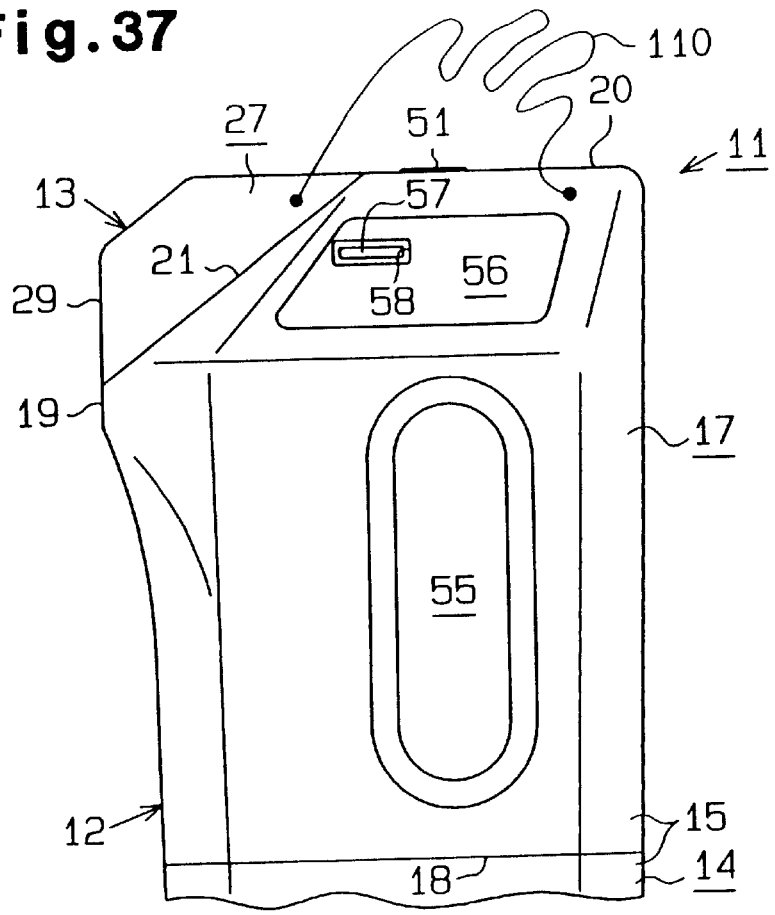
FIG. 37 is a lateral view of a container according to another embodiment.

In the respective embodiments, the lids 17 and the cap 13 may be connected by a strap 110, as illustrated in FIG. 37. The strap 110 is preferably made of rubber or nylon. In this case, loss of the cap 13 can be prevented.

Figure 38:
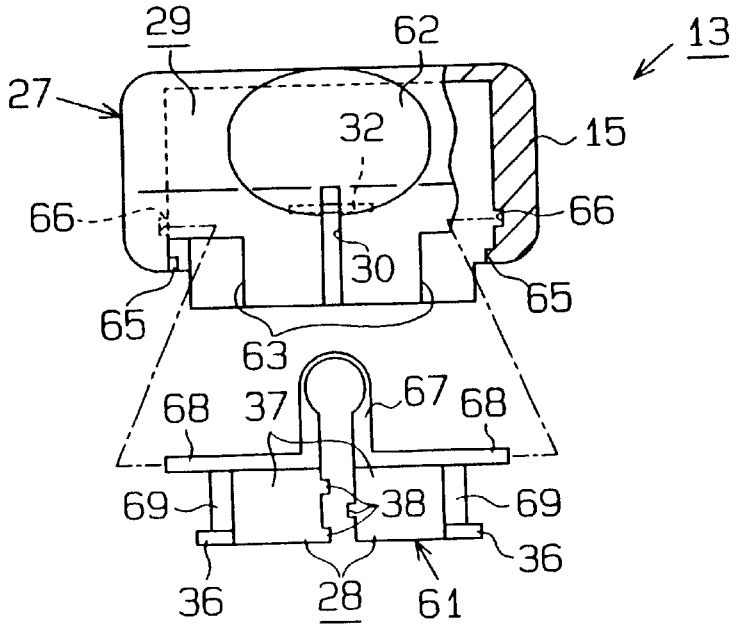
FIG. 38 is a front view of a cap according to another embodiment.

In the second and third embodiments, one fastening rail 38*a* may be formed on a surface opposing the two fastening rails 38, as illustrated in FIG. 38. The fastening rail 38*a* abuts the fasteners 37 at intermediate positions of the two fastening rails 38. In this case, the bag 42 is more securely sealed, thereby securely preventing the contained liquid 41 from leaking. Further, when the cap 13 is slid to the rear to open the bag 42, the portion near the pourer 43 is not deformed, so that the liquid 41 can more easily pour out.

Figure 39A:
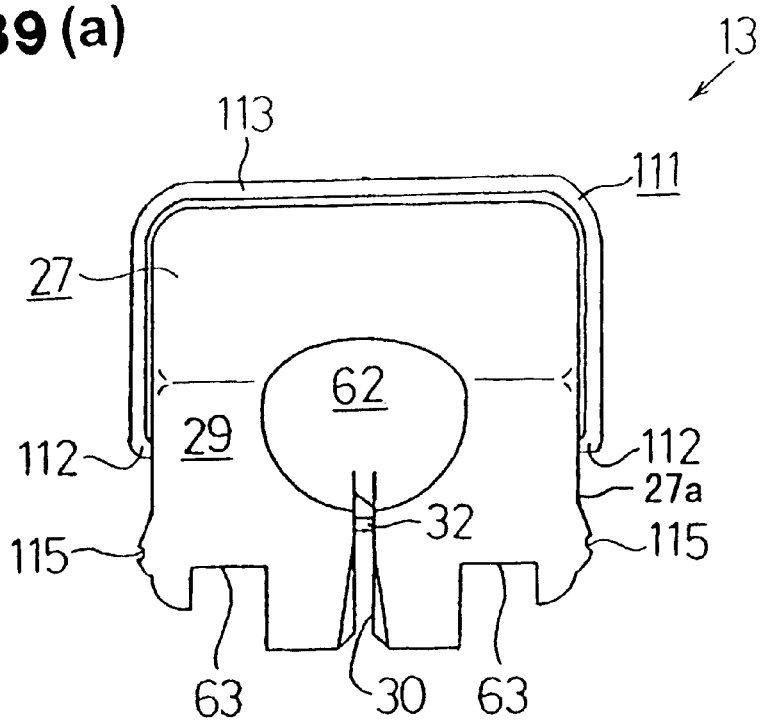
FIG. 39(*a*) is a front view of a cap according to another embodiment.
Figure 39B:
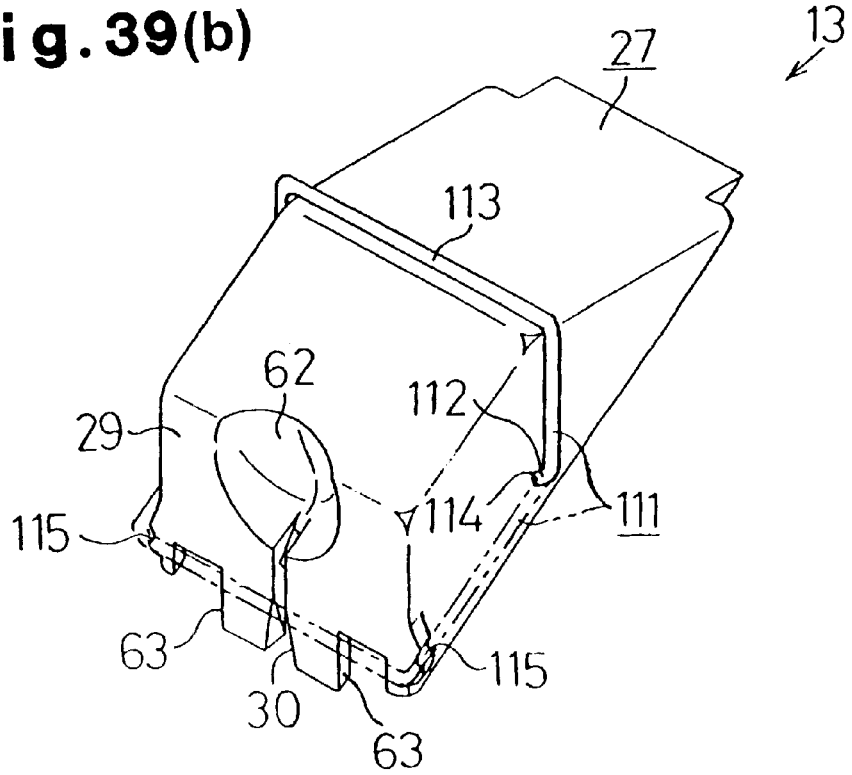

In the second and third embodiments, a locking member 111 formed by bending a round rod may be pivotably arranged on the top lid 27 of the cap 13, as illustrated in FIGS. 39(*a*) and 39(*b*). The locking member 111 includes a pair of pivot shafts 112, which are bent inwardly, and a handle 113.

The pivot shafts 112 are inserted into shaft holes 114 formed in the side walls 15*a* of the top lid 27. In this way, the locking member 111 can be pivotally moved along the top lid 27. Then, as shown by imaginary lines in FIG. 39(*b*), when the locking member 111 is pivoted in front to abut the front wall 29 of the top lid 27, the handle 113 is positioned in front of the passages 63.

Further, locking grooves 115 are preferably provided on the side walls 17*a* of the top lid 27 such that the locking member 111 can be locked at a predetermined position. A restriction (for example, a groove or a hook) for fixing the locking member 111 at a different location may be formed on the top lid 27.

In this case, when the opening 24 is closed by the cap 13, the locking member 111 is brought into contact with the front wall 29 of the top lid 27, which causes the handle 113 to abut the front surfaces of the tapering rails 52 on the lids 17. For this reason, the cap 13 is restricted from moving to the rear, so that the cap 13 can be fixed at the closed position.

Further, as illustrated in FIG. 39(*a*), the side walls 27*a* of the top lid 27 may be laterally extended, and locking grooves 115 may be formed in the extended side walls. In this case, when the locking member 111 is engaged with the locking groove 115, the side walls 27*a* of the top lid 27 are fastened inwardly by the locking member 111. For this reason, when the handle 113 is positioned in front of the passages 63, the side walls 27*a* of the top lid 27, tapering rails 52 and fasteners 37 of the clip 61 are fastened, so that the bag 42 is more tightly fastened.

In the respective embodiments, the bag 42 is formed to have the capacity of, for example, 200 ml, 350 ml, 500 ml, 1 liter, 1.5 liters, and 2 liters.

Figure 40:
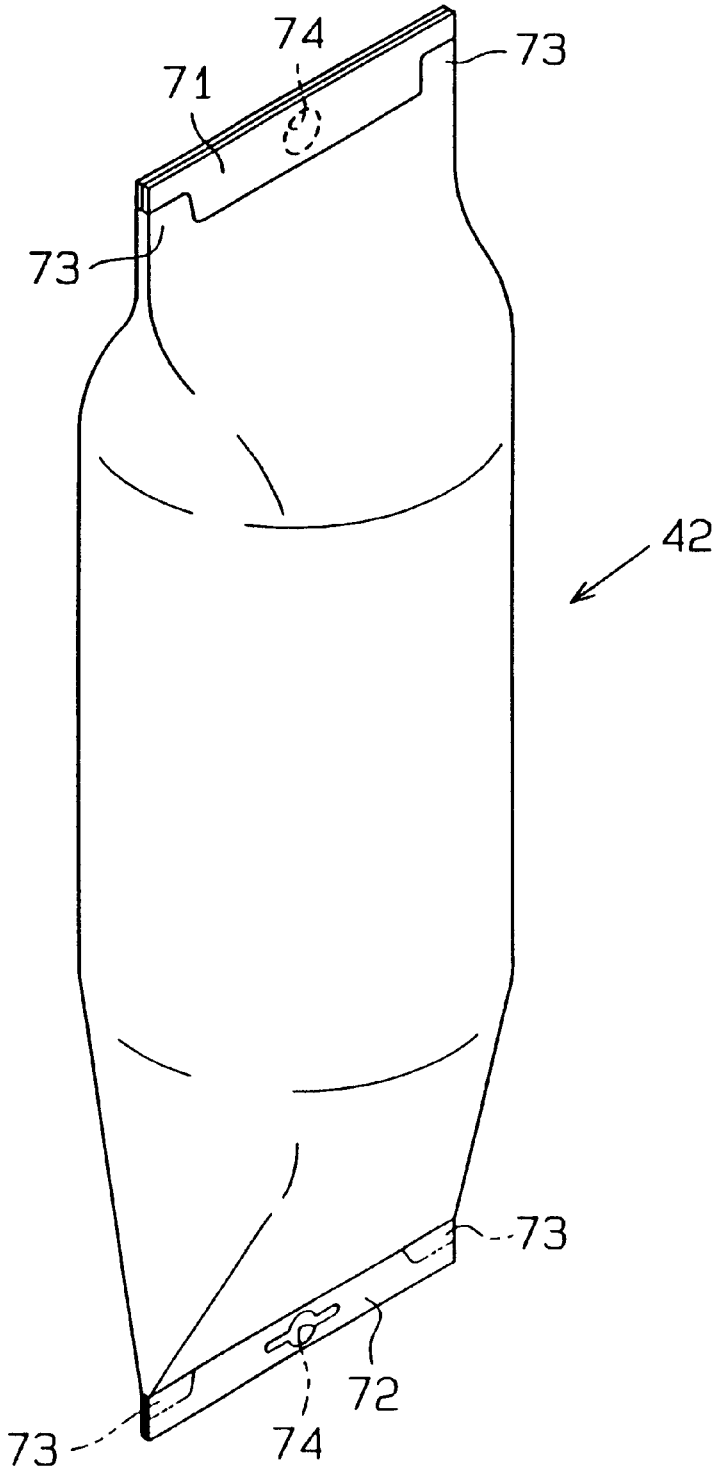
FIG. 40 is a perspective view of a liquid containing bag according to another embodiment.

In the respective embodiments, the hanging hole 74 in the upper welded zone 71 of the bag 42 may be circular, as indicated by a dotted line in FIG. 40. Further, a circular hanging hole 74 may be formed in the central portion of the lower welded zone 72.

Alternatively, as illustrated in FIG. 40, at least one of the hanging holes 74 in the upper welded zone 71 and the lower welded zone 72 may be formed in the shape of a combination of an elongated hole and a circular hole.

In this case, the bag 42 can be displayed on a display rod provided on a display shelf in a store or the like. The display rod is generally metal rod for supporting a plurality of articles by inserting the rod through hanging holes formed through the articles. The articles are displayed in line along the display rod.

Figure 41:
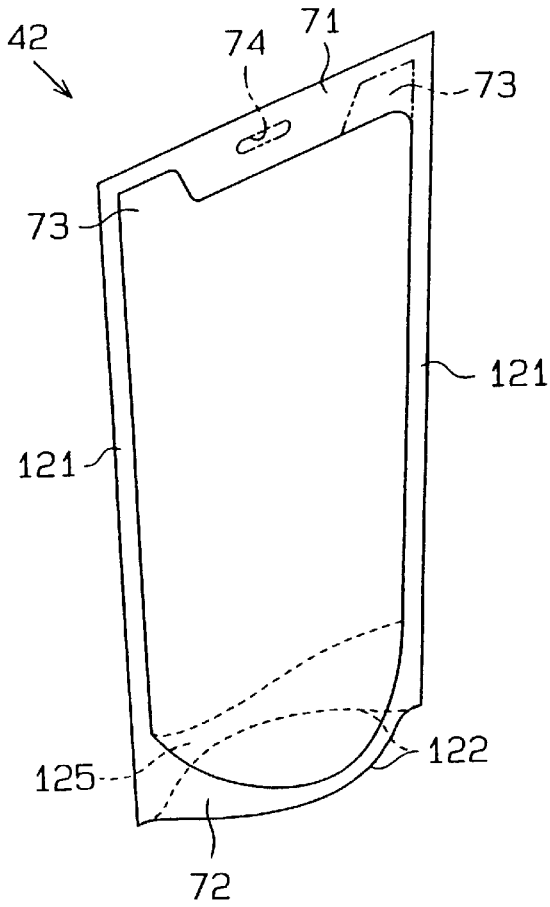
FIG. 41(*a*) is a perspective view of a liquid containing bag according to another embodiment.
Figure 41:
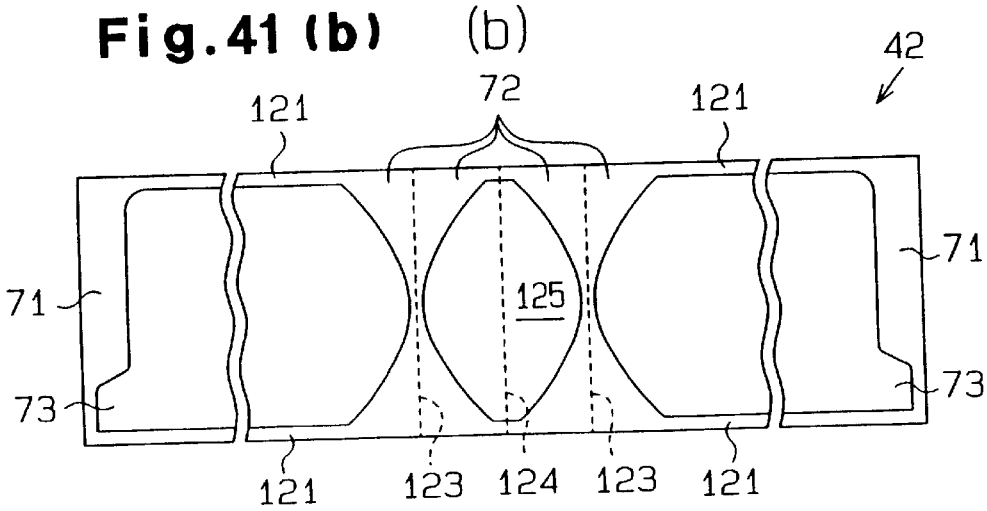

In the second and third embodiments, the positioning piece 57 may be omitted, and a bag 42 illustrated in FIGS. 41(*a*) and 41(*b*) may be employed. Specifically, the bag 42 is formed with an upper welded zone 71 and lateral welded zones 121 along the upper edge and the side edges by thermal welding. Further, a substantially cylindrical lower welded zone 72 is formed in the lower end portion of the bag 42 by thermal welding. The bag 42 can stand by itself with a leg 122 formed by lower edges of the lower welded zone 72. Also, a pouring zone 73 thermally welded in a smaller width is formed at the corner of the upper welded zone 71.

The bag 42 is manufactured in the following manner. First, a rectangular polyethylene sheet, as shown by a developed plan of FIG. 41(*b*), is folded along two valley folding lines 123 and along a peak folding line 124 at the position midway between the valley folding lines 123.

Next, the polyethylene sheet is folded back along the valley folding lines 123, and the peak folding line 124 is thermally welded to form the lateral welded zones 121 and the lower welded zone 72. Further, the upper welded zone 71 is thermally welded after the container is filled with liquid 41. In this event, a base 125, which is substantially circular, and the lower welded zone 72 along the periphery of the base 125 are formed in the lower end portion of the bag 42. Further, a substantially cylindrical leg 122 is formed by the valley folding lines 123 in the lower end portion of the lower welded zone 72.

This bag 42 is securely contained and held in the container 11. Also, since the bag 42 can stand by itself, the bag 42 can be easily handled.

Further, as illustrated in FIG. 41(*a*), a cutting line may be formed in the center of the upper welded zone 71 of the bag 42 for forming the hanging hole 74. In this case, the hanging hole 74 may receive the positioning piece 57 to readily position the bag 42.

Further, as illustrated in FIG. 41(*a*), a pouring zone 73 may be formed at each corner of the upper welded zone 71 of the bag 42.

The base 125 of the bag 42 illustrated in FIGS. 41(*a*) and 41(*b*) may be of a polygonal shape, for example, triangle, rectangle, hexagon, octagon, or the like, or of an elliptic shape.

Figure 42:
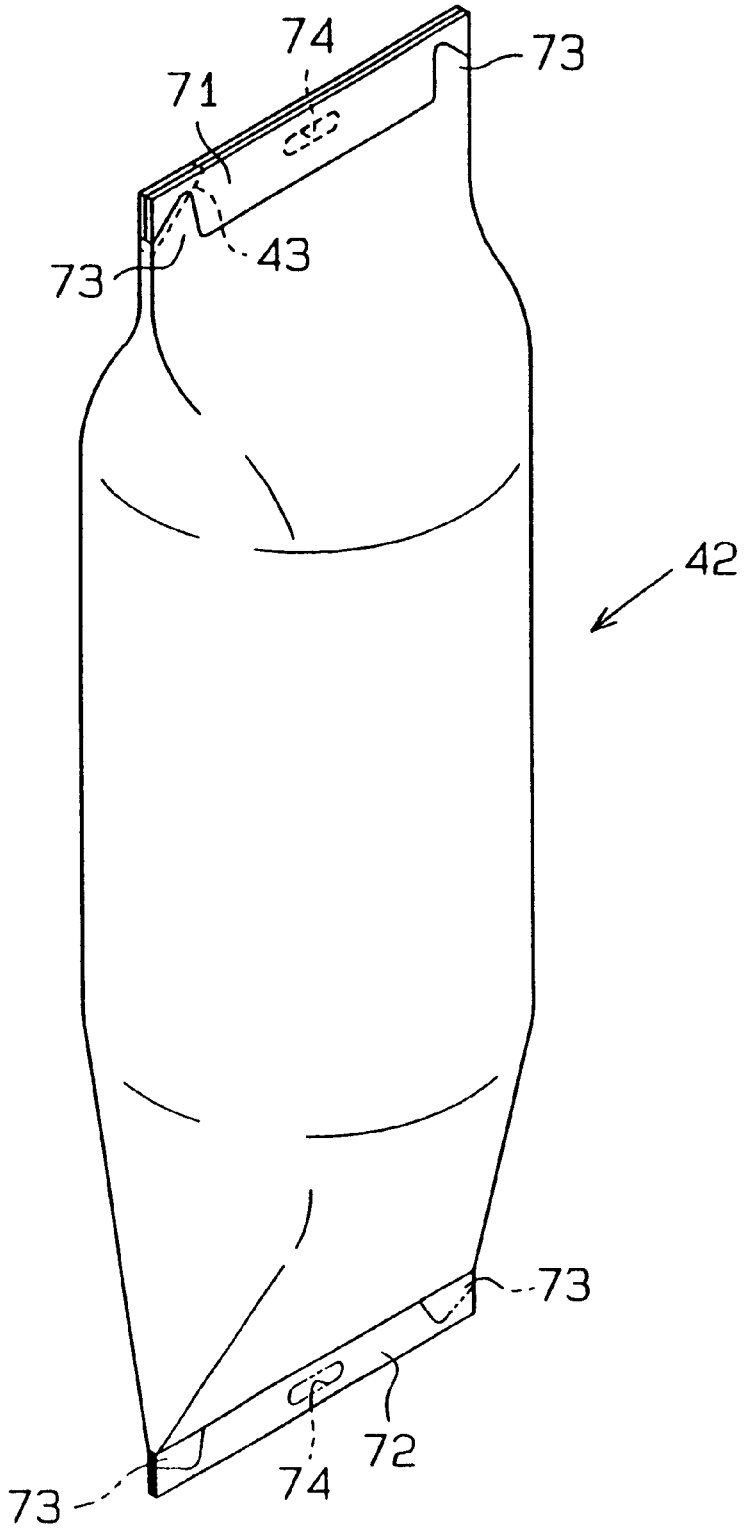
FIG. 42 is a perspective view of a liquid containing bag according to another embodiment.

In the bag 42 according to the second and third embodiments, an inclined pouring zone 73 may be formed along a cutting line (dotted line) of the blade 32, as illustrated in FIG. 42. In this case, when the bag 42 is opened, substantially no liquid 41 remains in a cut portion. Therefore, the container 11 is less likely to be contaminated by the liquid 41 left in the pouring zone 73 when the bag 42 is opened. Further, since the blade 32 hardly contacts the liquid 41 when the bag 42 is opened, the blade 32 resists corrosion and is sanitary. Particularly, this is effective for bags 42 containing liquids 41 such as juice, sports drink, vinegar, or the like, which promote corrosion.

Figure 43:
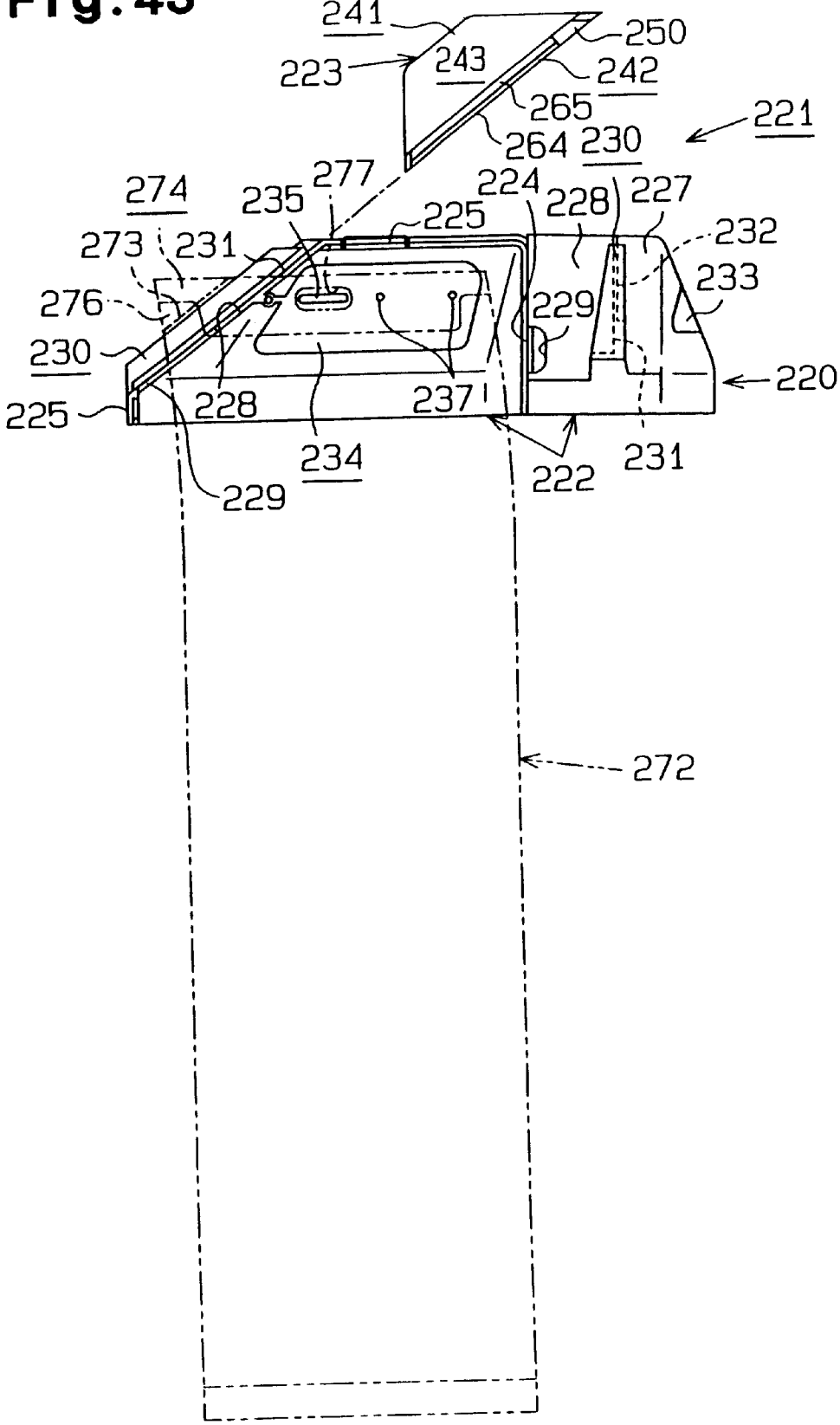
FIG. 43 is a lateral view of a holder according to a fourth embodiment.

In the following, a fourth embodiment will be described. As illustrated in FIG. 43, a holder 221 according to the fourth embodiment is similar to the upper portion of the lid 17 of the holding container 11 in FIG. 25. The holder 221 is mounted to a bag 272. The holder 221 has an attachment 220 and a removable cap 223. The liquid containing bag 272 is filled with a liquid 271, and is sealed. The holder 221 is preferably made of a hard synthetic resin. The bag 272 is preferably made of polyethylene.

Figure 44:
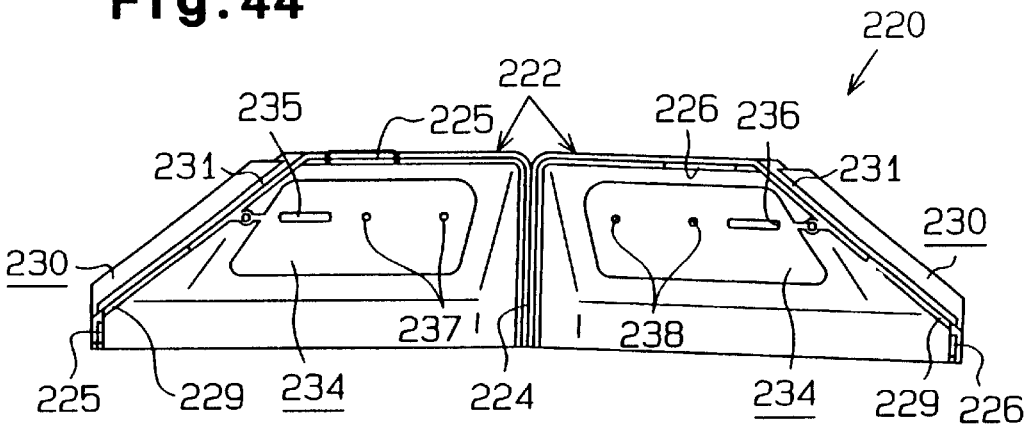
FIG. 44 is a lateral view of an attachment in FIG. 43.

As illustrated in FIGS. 43 and 44, the attachment 220 is formed of two substantially symmetric lids 222, which are connected through a hinge 224. The two lids 222 are pivoted about the hinge 224. Also, the attachment 220 has no bottom.

A mating face (inner edge) of one lid 222 is formed with a plurality of engaging protrusions 225, while a mating face of the other lid 222 is formed with engaging recesses 226 for engagement with the engaging protrusions 225. Then, by closing the lid 222, the respective engaging protrusions 225 are engaged with the engaging recesses 226, and a containing space is formed in the attachment 220 for containing the upper end portion of the bag 272.

Each lid 222 is formed with an outer inclined surface 227 and an inner inclined surface 228 in parallel. An oval opening 229 is formed through the front portion of the inner inclined surface 228. When the attachment 220 is attached to the bag 272, the opening 229 is positioned below a pourer 273 of the bag 272.

A tapering rail 230, which widens toward the front, is formed between the outer inclined surface 227 and the inner inclined surface 228. A guide groove 231 is formed between a bottom surface of the tapering rail 230 and the inner inclined surface 228. A fastening groove 232 is formed on the outer surface of the tapering rail 230 as a rail groove indicated by dotted lines in FIG. 43. The fastening groove 232 has a predetermined length along the outer inclined surface 227.

A rectangular handle recess 233 is formed in each of the side surfaces of the lids 222 to facilitate carrying of the holder 221. By grabbing the handle recesses 233, the bag 272 can be readily inclined to pour out the liquid 271. When the attachment 220 is closed, rear surfaces (clamping faces) 234 of the respective handle recesses 233 abut each other.

A plate-like positioning piece 235, which extends horizontally, is formed on one clamping face 234, while a positioning hole 236 for receiving the positioning piece 235 is formed in the other clamping face 234. A plurality of conical fixing pins 237 are formed in front of and behind the positioning piece 235. Also, fixing holes 238 for engagement with the fixing pins 237 are formed in line in front of and behind the positioning hole 236.

The cap 223 is similar to the cap 13 illustrated in FIGS. 15(*a*), 15(*b*) and 16. Specifically, the cap 223 has a clip 242 formed of an elastic member and a top lid 241 for covering the clip 242. The top lid 241 is preferably made of hard polypropylene. The top lid 241 has trapezoidal side surfaces. In other words, the top surface of the top lid 241 is parallel with the lower edges of the respective side walls 243 of the top lid 241. The cap 223 is engaged with the tapering rail 230 of the lid 222 for forward and backward movements.

Figure 45:
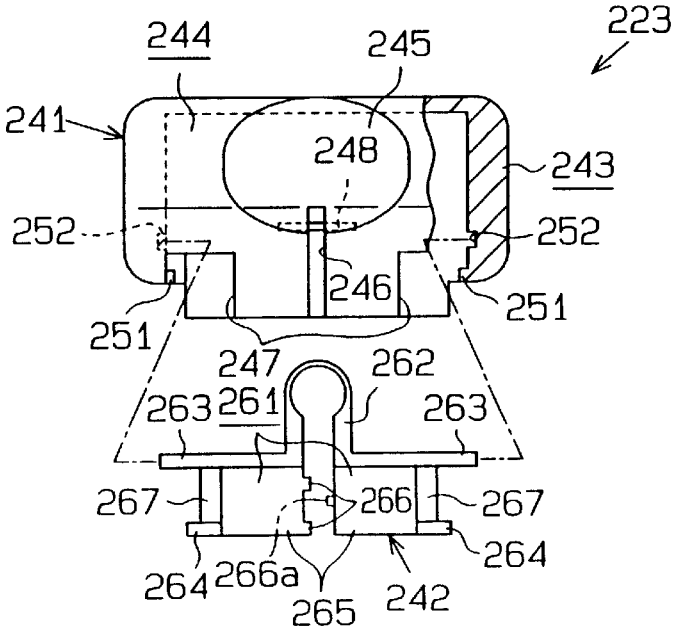
FIG. 45 is a front view of a cap in FIG. 43.
Figure 46:
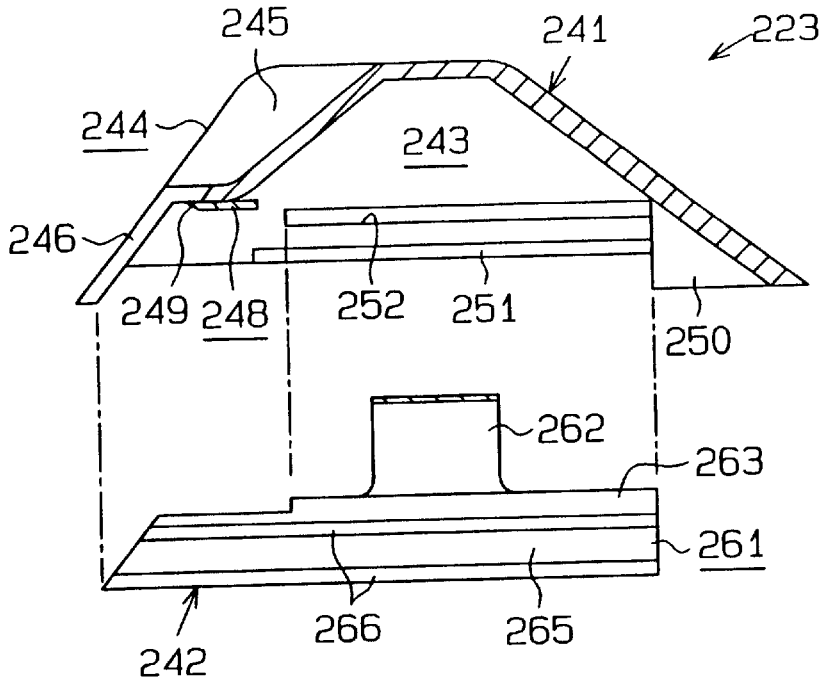
FIG. 46 is a cross-sectional view of the cap in FIG. 43.

As illustrated in FIGS. 45 and 46, a finger recess 245 is formed in the top lid 241 for readily sliding the cap 223 to the rear. A slot 246 extends from the lower end of the front wall 244 to the finger recess 245. A pair of notches 247 are formed in the lower edges of the front wall 244 for receiving the tapering rail 230.

A blade 248 is mounted on the rear side of the finger recess 245. The plane of the blade 248 is substantially parallel with the base of a supporter 261. A portion of an edge 249 of the blade 248 is located in the slot 246.

A pair of triangular stopper plates 250 are formed on the rear surface of the top lid 241. One side (inner edge) of the stopper plates 250 is substantially perpendicular to the lower edge of the side walls 243 of the top lid 241. In other words, one side of the stopper plate 250 is substantially perpendicular to the base of the supporter 261.

Figure 47:
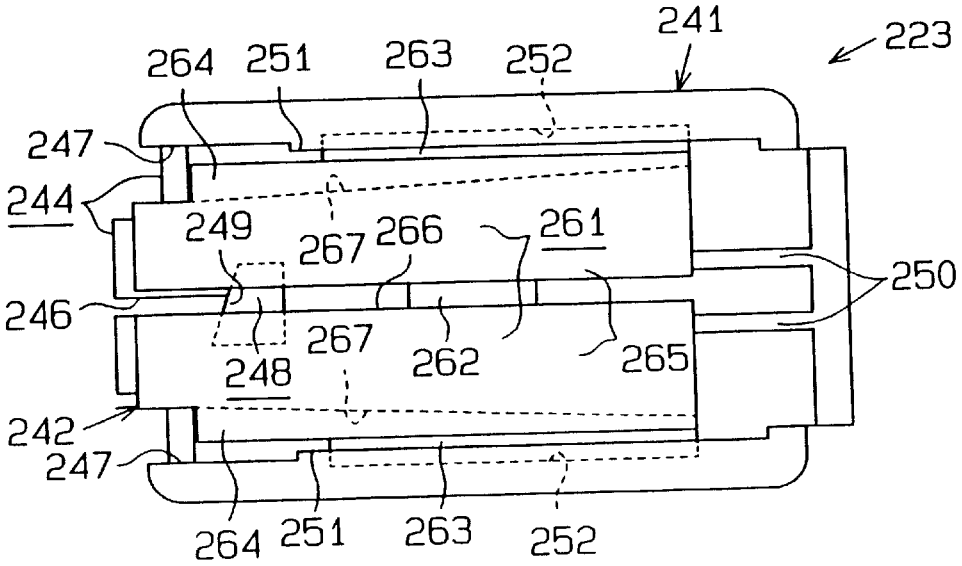
FIG. 47 is a bottom view of the cap in FIG. 43.

As illustrated in FIGS. 45 through 47, the side walls 243 are formed with fastening rails 251 on the lower edges that extends in the forward and backward directions and protrude inwardly. The fastening grooves 232 of the lids 222 are engaged with the fastening rails 251. Stopper grooves 252 extending parallel with the fastening rails 251 and having a predetermined length are formed on the side walls 243.

The clip 242 includes a pair of substantially symmetric supporters 261 and a U-shaped coupling portion 262 for coupling the supporters 261. The supporters 261 and the coupling portion 262 are elastic members. When a force changing the distance between the supporters 261 acts on the clip 242, the coupling portion 262 urges the supporters 261 with an oppositely directed force for restoring the distance between the supporters 261.

The supporters 261 are formed with stopper plates 263 on the upper ends. The stopper plates 263 extend in the forward and backward directions and protrude outwardly, respectively. Engagement of the stopper plates 263 with the stopper grooves 252 causes the supporters 261 to be attached at a predetermined position of the top lid 241. At the lower end of each supporter 261, a sliding plate 264 extends in the forward and backward directions and protrudes outwardly. The sliding plates 264, which engage the guide grooves 231 of the lids 222, can slide along the guide grooves 231.

A fastener 265 is formed between the stopper plate 263 and the sliding plate 264. The opposing faces (inner faces) of the fasteners 265 are parallel. Two fastening rails 266, which extend in the forward and backward directions, are formed on the inner face of one supporter 261. The pourer 273 of the bag 272 is fastened by the fastening rails 266 of a relatively small area.

Figure 49:
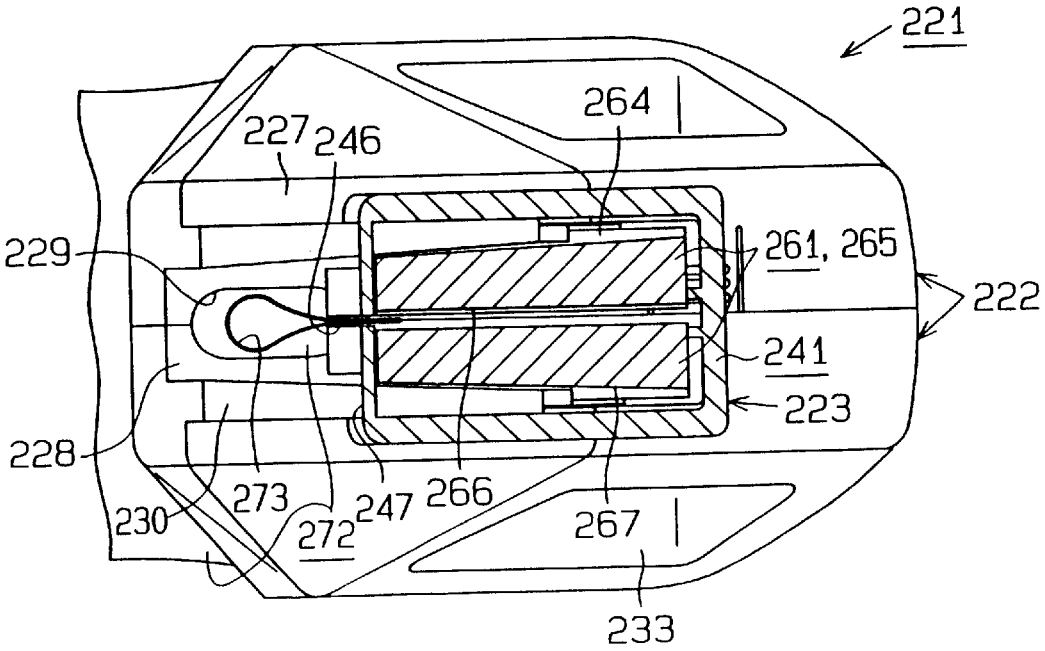
FIG. 49 is a cross-sectional view of a bag closing step.

As illustrated in FIGS. 45 and 47, the fasteners 265 widen toward the rear. Specifically, the fasteners 265 have an inclined side surface (tapered surface) 267. As illustrated in FIG. 49, when the cap 223 is mounted to the lids 222, the tapered surfaces 267 are placed parallel with the inner side surfaces of the tapering rails 230 on the lids 222.

Figure 50:
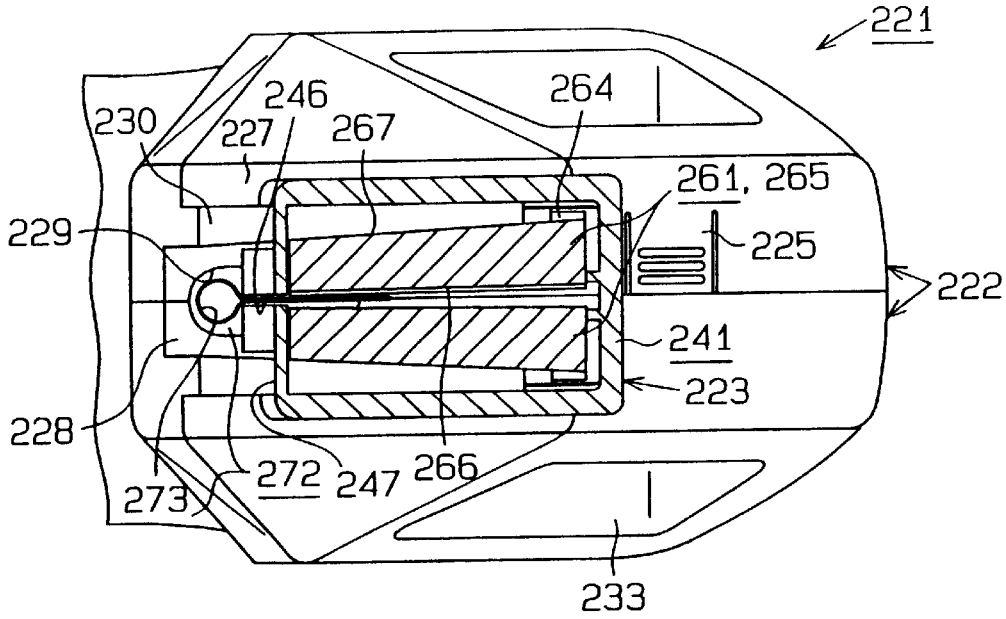
FIG. 50 is a cross-sectional view of a bag closing step.
Figure 51:
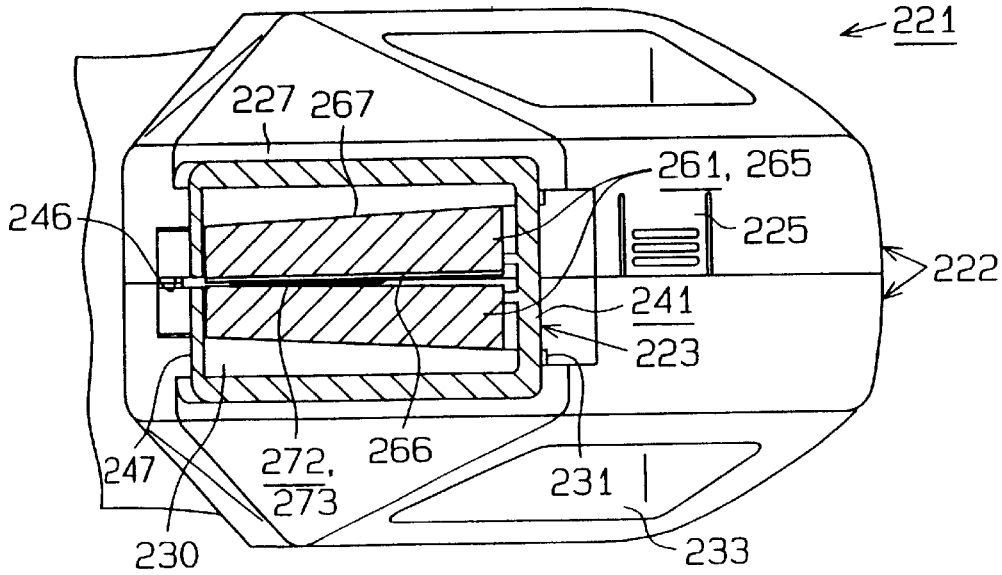
FIG. 51 is a cross-sectional view of a bag closing step.

A process of mounting the cap 223 to the attachment 220 is shown from FIGS. 49 through 51. The tapered surfaces 267 are slid along the tapering rails 230 to bring the inner faces of the fasteners 265 closer to each other. As the cap 223 is slid forward, the tapered surfaces 267 are clamped by the tapering rails 230, so that the inner faces of the fasteners 265 abut each other.

The function of the holder 221 is described below.

Figure 48:
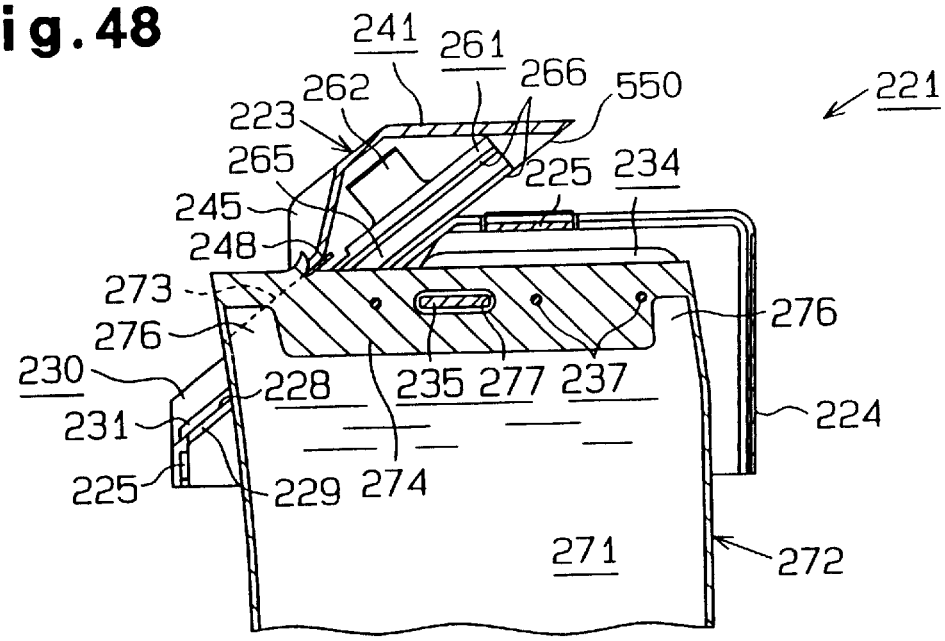
FIG. 48 is a cross-sectional view of a bag opening step.

When the bag 272 is mounted on the holder 221, the upper end portion of the bag 272 is first cut along the cutting line to form a hanging hole 277. As illustrated in FIG. 43, the lids 222 are opened. The hanging hole 277 receives the positioning piece 235. Then, the lids 222 are closed to engage each engaging protrusion 225 with the engaging recess 226. In this way, the upper end portion of the bag 272 is clamped at a predetermined position of the lids 222. Specifically, the bag 272 is offset toward the front of the attachment 220 by the hanging hole 277 and the positioning piece 235, as illustrated in FIG. 48. Also, the upper welded zone 274 is fixed by the plurality of fixing pins 237. The front corner of the bag 272 is positioned above the lids 222.

Next, when the bag 272 is opened, the cap 223 is first placed above the lid 222, and the cap 223 is moved along an imaginary line in FIG. 43. The fastening rails 251 of the top lid 241 are inserted into the fastening grooves 232 of the lids 222, and the sliding plates 264 of the supporters 261 are inserted into the guide grooves 231 of the lids 222. Then, the cap 223 is slid to the front up to the front end of the tapering rails 230.

In this event, as illustrated in FIGS. 49 through 51, the bag 272 is clamped between the slot 246 and the inner edges of the lids 222. Also, the bag 272 is fastened between the inner faces of the fasteners 265.

Then, as indicated by a dotted line in FIG. 48, the corner of the bag 272, including one pouring zone 276, is cut by the blade 248 to form the pourer 273. Since the opened bag 272 is supported between the lids 222, it can be held by grasping the attachment 220. Therefore, the bag 272 is prevented from deformation, and the liquid 271 is prevented from flowing out of the bag 272.

Figure 52:
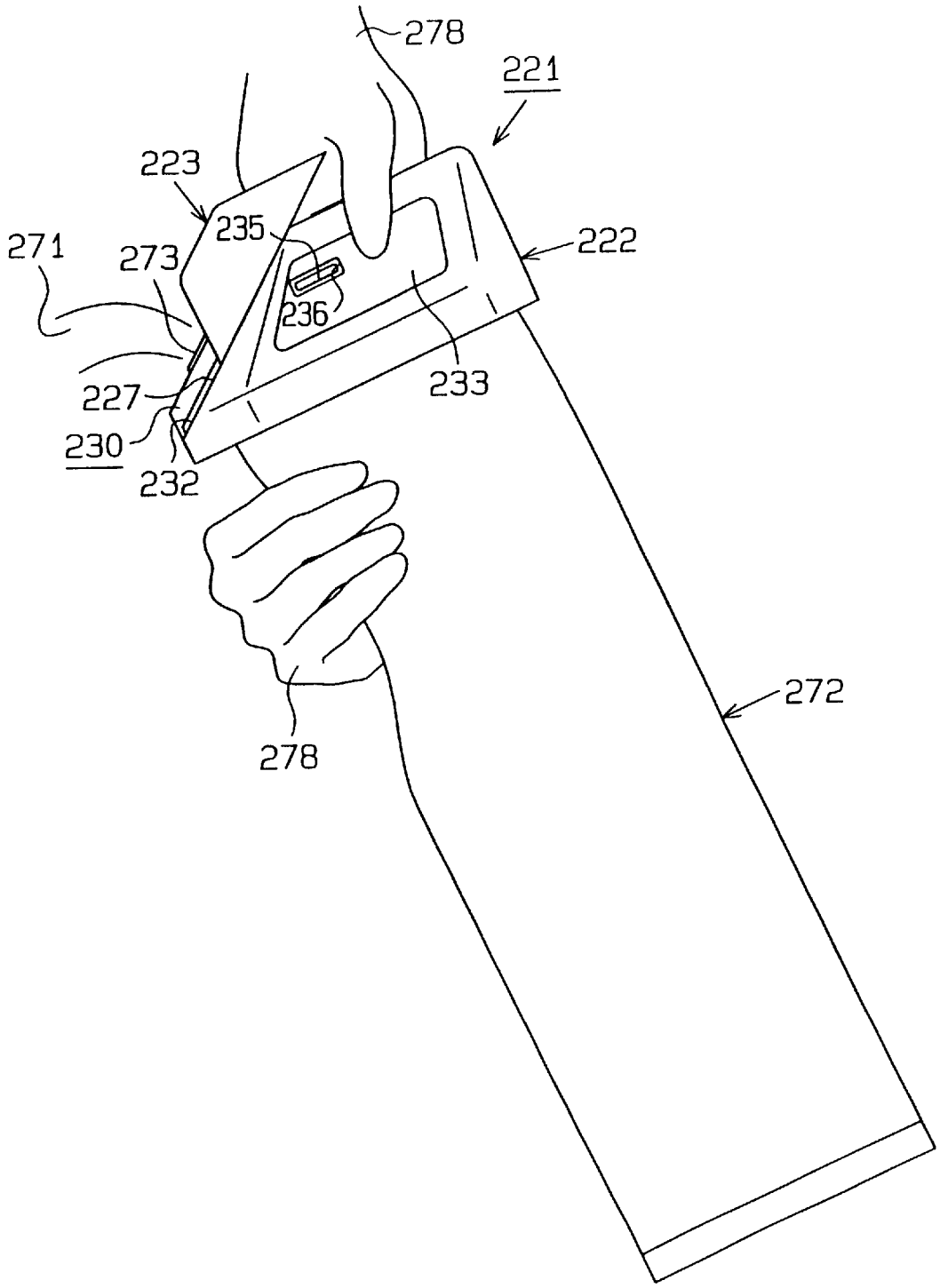
FIG. 52 is a lateral view of a liquid pouring step.

Next, for pouring a large amount of the liquid 271 out of the bag 272, to which the attachment 220 is attached, for a short time, the cap 223 is positioned at a rear portion of the tapering rails 230 (the position indicated in FIG. 49). Thus, the bag 272 is hardly fastened by the cap 223, so that the pourer 273 is relatively large. Next, as illustrated in FIG. 52, the handle recess 233 is grasped by one hand 278 to hold the bag 272. Also, the front portion of the bag 272 is supported by the other hand 278 to incline the holder 221. Consequently, a large amount of the liquid 271 can pour out through the large pourer 273 for a short time.

On the other hand, for pouring a small amount of the liquid 271 out of the bag 272, the cap 223 is positioned in the middle of the tapering rails 230 (position indicated in FIG. 50). This causes the fasteners 265 of the cap 223 to fasten a rear portion of the pourer 273. Then, the holder 221 is inclined in a manner similar to the foregoing case. Consequently, a small amount of the liquid 271 can pour out through the relatively small pourer 273.

Also, since the size of the pourer 273 is adjusted in accordance with the position of the cap 223, the flow rate of the liquid 271 to be poured can be adjusted.

For sealing the bag 272 to store the liquid 271, the cap 223 is positioned at the front end of the tapering rails 230, as illustrated in FIG. 51. Thus, the pourer 273 is clamped between the fasteners 265 of the cap 223. Also, since the tapered surfaces 267 are pressed by the tapering rails 230 inwardly with a uniform force, the pourer 273 is sealed. In addition, since the fastening rails 266 locally fasten the bag 272, the liquid 271 is prevented from pouring out of the pourer 273.

Since the pourer 273 is completely covered with the cap 223, it is possible to prevent foreign substances such as garbage, dust and so on from attaching near the pourer 273.

When the cap 223 is properly attached to the attachment 220, the top surface of the top lid 241 is parallel with the outer inclined surfaces 227 of the lids 222, thereby making it possible to readily view whether the cap 223 has been properly attached to the attachment 220.

When the bag 272 mounted with the holder 221 is inserted into a closed hard container with a bottom, for example, a used milk pack, a cake container or the like, not shown, and the attachment 220 is carried on the top end of the hard container, the bag 272 can be kept in an upright state.

According to the fourth embodiment, the following advantages are provided.

Since the readily deformable bag 272 is fastened between the clamping faces 234 of the lids 222 and between the fasteners 265 of the cap 223, the holder 221 can be readily attached to the bag 272. As a result, the liquid 271 is prevented from leaking from the pourer 273, the liquid 271 is securely kept in the bag 272.

Further, since all the liquid 271 need not to be poured out at once, the liquid 271 in the bag 272 need not be used up at one time. Therefore, this is economical because a required amount of the liquid 271 can be dispensed when needed. Also, since the size of the pourer 273 can be adjusted using the cap 223, it is possible to readily adjust the flow rate of the liquid 271 to be poured.

Since the holder 221 is small as compared with the bag 272, the holder 221 can be accommodated in a compact space when not in use. Also, since it can be readily carried, it can be used, for example, while on a journey, thereby making it possible to further extend its utilization range.

When the cap 223 is moved frontward along the tapering rails 230, the fasteners 265 are brought closer to each other by the tapering rails 230 and the tapered surfaces 267. Then, when the cap 223 is positioned at the front ends of the tapering rails 230, the pourer 273 is clamped between the fasteners 265 and is securely sealed. As a result, the liquid 271 can be securely prevented from pouring out of the pourer 273. Also, since the size of the pourer 273 can be adjusted by changing the position of the cap 223, it is possible to arbitrarily adjust the flow rate of the liquid 271 to be poured.

Since the force fastening the fasteners 265 concentrates on the narrower fastening rails 266 formed on the inner faces of the fasteners 265, the pourer 273 of the bag 272 is fastened with a large force. Therefore, the bag 272 is securely sealed.

Since the pourer 273 is positioned above the inner inclined surface 228, the liquid 271 can be readily and sanitarily poured out of the bag 272.

The bag 272 is readily opened by the blade 248. Further, since the blade 248 is parallel with the direction in which the cap 223 is slid, it readily cuts the pouring zone 276 of the bag 272 while the cap 223 slides forward. Also, since the pourer 273 is smoothly formed, the liquid 271 can smoothly pour out.

The fasteners 265 made of elastic members enable the pourer 273 to be closed with a necessary and sufficient fastening force, so that the pourer 273 can be further securely sealed. Also, the opening 229 is readily and smoothly opened and closed by the cap 223.

The upper end of the bag 272 can be readily placed at a predetermined position in the lid 222, and supported by the positioning piece 235.

With the plurality of fixing pins 237 formed around the positioning piece 235, the bag 272 can be effectively prevented from slipping.

Since the top lid 241 can be removed from the clip 242, the maintenance of the blade 248 (corrosion prevention) and washing of the clip 242 and the top lid 241 can be readily carried out in a sanitary manner.

With the pouring zones 276 formed in both end portions of the bag 272, the bag 272 can be opened in either a forward or a backward orientation, thereby improving the handling of the bag 272. For example, if a portion near the one pouring zone 276 is contaminated, the other pouring zone 276 may be opened to sanitarily pour out the liquid 271.

With the cutting line for the hanging hole 277 formed at the center of the upper welded zone 274 of the bag 272, the hanging hole 277 can be formed as required. Also, by inserting the positioning piece 235 in the hanging hole 277 through the positioning piece 235, the bag 272 can be readily placed at a predetermined position on the lid 222.

The bag 272, which is made of a soft polyethylene sheet, allows the used bag 272 to be reduced to a sheet form. Therefore, when the bag 272 is empty, the volume of garbage is greatly reduced.

The holder 221 of the fourth embodiment may be improved in accordance with the description of the first through third embodiments and other embodiments. For example, the following modifications can be made.

The holder 221 may be used for the bag 42 illustrated in FIGS. 40 through 42.

Figure 53A:
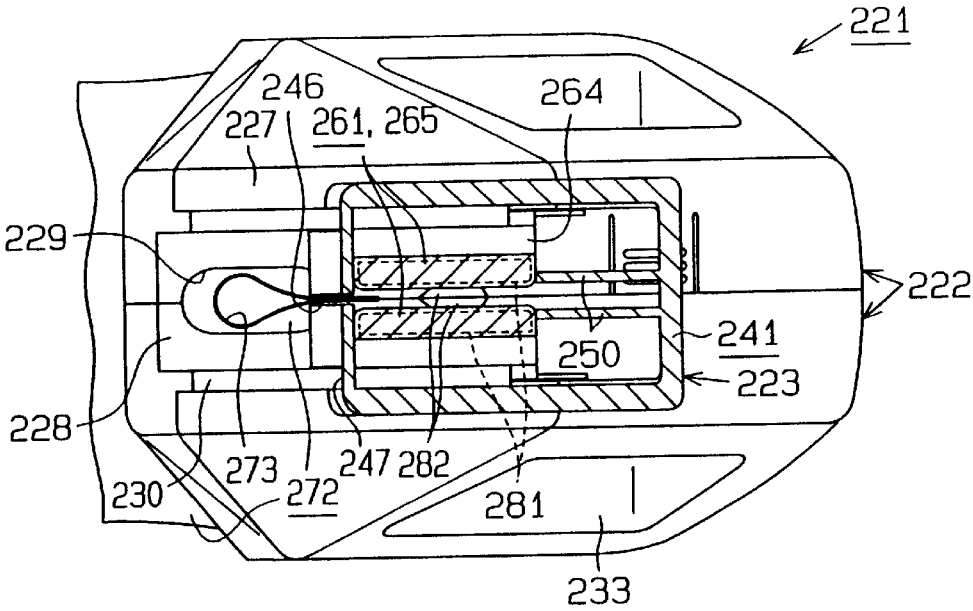
FIGS. 53(*a*) and 53(*b*) are cross-sectional views of bag closing steps using a holder according to another embodiment.
Figure 53B:
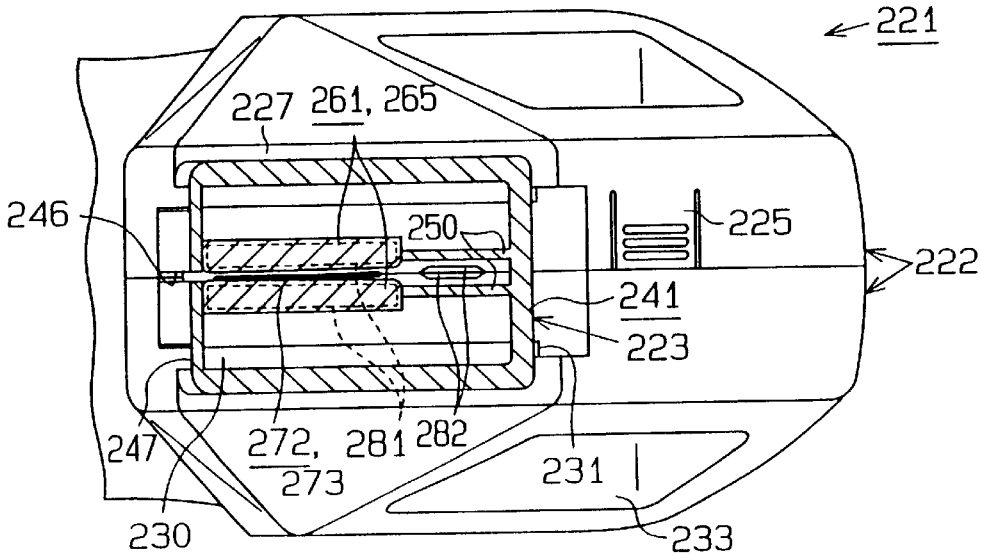

The holder 221 may be formed in a shape illustrated in FIGS. 53(*a*) and 53(*b*). Specifically, the fasteners 265 of the cap 223 are formed of a magnet 281 indicated by dotted lines and a thin elastic member (not shown) covering the magnet 281. An attractive force acts between both magnets 281. Then, the side surfaces of the fasteners 265 are formed horizontally. The tapering rails 230 are formed in a rectangular manner to avoid abutting the fasteners 265. Further, a rail 282 is formed on the inner inclined surface 228, and the fastening rails 266 of the fasteners 265 can be omitted. In this case, as the cap 223 is engaged with rear portions of the rails 230 as illustrated in FIG. 53(*a*), the fasteners 265 are separated against the magnetic forces of the magnets 281 by contact with the separating rails 282. Then, as the cap 223 is slid forward, the fasteners 265 are closed by the magnetic forces of the magnets 281 to seal the pourer 273 of the bag 42. It is therefore possible to readily and securely seal the pourer 273 of the bag 272.

Figure 54:
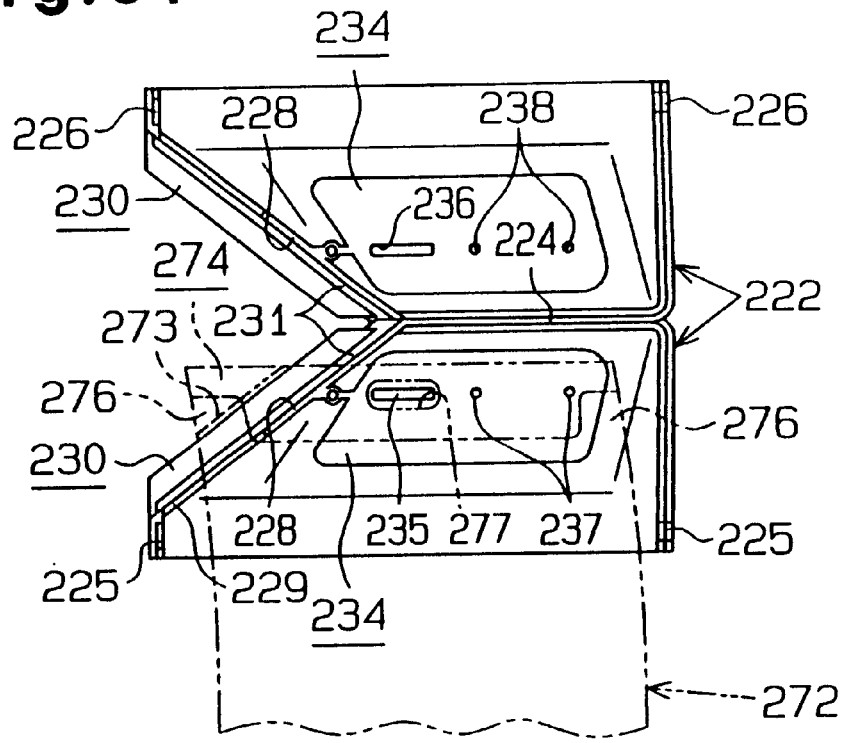
FIG. 54 is a lateral view of a holder according to another embodiment.

As illustrated in FIG. 54, the upper ends of the lids 222 may be coupled through a hinge 224. In this case, the lids 222 pivot about the hinge 224.

The front ends of the lids 222 may be coupled through a hinge 224. In this case, the lids 222 pivot about the hinge 224.

Figure 55:
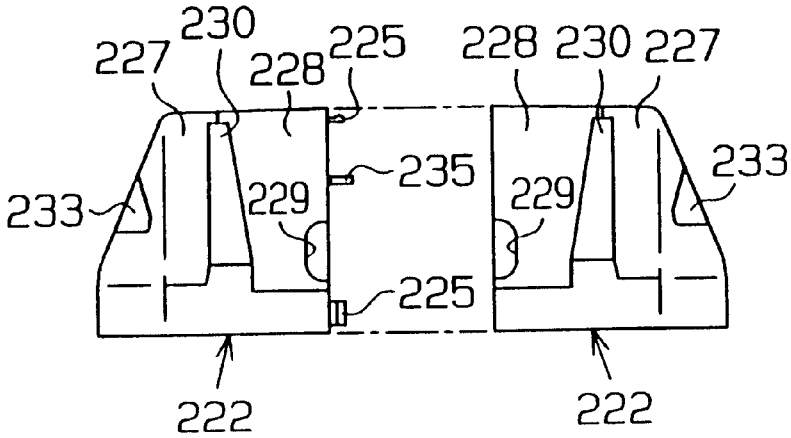
FIG. 55 is a front view of a holder according to another embodiment.

As illustrated in FIG. 55, two separable lids 222 may be used. In this case, the two lids 222 are coupled by an engaging protrusion 225 and an engaging recess 226.

A pair of fastening rails 266 abutting to each other may be formed on the inner faces of the fasteners 265, respectively. In this case, since the pourer 273 of the bag 272 is more locally fastened, the bag 272 is more tightly sealed.

At least one of the lids 222 and the top lid 241 of the cap 223 may be made, for example, of a synthetic resin such as polyethylene, polystyrene, polyethylene terephthalate, polyvinyl chloride, polycarbonate, acrylic resin or the like, aluminum, or water-proof converted paper.

The clip 242 may be made of an elastic material, for example, silicone, natural rubber, synthetic rubber, thermoplastic elastomer or the like.

At least one of the fastening rails 266 and the finger recesses 245 may be omitted. In this case, the structure of the holder 221 can be simplified.

One of the pouring zones 276 provided in the upper welded zone 274 of the bag 272 may be omitted. In this case, the structure of the bag 272 can be simplified.

The positioning piece 235 of the holder 221 may be omitted, and the hanging hole 277 may be omitted. In this case, the bag 272 can also be securely attached to the holder 221 by clamping and fastening the top end of the bag 272 between the clamping faces 234 of the lids 222.

The fixing pins 237 may be omitted. In this case, the bag 272 can also be securely attached between the clamping faces 234 of the lids 222.

The positioning piece 235 may be colored, for example, in red to be prominent. In this case, the hanging hole 277 can be readily hung on the prominent positioning piece 235.

The cap 223 may be connected to one lid 222 by a strap. The strap is preferably made of rubber or nylon. In this case, loss of the cap 223 can be prevented. (See FIG. 37)

A fastening rail 266*a* may be formed on the inner face of the fastener 265 of the clip 242, as indicated by two-dot chain lines in FIG. 45. The fastening rail 266*a* abuts the fasteners 265 between the two fastening rails 266. Since the pourer 273 of the bag 272 is more securely fastened by the fastening rail 266*a,* it is possible to securely prevent the contained liquid 271 from leaking. Further, when the cap 223 is slid to the rear, the pourer 273 of the bag 272 is not deformed, so that the liquid 271 can more smoothly pour out.

Figure 56:
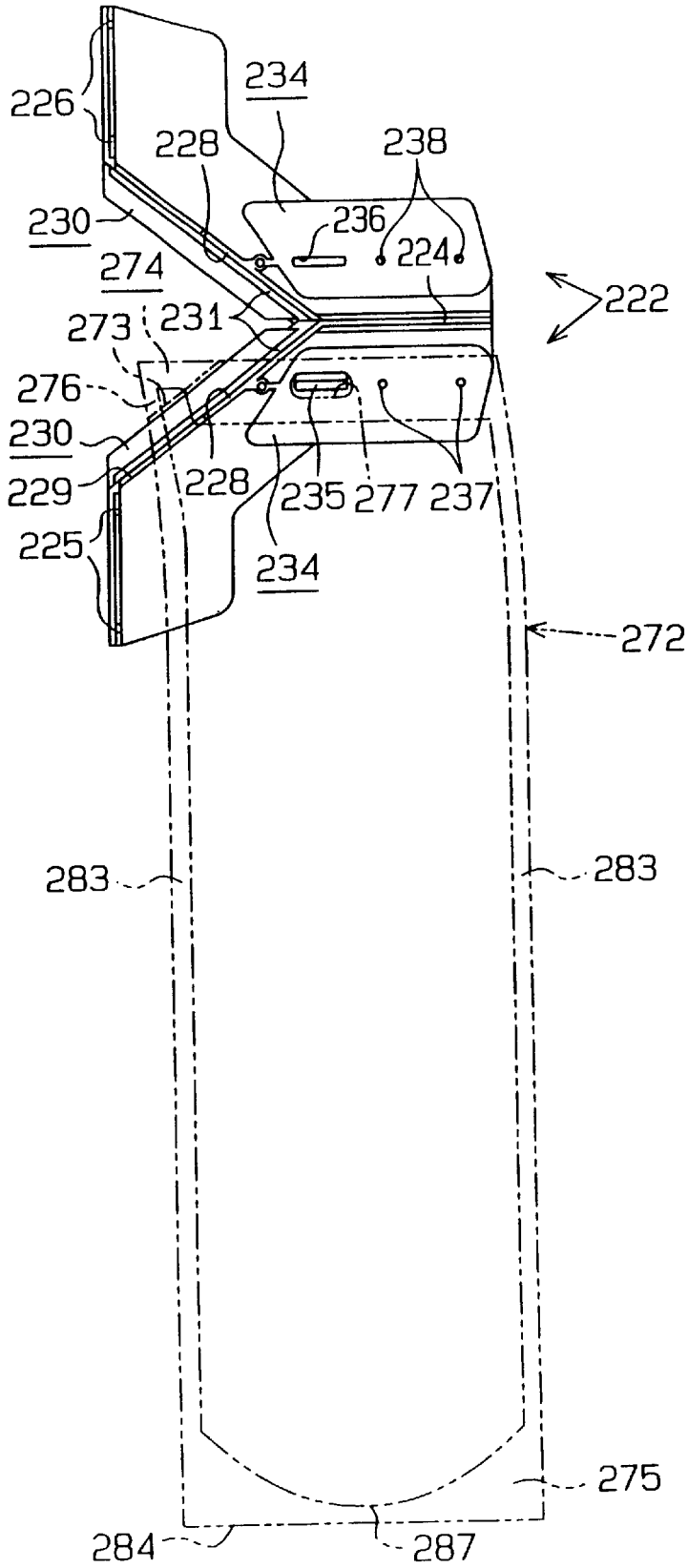
FIG. 56 is a lateral view of a holder according to another embodiment.

As illustrated in FIG. 56, the lids 222 may be connected through a hinge 224 formed on the top wall. Then, an engaging protrusion 225 and an engaging recess 226 corresponding to the engaging protrusion 225 may be formed on mating faces of extended front walls. Further, the front walls of the lids 222 may be formed to extend downward, and the side walls and the rear wall of the lids 222 may be omitted in part. In this case, the upper end of the bag 272 is also clamped between the clamping faces 234 of the lids 222.

The bag 272 may be formed as illustrated in FIGS. 41(*a*) and 41(*b*) such that it can be maintained in an upright state. Also, the holder 221 is preferably reduced in weight to maintain the shape of the bag 272 when the holder 221 is mounted to the upper end of the standing bag 272.

In this case, bags 272 in a variety of shapes can be readily and securely mounted. Specifically, the holder 221 can be readily mounted to an end of the bag 272 that is expanded in the forward and backward directions (width direction), by way of example.

Figure 57:
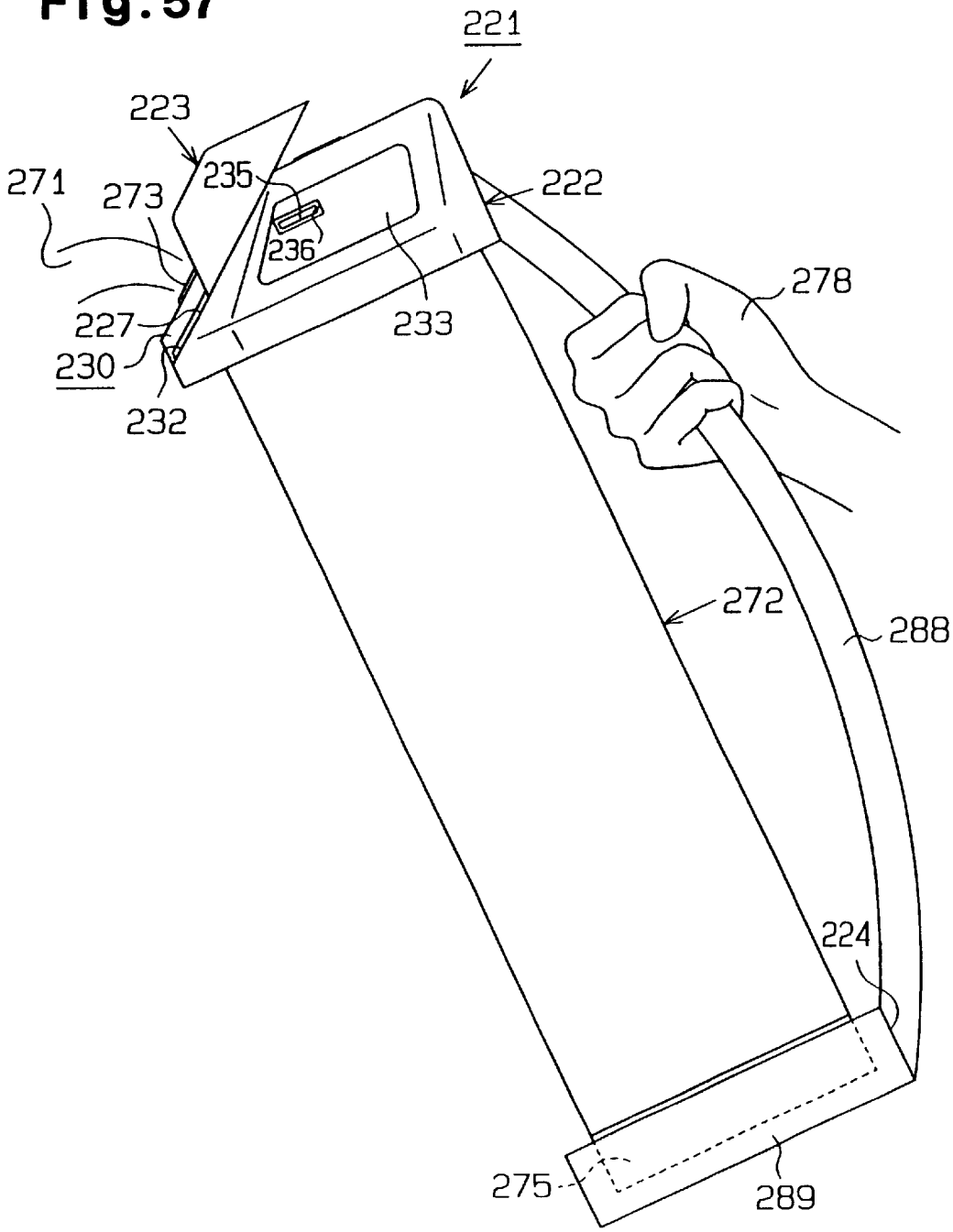
FIG. 57 is a lateral view of a holder according to another embodiment.
Figure 58A:
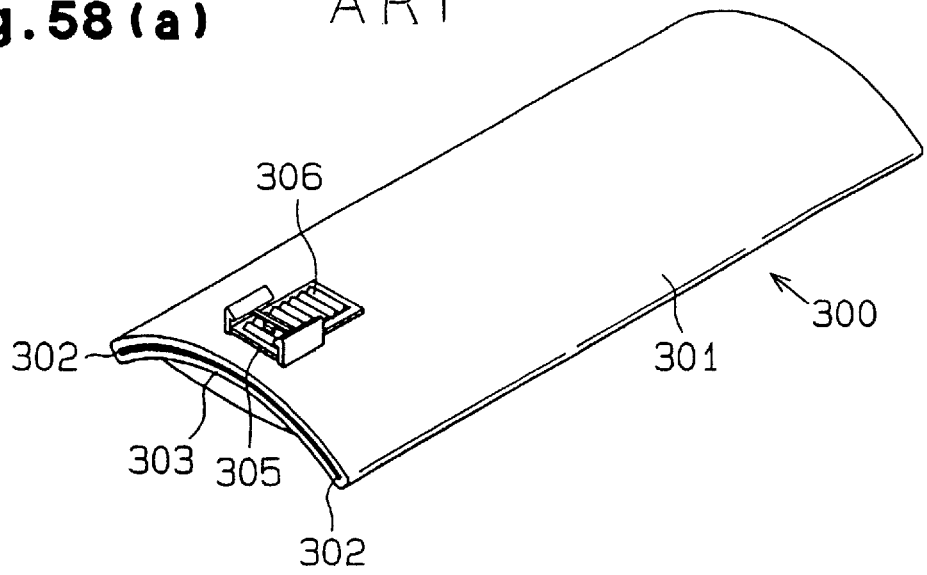
PRIOR ART Fig.58(a)
FIGS. 58(*a*), 58(*b*) are perspective views of a conventional holder.
Figure 58B:
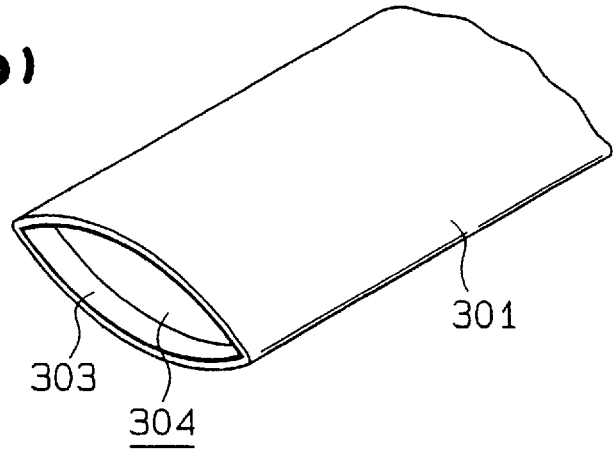
Figure 58C:
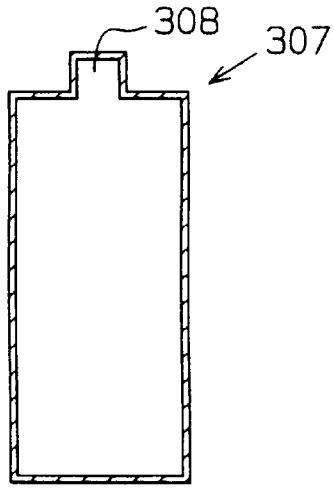

As illustrated in FIG. 57, an arcuate grip 288 connected to the rear portion of the lids 222, and a pair of rectangular or discoidal bases 289 connected to the lower portion of the grip 288 may be provided. The pair of bases 289 can be pivoted in the horizontal direction by a hinge 224 located in the rear end portion. Also, mating faces of the bases 289 are formed to be flat such that they can come into close contact to each other and function as clamping faces. Further, an engaging protrusion and an engaging recess, not shown, are located in front end portions of the bases 289, such that the lower welded zone 275 of the bag 272 is clamped between the clamping faces of the bases 289.

Further, a fixing pin and a fixing hole, not shown, are preferably located on the clamping faces to more securely fix the bag at a predetermined position. Also, a positioning piece, not shown, may be protrusively formed in the central portion of a clamping face, while a positioning recess, not shown, may be formed in the other clamping face for accommodating the positioning piece. In this case, a bag 272 formed with hanging holes through upper and lower end portions is used, and the positioning piece is inserted into the lower hanging hole of the bag 272.

In this case, since the bag 272 can be held in an upright state, the handling of the bag 272 mounted with the holder 221 is easy. Further, since the holder 221 and the bag 272 can be grasped with one hand 278, the liquid 271 can readily pour out of the pourer 273 of the bag 272, and moreover, the flow rate can be more readily adjusted. Also, in this event, since the bag 272 need not be accompanied by the hand 278, the liquid 271 can be prevented from being heated by body heat.

While embodiments of the present invention have been described in connection with the drawings, the present invention is not limited to the foregoing but may be modified within the appended claims and equivalents thereof.

What is claimed is:

1. A container for accommodating a bag that contains a liquid, comprising:

a container body having an opening and capable of opening and closing; and a cap member for closing the opening, the cap member being removable from the container body, the container body including a supporter for supporting an upper end portion of the bag, and an engaging portion for engagement with the cap member; and the cap member including a fastener for clamping an upper end portion of the bag exposed from the opening.

2. The container according to claim 1, wherein the container body has an inclined top surface having the opening, and the engaging portion includes a rail groove formed in the inclined top surface.

3. The container according to claim 1, wherein the container body includes two symmetrical lids, the container body is closed by joining the lids together, and the supporter is formed by opposing edges of the lids.

4. The container according to claim 3, wherein the lids have recesses forming mating faces, which abut to each other when the lids are closed, and the supporter is formed by the mating faces.

5. The container according to claim 1, wherein the fastener has two opposing faces, and at least one of the opposing faces has a rail.

6. The container according to claim 1, wherein the cap member has a blade, and the blade cuts the upper end portion of the bag exposed from the opening when the cap member is moved along the container body.

7. The container according to claim 1, wherein the cap member has a blade, and the blade cuts the upper end portion of the bag exposed from the opening by mounting the cap member to the container body.

8. The container according to claim 1, wherein the container body has a tapering rail for engagement with the fastener, the fastener has a tapering surface that slides against the tapering rail, and the cap member is slid while the tapering rail is sliding on and in contact with the tapering surface to increase a fastening force of the fastener.

9. The container according to claim 1, wherein the fastener includes a pair of magnets, and the upper end portion of the bag is fastened by an attractive force acting between the magnets.

10. The container according to claim 1, wherein the fastener is made of an elastic material.

11. The container according to claim 1, wherein the supporter comprises a fixing pin for fixing the upper end portion of the bag.

12. The container according to claim 1, wherein the upper end portion of the bag has a hanging hole, and the supporter comprises a positioning protrusion for insertion through the hanging hole.

* * * * *

UNITED STATES PATENT AND TRADEMARK OFFICE

CERTIFICATE OF CORRECTION

PATENT NO. : 6,543,644 B2
DATED : April 8, 2003
INVENTOR(S) : Makino et al.

It is certified that error appears in the above-identified patent and that said Letters Patent is hereby corrected as shown below:

Title page,
Item [30], replace "April 4" with -- April 12 --

Signed and Sealed this

Twelfth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,543,644 B2
DATED : April 8, 2003
INVENTOR(S) : Makino et al.

It is certified that error appears in the above-identified patent and that said Letters Patent is hereby corrected as shown below:

Title page,
Item [63], insert -- This application claims priority per 35 U.S.C. §119(a) and §365 to various Japanese Patent Application Numbers:
11/103887, 11/209359, 11/209371, 11/298731, 11/298732. --

Signed and Sealed this

Twenty-seventh Day of January, 2004

JON W. DUDAS
*Acting Director of the United States Patent and Trademark Office*